US010153148B2

(12) United States Patent
Verenchikov

(10) Patent No.: US 10,153,148 B2
(45) Date of Patent: Dec. 11, 2018

(54) ION TRAP MASS SPECTROMETER

(71) Applicant: LECO Corporation, St. Joseph, MI (US)

(72) Inventor: Anatoly N. Verenchikov, St. Petersburg (RU)

(73) Assignee: LECO Corporation, St. Joseph, MI (US)

( * ) Notice: Subject to any disclaimer, the term of this patent is extended or adjusted under 35 U.S.C. 154(b) by 0 days.

(21) Appl. No.: 15/696,770

(22) Filed: Sep. 6, 2017

(65) Prior Publication Data

US 2017/0365457 A1 Dec. 21, 2017

Related U.S. Application Data

(62) Division of application No. 14/798,206, filed on Jul. 13, 2015, now Pat. No. 9,768,008, which is a division
(Continued)

(30) Foreign Application Priority Data

Jan. 15, 2010 (GB) ..... 1000649.2

(51) Int. Cl.
*H01J 49/28* (2006.01)
*H01J 49/42* (2006.01)
(Continued)

(52) U.S. Cl.
CPC ..... *H01J 49/282* (2013.01); *H01J 49/0031* (2013.01); *H01J 49/0036* (2013.01);
(Continued)

(58) Field of Classification Search
USPC ..... 250/287, 397
See application file for complete search history.

(56) References Cited

U.S. PATENT DOCUMENTS 4,072,862 A 2/1978 Mamyrin et al.
4,731,532 A 3/1988 Frey et al.
(Continued)

FOREIGN PATENT DOCUMENTS

GB 2080021 A 1/1982
JP 2000162189 A 6/2000
(Continued)

OTHER PUBLICATIONS

International Search Report dated Apr. 7, 2011 relating to International Application No. PCT/IB2010/055395.
(Continued)

*Primary Examiner* — Kiet T Nguyen
(74) *Attorney, Agent, or Firm* — Honigman Miller Schwartz and Cohn LLP

(57) ABSTRACT

An apparatus 41 and operation method are provided for an electrostatic trap mass spectrometer with measuring frequency of multiple isochronous ionic oscillations. For improving throughput and space charge capacity, the trap is substantially extended in one Z-direction forming a reproduced two-dimensional field. Multiple geometries are provided for trap Z-extension. The throughput of the analysis is improved by multiplexing electrostatic traps. The frequency analysis is accelerated by the shortening of ion packets and either by Wavelet-fit analysis of the image current signal or by using a time-of-flight detector for sampling a small portion of ions per oscillation. Multiple pulsed converters are suggested for optimal ion injection into electrostatic traps.

4 Claims, 32 Drawing Sheets

Related U.S. Application Data of application No. 13/522,458, filed as application No. PCT/IB2010/055395 on Nov. 24, 2010, now Pat. No. 9,082,604.

(51) Int. Cl.
*H01J 49/40* (2006.01)
*H01J 49/00* (2006.01)
*H01J 49/06* (2006.01)

(52) U.S. Cl.
CPC ..... *H01J 49/062* (2013.01); *H01J 49/40* (2013.01); *H01J 49/401* (2013.01); *H01J 49/406* (2013.01); *H01J 49/4245* (2013.01)

(56) References Cited

U.S. PATENT DOCUMENTS

| | | | | |
|---|---|---|---|---|
| 5,017,780 | A | 5/1991 | Kutscher et al. | |
| 5,206,506 | A * | 4/1993 | Kirchner | G21K 1/003 250/281 |
| 5,880,466 | A | 3/1999 | Benner | |
| 5,886,346 | A | 3/1999 | Makarov | |
| 6,013,913 | A | 1/2000 | Hanson | |
| 6,300,625 | B1 | 10/2001 | Ishihara | |
| 6,744,042 | B2 | 6/2004 | Zajfman et al. | |
| 6,888,130 | B1 | 5/2005 | Gonin | |
| 8,933,397 | B1 * | 1/2015 | Hanson | H01J 49/42 250/287 |
| 2003/0236636 | A1 | 12/2003 | Yoshinari et al. | |
| 2011/0215235 | A1 * | 9/2011 | Schoen | H01J 49/26 250/282 |

FOREIGN PATENT DOCUMENTS

| | | | |
|---|---|---|---|
| JP | 2004028782 | A | 1/2004 |
| JP | 2005-79037 | A | 3/2005 |
| JP | 2007046966 | A | 2/2007 |
| JP | 2007526596 | A | 9/2007 |
| JP | 2008138621 | A | 6/2008 |
| JP | 2008544472 | A | 12/2008 |
| JP | 2009-512162 | A | 3/2009 |
| JP | 2010531038 | A | 9/2010 |
| SU | 1725289 | A1 | 4/1992 |
| WO | WO-2005001878 | A2 | 1/2005 |
| WO | WO-2006102430 | A2 | 9/2006 |
| WO | WO-2008047891 | | 4/2008 |
| WO | WO-2008047891 | A2 | 4/2008 |
| WO | WO-2009001909 | | 12/2008 |
| WO | WO-2009001909 | A2 | 12/2008 |

OTHER PUBLICATIONS

English translation of Japanese Office Action for Application No. 2012-548488 dated Jan. 28, 2014.

Japanese Office Action dated Oct. 4, 2016, relating to Application No. 2015-171805, with English translation.

Non-Final Office Action dated May 20, 2014, from the U.S. Patent and Trademark Office relating to U.S. Appl. No. 13/522,458.

* cited by examiner

ION TRAP MASS SPECTROMETER

CROSS-REFERENCE TO RELATED APPLICATIONS

This Application is a Division of application Ser. No. 14/798,206 filed on Jul. 13, 2015, which is a Division of application Ser. No. 13/522,458 filed on Dec. 4, 2012, now U.S. Pat. No. 9,082,604, which is a 371 of International Application No. PCT/IB2010/055395 filed on Nov. 24, 2010, which claims priority for Application 1000649.2 filed on Jan. 15, 2010 in the United Kingdom. The entire contents of these applications are incorporated herein by reference in their entirety.

FIELD

The disclosure relates to time-of-flight mass spectrometers and electrostatic traps for trapping and analyzing charged particles.

BACKGROUND

Electrostatic trap (E-Trap) and multi-pass time-of-flight (MP-TOF) mass spectrometers (MS) generally appear to share one common feature—the analyzer electrostatic fields are designed to provide an isochronous ion motion with respect to small initial energy, angular, and spatial spreads of the ion packets. In MP-TOF MS, ion packets follow a predetermined folded ion path from a pulsed source to a detector, and ion mass-to-charge ratio (m/z) is determined from the ion flight time (T), where $T \sim (m/z)^{0.5}$. In E-Trap MS, ions are trapped indefinitely and the ion flight path is not fixed. Ion m/z is determined from the frequency (F) of ion oscillations, where $F \sim (m/z)^{-0.5}$. The signal from an image charge detector is analyzed with the Fourier transformation (FT).

Both techniques are challenged to provide a combination of the following parameters: (a) spectral acquisition rate up to 100 spectra a second in order to match speed of GC-MS, LC-IMS-MS, and LC-MS-MS experiments; (b) ion charge throughput from 1E+9 to 1E+11 ions/sec in order to match ion flux from modern ion sources like ESI (1E+9 ion/sec), EI (1E+10 ion/sec) and ICP (1E+11 ion/sec); and (c) mass resolving power in the order 100,000 to provide mass accuracy under part-per-million (ppm) for unambiguous identification in highly populated mass spectra.

TOF MS: High resolution TOF MS developments have been made with the introduction of electrostatic ion mirrors. Mamyrin et al in U.S. Pat. No. 4,072,862, incorporated herein by reference, appears to suggest using a double stage ion mirror to reach second-order time per energy focusing. Frey et al in U.S. Pat. No. 4,731,532, incorporated herein by reference, appears to suggest introducing grid-free ion mirrors with a decelerating lens at the mirror entrance to provide a spatial ion focusing and to avoid ion losses on meshes. Aberrations of grid-free ion mirrors have been improved by incorporation of an accelerating lens by Wollnik et al in Rapid Comm. Mass Spectrom., v.2 (1988) #5, 83-85, incorporated herein by reference. From that point it became apparent that the resolution of TOF MS is no longer limited by analyzer aberrations, but rather by the initial time spread appearing in the pulsed ion sources. To diminish effects of the initial time spread one should extend the flight path.

Multi-Pass TOF MS: One type of MP-TOF, a multi-reflecting MR-TOF MS arranges a folded W-shaped ion path between electrostatic ion mirrors to maintain a reasonable size of the instrument. Parallel ion mirrors covered by grids has been described by Shing-Shen Su, Int. J. Mass Spectrom. Ion Processes, v.88 (1989) 21-28, incorporated herein by reference. To avoid ion losses on grids, Nazarov et al in SU1725289, incorporated herein by reference, suggested gridless ion mirrors. To control ion drift, Verenchikov et al in WO2005001878, incorporated herein by reference, suggested using a set of periodic lenses in a field-free region. Another type of MP-TOF—so called Multi-turn TOF (MT-TOF) employs electrostatic sectors to form spiral loop (race-track) ion trajectories as described in Satoh et al, J. Am. Soc. Mass Spectrom., v.16 (2005) 1969-1975, incorporated herein by reference. Compared to MR-TOF, the spiral MT-TOF has notably higher ion optical aberrations and can tolerate much smaller energy, angular and spatial spreads of ion packets. The MP-TOF MS provide mass resolving power in the range of 100,000 but they are limited by space charge throughput estimated as 1E+6 ions per mass peak per second.

E-Trap MS with TOF Detector: Ion trapping in electrostatic traps (E-trap) allows further extension of the flight path. GB2080021 and U.S. Pat. No. 5,017,780, both incorporated herein by reference, suggest I-path MR-TOF where ion packets are reflected between coaxial gridless mirrors. Looping of ion trajectories between electrostatic sectors is described by Ishihara et al in U.S. Pat. No. 6,300,625, incorporated herein by reference. In both examples, ion packets are pulsed injected onto a looped trajectory and after a preset delay the packets are ejected onto a time-of-flight detector. To avoid spectral overlaps, the analyzed mass range is shrunk reverse proportional to number of cycles which is the main drawback of E-Traps with a TOF detector.

E-Trap MS with Frequency Detector: To overcome mass range limitations I-path electrostatic traps (I-Path E-Trap) employ an image current detector to sense the frequency of ion oscillations as suggested in U.S. Pat. Nos. 6,013,913A, 5,880,466, 6,744,042, Zajfman et al Anal. Chem, v.72 (2000) 4041-4046, incorporated herein by reference. Such systems are referred as I-path E-traps or Fourier Transform (FT) I-path E-traps and form part of the prior art (FIG. 1). In spite of the large size analyzer (0.5-1 m between mirror caps), the volume occupied by ion packets is limited to ~1 $cm^3$. A combination of low oscillation frequencies (under 100 kHz for 1000 amu ions) and low space charge capacity (1E+4 ions per injection) either severely limit an acceptable ion flux or lead to strong space charge effects, such as self-bunching of ion packets and peaks coalescence.

Orbital E-Traps: In U.S. Pat. No. 5,886,346 Makarov, incorporated herein by reference, suggested electrostatic Orbital Trap with an image charge detector (trade mark 'Orbitrap'). The Orbital Trap is a cylindrical electrostatic trap with a hyper-logarithmic field (FIG. 2). Pulsed injected ion packets rotate around the spindle electrode in order to confine ions in the radial direction, and oscillate in a nearly ideal harmonic axial field. It is relevant to the present invention that the field type and the requirement of stable orbital motion locks the relationship between characteristic length and radius of the Orbitrap, and do not allow substantial extension of a single dimension of the trap. In WO2009001909 Golikov et al, incorporated herein by reference, suggested a three-dimensional electrostatic trap (3D-E-trap) also incorporating orbital ion motion and image charge detection. However, the trap is even more complex than Orbitrap. An analytically defined electrostatic field defines 3-D curved electrodes with sizes linked in all three directions. Though linear electrostatic field (quadratic potential) of the Orbital trap extends the space charge capacity of the analyzer, still ion packets are limited to 3E+6 ions/per injection by the capacity of so-called C-trap and by the necessity to inject ion packets into the Orbitrap via a small (1 mm) aperture (Makarov el al, JASMS, v.20, 2009, No. 8, 1391-1396, incorporated herein by reference). The orbital trap suffers slow signal acquisition—it takes one second for obtaining spectra with 100,000 resolution at m/z=1000. Slow acquisition speed, in combination with the limited charge capacity does limit the duty cycle to 0.3% in most unfavorable cases.

Thus, in the attempt of reaching high resolution, the prior art MP-TOF and E-traps do limit throughput (i.e. combination of the acquisition speed and the charge capacity) of mass analyzers under 1E+6 to 1E+7 ions per second, which limits effective duty cycle under 1%. The data acquisition speed of E-traps is limited to 1 spectrum a second at resolution of 100,000.

It is an object of at least one aspect of the present invention to obviate or mitigate at least one or more of the aforementioned problems.

It is a further object of at least one aspect of the present invention to improve the acquisition speed and the duty-cycle of high resolution electrostatic traps in order to match the intensity of modern ion sources exceeding about 1E+9 ions/sec and to bring the acquisition speed to about 50-100 spectra/sec required by tandem mass spectrometry while keeping the resolving power at about 100,000.

SUMMARY

Space charge capacity and throughput of electrostatic traps (E-trap) with ion frequency detection can be substantially improved by substantially extending electrostatic traps in a Z-direction which is substantially locally orthogonal to a plane of isochronous ion motion (see, e.g., FIG. 3). The extension leads to reproduction of the field structure and sustains the same ion oscillation frequency along the Z-axis (or substantially along the Z-axis). This differs from I-path and Orbital E-traps of the prior art (FIG. 1 and FIG. 2) where all three dimensions of the E-trap are linked due to the employed field structures and topologies.

Multiple implementations are proposed for extended electrostatic fields (as shown, e.g., in FIG. 4 and FIG. 5) comprising two dimensional planar (P-2D) and torroidal (T-2D) fields, spatially modulated fields with 3-D repeating sections, so as multiplexing of those fields (FIG. 5). The novel fields may be also used in TOF and open E-trap mass analyzers.

Extension of the E-trap field can allow for the use of extending ion pulsed converters and the use of novel enhanced schemes of ion injection (FIG. 12 to FIG. 18) while employing novel RF and electrostatic pulsed converters. Extended fields allow mass selection between trap regions and MS-MS analysis within E-traps.

Embodiments discussed herein also disclose methods for analysis acceleration in E-traps by using much shorter ion packets (relative to E-trap X-size) and by detecting the frequency of multiple ion oscillations either with an image charge detector or with a TOF detector sampling a portion of ion packets per oscillation. The overlapping signals from multiple ionic components and from multiple oscillation cycles are capable of being deciphered either by the method of peak shape fitting (called Wavelet-fit), or by analyzing with the Fourier Transformation method while employing higher harmonics, optionally complimented by a logical analysis of the spectral overlaps or by analysis of frequency spectral patterns. Alternatively, spectral acquisition is accelerated by using Filter Diagonalization Method (FDM) of longer ion packets forming nearly sinusoidal signals.

Use of the extended electrostatic fields can extend the spatial volume, while allowing small ion path per single ion oscillation, usually about equal to X-size of electrostatic ion traps. While high resolution is provided by the isochronous properties of the trapping fields, the duty cycle, the space charge capacity, and the space charge throughput of the novel E-trap are enhanced by at least one or any combination of the following:

- By a larger volume occupied by ion packets within the Z-extended E-trap;
- By a shorter ion path per single oscillation, which allows higher oscillating frequencies and faster data acquisition;
- By Z-extension of pulsed converters improving their charge capacity and duty cycle;
- By using novel types of enhanced pulsed converters;
- By using multiple image current detectors;
- By using a novel principle of sampling small portion of ion assembly onto a time-of-flight detector, which allows using much shorter ion packets and dramatically accelerates spectral acquisition so as sensitivity of E-traps;
- By the multiplexing of E-trap analyzers for parallel analysis of multiple ion flows, ion flow portions, or time slices of ion flow;
- By resonant ion selection and MS-MS features within the novel E-trap;
- By using spectral analysis methods for short ion packets or an FDM type methods for long ion packets.

The disclosed E-trap can overcome limited space charge capacity of the mass analyzers and of the pulsed converters and limited dynamic range of the detectors and the low duty-cycle of pulsed converters, among having other potential benefits. In an implementation, the disclosed apparatuses and methods improve spectral acquisition to about 50-100 spectra/sec when using image charge detection and up to about 500-1000 spectra/sec when using TOF detectors which makes the novel E-trap well compatible with chromatographic separations and tandem mass spectrometry.

In an implementation, there is provided an electrostatic ion trap (E-trap) mass spectrometer comprising:

(a) at least two parallel sets of electrodes separated by a field-free space;

b) each of said two electrode sets forming a volume with two-dimensional electrostatic field in an X-Y plane;

(c) the structure of said fields is adjusted to provide both—stable trapping of ions passing between said fields within said X-Y plane and isochronous repetitive ion oscillations within said X-Y plane such that the stable ion motion does not require any orbital or side motion; and (d) wherein said electrodes are extended along a generally curved Z-direction locally orthogonal to said X-Y plane to form either planar or torroidal field regions.

In an implementation, the ratio of Z width of said electrostatic trapping fields to the ion path per single ion oscillation is larger than one of the group: (i) 1; (ii) 3; (iii) 10; (iv) 30; and (v) 100. Most preferably, said ratio is between 3 and 30. In an implementation, said ion oscillations in X-Y plane are isochronous along a generally curved reference ion trajectory T which can be characterized by an average ion path per single oscillation. In an implementation, the ratio of Z width of said electrostatic trapping fields to ion Z-displacement per single ion oscillation is larger than one of the group: (i) 10; (ii) 30; (iii) 100; (iv) 300; and (v) 1000. The X-direction is chosen to be aligned with the isochronous reference trajectory T in at least one point. Then the ion path per single ion oscillation is comparable to X-size of the E-trap. Preferably, the ratio of average velocities in Z- and T-directions is smaller than one of the group: (i) 0.001; (ii) 0.003; (iii) 0.01; (iv) 0.03; (v) 0.1; (vi) 0.3; (vii) 1; (viii) 2; and (ix) 3; and most preferably, said ratio stays under 0.01.

In one particular group of embodiments, the trap may be designed for a rapid data acquisition at accelerated oscillation frequencies. In an implementation, the acceleration voltage of the electrostatic trap is larger than one of the group: (i) 1 kV; (ii) 3 kV; (iii) 5 kV; (iv) 10 kV; (v) 20 kV; and (vi) 30 kV. In an implementation, the acceleration voltage is between 5 and 10 kV. In an implementation, the ion path per single oscillation is smaller than one of the group: (i) 100 cm; (ii) 50 cm; (iii) 30 cm, (iv) 20 cm; (v) 10 cm, (vi) 5 cm; and (vii) 3 cm. In an implementation, said path is under 10 cm. In an implementation, the ratio of ion path per single oscillation to transverse Y-width of said electrostatic trapping field is larger than one of the group: (i) 1; (ii) 3; (iii) 10; (iv) 30; and (v) 100. In an implementation, the ratio is between 20 and 30. In an implementation, the above parameters are chosen to increase frequency F of ion oscillations of m/z=1000 amu ions above one of the group: (i) 0.1 MHz; (ii) 0.3 MHz; and (iii) 1 MHz, and most preferably, F is between 0.3 and 1 MHz.

The specified trapping electrostatic fields, at least within the region of ion motion, may be purely two-dimensional, substantially two-dimensional or may have repetitive three-dimensional sections either connected or separate. In one group of embodiments, said electrostatic fields are two-dimensional, independent on the Z-direction, and the field component along the Z-direction $E_Z$ is either zero, or constant, or changes linearly in the Z-direction. Yet in another group of embodiments, said electrode sets are substantially extended in the third Z-direction to periodically repeat three-dimensional field sections E(X,Y,Z) along the Z-direction.

The topology of said two-dimensional electrostatic fields may be formed by linear or curved extension of said E-trap electrodes. In one group of embodiments, said Z-axis is straight, in another—said Z-axis is curved to form torroidal field structures. In an implementation, the ratio of the curvature radius R to ion path $L_1$ per single oscillation is larger than one of the group: (i) 0.3; (ii) 1; (iii) 3; (iv) 10; (v) 30; and (vi) 100. In an implementation, the ratio $R/L_1>50*\alpha^2$, where $\alpha$ is an inclination angle between ion trajectory and X axis in X-Z plane in radians. The requirement is set for resolving power Res=300,000 and may be softened as $R\sim(Res)^{-1/2}$. In an implementation, torroidal E-traps comprise at least one electrode for ion radial deflection. In an implementation, said Z-axis is curved at constant radius to form torroidal field regions; and wherein the angle $\phi$ between the curvature plane and said X-Y plane is one of the group: (i) 0 deg; (ii) 90 deg; (iii) $0<\phi<180$ deg; (iv) $\phi$ is chosen depending on the ratio of the curvature radius to X-size of said trap in order to minimize the number of trap electrodes.

The electrostatic fields of said E-trap may be formed with a variety of electrode sets, which may include a broader class than the presented examples. In an implementation, the geometry of said electrode sets is one of the geometries shown in FIG. 4. In an implementation, said electrode sets comprises a combination of electrodes of the group: (i) an ion mirror; (ii) an electrostatic sector; (iii) a field-free region; (iv) an ion lens; (v) a deflector; and (vi) a curved ion mirror having features of an electrostatic sector. In an implementation, said at least two electrode sets are parallel or coaxial. In an implementation, the class of E-trap electrodes comprises the ion mirrors since they are known to provide high-order spatial and time-of-flight focusing. In one group of the disclosed embodiments, said electrode set comprises at least one ion mirror reflecting ions in a first X-direction. Preferably, at least one ion mirror comprises at least one electrode with an attracting potential which is at least twice larger than the acceleration voltage. In an implementation, said at least one ion mirror has at least three parallel electrodes with distinct potentials. In an implementation, said at least one ion mirror comprises at least four parallel electrodes with distinct potentials and an accelerating lens electrode for providing a third-order time-of-flight focusing in the first X-direction with respect to ion energy. In one embodiment, at least a portion of said ion mirror provides a quadratic distribution of electrostatic potential in said first X-direction. In one group of embodiments, said electrode set comprises at least one ion mirror and at least one electrostatic sector separated by a field-free space.

In an implementation, said electrostatic trap further comprises bounding means in said Z-direction for indefinite ion trapping in non-enclosed 2D fields. The bounding means automatically appear in torroidal enclosed fields. The primary concern of the invention is the retention of the trap isochronous properties. Though not limiting, said ion bounding means in the Z-direction may comprise one of the group: (i) an electrode with retarding potential at Z-edge of a field-free region; (ii) an uneven Z-size of the electrodes of said electrode set for distorting said E-trap field at the Z-edge; (iii) at least one auxiliary electrode for uneven in Z-direction penetration of auxiliary field through a slit in at least one electrode or at least one gap between electrodes of said electrode set; (iv) at least one electrode of said electrode set being bent around Z-axis near the Z-edges of said trap; (v) Matsuda electrodes at Z-boundaries of electrostatic sectors; and (vi) split sections at Z-edge of the mirror or the sector electrodes being electrically biased. The bounding means in Z-direction may comprise a combination of at least two repulsing means of said group for mutual compensation of the ion frequency distortions. Alternatively, ion packets are focused in the Z-direction by spatial modulation of said trapping electrostatic fields; and wherein the strength of said focusing is limited to maintain the desired level of ion motion isochronicity. Such means would localize ions in multiple Z-regions.

The detector for measuring frequency of ion oscillations may comprise an image charge detector or a TOF detector sampling a portion of ion packets per single oscillation. In an implementation, said detector for measuring frequency of ion oscillations is located in the plane of temporal ion focusing and the E-trap is tuned to reproduce position of the ion temporal focusing per multiple oscillations. In an implementation, the X-length of said ion packets is adjusted much shorter compared to the X-size of the E-trap.

In one group of embodiments, said detector for measuring the frequency of ion oscillations comprises at least one electrode for sensing image current induced by ion packets. In an implementation, the ratio of ion packets length to ion path per single oscillation is smaller than one of the group: (i) 0.001; (ii) 0.003; (iii) 0.01; (iv) 0.03; (v) 0.1; (vi) 0.3; (v) 0.5. In one embodiment, the X-size of ion packets is comparable to both—the X-length of said image charge detector and the Y-distance from ion packets to said image charge detector. In one embodiment, said image charge electrode comprises multiple segments aligned either in X or Z-directions. In an implementation, said multiple segments are connected to multiple individual preamplifiers and data acquisition channels. The particular arrangements of multi-electrode detector may be optimized for at least one purpose of the group: (i) improving the resolving power of the analysis per the acquisition time; (ii) enhancing the signal-to-noise ratio and the dynamic range of the analysis by adding multiple signals with account of individual phase shifts for various m/z ionic components; (iii) enhancing signal-to-noise ratio by using narrow bandwidth amplifiers on different channels; (iv) decreasing capacitance of individual detectors; (v) compensating parasitic pick-up signals by differential comparison of multiple signals; (vi) improving the deciphering of the overlapping signals of multiple m/z ionic components due to variations between signals in multiple channels; (vi) utilizing phase-shifts between individual signals for spectral deciphering; (vii) picking up common frequency lines in the Fourier analysis; (viii) assisting the deciphering of sharp signals from the short detector segments by the Fourier transformation of signals from a larger size detector segments; (ix) compensating a possible shift of temporal ion focusing position; (x) multiplexing the analysis between separate Z-regions of said electrostatic trap; (xi) measuring the homogeneity of ion trap filling by ions; (xii) testing the controlled ion passage between different Z-regions of said electrostatic trap; and (xiii) measuring the frequency shifts at Z-edges for controllable compensation of frequency shifts at said Z-edges. Ions may be m/z separated between z-regions of E-trap for narrow-band signal detection within individual Z-regions and better spectral deciphering.

In another group of embodiments, said detector for measuring the frequency of ion oscillations comprises a time-of-flight detector sampling a portion of the ion assembly per one oscillation. In an embodiment, said portion is one of the group: (i) 10% to 100%; (ii) 1 to 10%; (iii) 0.1 to 1%; (iv) 0.01 to 0.1%; (v) 0.001 to 0.01%; and (vi) less than 0.001%. In an embodiment, said portion is controlled electronically, e.g. by adjusting at least one potential or by adjusting a magnetic field surrounding said E-trap. In an implementation, said time-of-flight detector further comprises an ion-to-electron converting surface and means for attracting thus formed secondary electrons onto the time-of-flight detector; wherein said converting surface occupies a fraction of the ion path. Further preferably, said ion-to-electron converting surface comprises one of the group: (i) a plate; (ii) a perforated plate; (iii) a mesh; (iii) a set of parallel wires; (iv) a wire; (v) a plate covered by a mesh with different electrostatic potential; (v) a set of bipolar wires. In one group of particular embodiments, said time-of-flight detector is located within a detection region of said electrostatic trap and wherein said detection region is separated from the main trap volume by an adjustable electrostatic barrier in Z-direction.

In an implementation, the life-time of TOF detector is improved. In an embodiment, the TOF detector comprises two amplification stages, wherein the first stage may be a conventional MCP or SEM. Preferably, the life time of the second stage is extended by at least one mean of the group: (i) using pure metallic and non modified materials for dynodes; (ii) using multiple dynodes for collecting signals into multiple channels; (iii) picking image charge signal at higher amplification stages; (iv) protecting higher amplification stages of the detector by feeding an inhibiting potential from earlier amplification stages being amplified by a fast reacting vacuum lamp; (v) using mesh for retarding secondary electrons at some higher amplification stages and feeding the mesh by an amplified signal from earlier amplification stages; (vi) using a signal from an image charge detector for triggering the TOF detection below some threshold signal intensity; (vii) for the second amplification stage using a scintillator in combination with either a sealed PMT, or a pin diode, or an avalanche diode or a diode array.

The current disclosure proposes multiple embodiments of the pulsed converters particularly suited for the novel E-trap. In one embodiment, said electrostatic trap further comprises a radiofrequency (RF) pulsed converter for ion injection into said E-trap; and wherein said pulsed converter comprises a linear ion guide extended in the Z-direction and having means for ion ejection substantially orthogonal to the Z-direction. In another embodiment, said electrostatic trap further comprises an electrostatic pulsed converter for confining a continuous ion beam (prior to ion injection into said E-trap), either in a form of an electrostatic ion trap or an electrostatic ion guide. Preferably, the length of ion packets along the direction of ion oscillations is adjusted much shorter compared to the path of single oscillation.

In a more general form, said electrostatic trap may further comprise a pulsed converter which may have means for ion confinement within a fine ribbon space, said ribbon space may be substantially extended in one direction. Preferably, the distance between said ribbon space and said electrostatic trap may be at least three times smaller than the ion path per single oscillation in order to expand the m/z span of injected ions. In one embodiment, said pulsed converter may comprise a linear RF ion trap with an aperture or a slit for axial ion ejection. Then said ribbon region may be preferably oriented substantially in the X-direction. In another embodiment, said pulsed converter may be oriented substantially parallel to the Z-direction in order to align the converter with the extended electrostatic trap mass analyzer.

In one group of embodiments, said pulsed converter may comprise a linear radio-frequency (RF) ion guide with radial ion ejection either through a slit in one electrode or between electrodes. In an implementation, said RF ion guide may comprise a circuit and ion admission means for controlling the ion filling time into said RF guide. In an implementation, the gaseous conditions of said linear RF guide may comprise any one of or combination of the group: (i) a substantially vacuum condition; (ii) a temporarily gaseous condition produced by a pulsed gas injection with subsequent pumping down prior to ion injection; and (iii) a vacuum condition wherein ion dampening occurs in an additional upstream gaseous RF ion guide. In one group of embodiments, the same RF converter may protrude between at least two stages of differential pumping without distorting said radial RF field; wherein the gas pressure drops from substantially gaseous conditions upstream to substantially vacuum conditions downstream; and wherein ion communication between said RF converter regions comprises at least one of or any combination of the group: (i) a communication which allows ion free exchange between said gaseous and said vacuum regions; (ii) a communication which allows ion free propagation from said gaseous region into said vacuum region for the time between ion ejections; (iii) a communication which allows ion pulsed admission from gaseous region into said vacuum region of said RF converter; and (iv) a communication which allows ions returning from said vacuum region into said gaseous region of said RF converter. To reduce gas load between pumping stages, the converter may comprise a curved portion.

In one group of embodiments, said linear RF converter may comprise trapping means in the Z-direction; and wherein said trapping means may comprise one means of the following group: (i) at least one edge-electrode for generating an edge RF field; (ii) at least one edge electrode for generating an edge electrostatic field; (iii) at least one auxiliary electrode for generating an RF field penetrating through said converter electrodes; (iv) at least one auxiliary electrode for generating an auxiliary electrostatic field penetrating through said converter electrodes; (v) geometrically altered converter electrodes to form a three dimensionally distorted radial RF field; and (vi) sectioned converter electrodes connected to DC bias supply. Preferably, said Z-trapping means are connected to a pulsed power supply.

In another embodiment, said pulsed converter may comprise a set of parallel electrodes with spatially alternated electrostatic potentials (electrostatic ion guide) for periodic spatial focusing and confinement of a low divergent continuous ion beam. Yet in another embodiment, the pulsed converter may comprise an equalizing electrostatic trap, said trap accumulates fast oscillating ions and pulse release the ion content into the main analytical E-trap. The embodiment allows forming m/z independent elongated ion packets and forming a nearly sinus detector signal at main oscillation frequency.

This disclosure also proposes multiple embodiments of specially tailored injection means for efficient injection of spatially extended ion packets into the novel E-trap. In one group of embodiments, said ion injection means may comprise a pulsed voltage supply for switching potentials of electrodes of said electrostatic trap between the stages of ion injection and ion oscillation. The ion injection means may comprise at least one or more of the following group: (i) an injection window in a field-free region; (ii) a gap between electrodes of said electrostatic trap; (iii) a slit in an outer electrode of said electrostatic trap; (iv) a slit in the outer ion mirror electrode; (v) a slit in at least one sector electrode; (vi) an electrically isolated section of at least one electrode of said electrostatic trap with a window for ion admission; and (vii) at least one auxiliary electrode for compensating field distortions introduced by an ion admission window. In a group of embodiments, said ion injection means may comprise one deflecting means of one or more of the group: (i) a curved deflector for turning the ion trajectory; (ii) at least one deflector for steering the ion trajectory; and (iii) at least one pair of deflectors for displacing the ion trajectory. One deflecting device of said group may be pulsed. In one group of embodiments, for the purpose of keeping said pulsed ion source or said ion converter at nearly ground potential during the ion filling or the ion packet formation stage while keeping said ion detector at substantially ground potential, said injection means may comprise at least one or more energy adjusting means of the group: (i) a power supply for an adjustable floating of said pulsed converter prior to ion ejection; (ii) an electrode set for pulsed acceleration of ion packets out of the pulsed ion source or the pulsed converter; and (iii) an elevator electrode located in-between said pulsed converter and said electrostatic trap, said elevator being pulsed floated during the passage of ion packets through said elevator electrode.

The novel E-trap mass spectrometer is compatible with chromatography, tandem mass spectrometry and with other separation methods. The E-trap may comprise ion separation means preceding said electrostatic trap; and wherein said separation means may comprise one or more of the group: (i) a mass-to-charge separator; (ii) a mobility separator; (iii) a differential mobility separator; and (iv) a charge separator. The mass spectrometer may further comprise one or more fragmentation means of the group: (i) a collisional induced dissociation cell; (ii) an electron attachment dissociation cell; (iii) an anion attachment dissociation cell; (iv) a cell for dissociation by metastable atoms; and (v) a cell for surface induced dissociation. Prior to analyte ionization and to ion analysis, said E-trap mass spectrometer may comprise one analyte separation means of the group: (i) a gas chromatograph; (ii) a liquid chromatograph; (iii) a capillary electrophoresis; and (iv) an affinity separator.

This disclosure further proposes MS-MS features within the novel E-trap. In one group of the embodiments, said electrostatic trap may further comprise means for selective resonant excitation of ion oscillations within said electrostatic trap either in X or Z-direction. The E-trap may further comprise a surface for ion fragmentation in the region of ion turn in the X-direction. The trap may further comprise a deflector for returning fragment ions into the analytical portion of said electrostatic trap.

The novel E-trap is suitable for multiplexing of electrode sets of the electrostatic trap. Preferably, said electrostatic trap mass spectrometer may further comprise multiple sets of Z-elongated slits within said electrode set to form an array of Z-elongated volumes of trapping electrostatic field, wherein each field volume is formed by a single set of slits aligned between said electrodes of the set; and wherein said array is one of the group: (i) an array formed by linear shift; (ii) a coaxially multiplexed array; (iii) a rotationally multiplexed array; and (iv) an array shown in FIG. 5A and FIG. 5B. The multiple electrode sets may be arranged into one of the group: (i) an array; (ii) a stack; (iii) a coaxially multiplexed array; (iv) a rotationally multiplexed array; (v) an array formed by making multiple windows within the same set of electrodes; (vi) a connected array formed of linear and curved slots either of spiral shape, or snake-shape, or a stadium shape; (vii) an array of coaxial traps. In an implementation, either the fields of said multiplexed electrode sets are in communication or ions are passed between the fields of said multiplexed electrode sets. In an implementation, the multiplexed E-trap may further comprise multiple simultaneously ejecting pulsed ion converters; each converter being in communication with an individual trapping field of said electrostatic trap; said multiple converters receive an ion flow from one ion source of the group: (i) a single ion source sequentially multiplexing portions or time slices of the ion flow between said multiple converters; (ii) a mass spectrometer multiplexing portions of the ion flow with different m/z span between said multiple converters; (iii) a mobility separator multiplexing portions of the ion flow with different span of ion mobility; (iv) multiple ion sources each feeding its own pulsed converter; and (v) a separate ion source feeding a calibrating ion flow into at least one of said multiple converters. The array of traps may be within the same vacuum chamber and may be fed by same power supplies. Parallel or sequentially filled converters may simultaneously or substantially simultaneously inject ion packets into multiple E-traps of the array to avoid pulse pick up by charge sensitive detectors.

In an implementation, an electrostatic trap mass spectrometer may comprise: (a) at least two parallel ion mirrors separated by a field-free region forming a substantially two-dimensional field in the X-Y plane; (b) said ion mirrors retard ions in the X-direction and provide indefinite ion confinement in the locally orthogonal Y-direction, so that moving ions are trapped for repetitive oscillations; (c) a pulsed ion source or a pulsed converter for generating ion packets in a wide span of m/z values; (d) means for injecting of said ion packets into said electrostatic trap; (e) a detector for measuring frequency of multiple ion oscillations within said trap; and (f) wherein said mirrors are substantially extended in the third Z-direction locally orthogonal to both of said X- and Y-directions. In an implementation, at least one of said mirrors may comprise at least four electrodes with at least one electrode having attractive potential and forming a spatial lens, such that said ion oscillations being isochronous in the X-direction relative to small deviations in spatial, angular, and energy spreads of the ion packets to at least second-order of the Tailor expansion including cross-term aberrations, and isochronous to at least third-order relative to ion energy in the X-direction. In an implementation, the E-trap may be either a planar 2D trap having bounding means in the Z-direction, or said E-trap may be extended into a 2D torroid. In an implementation, said pulsed converter accumulates and ejects an ion ribbon elongated in said Z-direction and wherein said injection means are substantially extended and substantially aligned in said Z-direction. In an implementation, said converter may employ either RF ion confinement, or electrostatic guide, or an electrostatic trap. In an implementation, said detector may be either an image charge detector or a time-of-flight detector sampling a portion of ions per oscillation. In an implementation, said image charge detector may be split into multiple segments to form high frequency signals. Preferably, said electrostatic trap may further comprise means for recovering spectra of oscillation frequencies by one method of the group: (i) the Wavelet-fit, (ii) the Fourier transformations accounting higher harmonics and (iii) the FDM transformation.

There is also provided a method of mass spectrometric analysis comprising the following steps:

(a) forming at least two parallel electrostatic field volumes, separated by a field-free space;

(b) arranging said electrostatic fields being two-dimensional in an X-Y plane;

(c) said field structure allows both—isochronous repetitive ion oscillations between said fields within said X-Y plane and stable ion trapping in said X-Y plane at about zero ion velocity in the orthogonal direction to said X-Y plane;

(d) injecting ion packets into said field;

(e) measuring frequencies of said ion oscillations with a detector; and (f) wherein said electric field is extended and the field distribution in said X-Y plane is reproduced, along a Z-direction locally orthogonal to said X-Y plane to form either planar or torroidal field regions.

In an implementation, the oscillation frequency of 1000 amu ions may be larger than one of the group: (i) 100 kHz; (ii) 200 kHz; (iii) 300 kHz; (iii) 500 kHz; and (iv) 1 MHz. The adjustment includes usage of high acceleration voltage and small X-size of the trap, while retaining large Z-size for maintaining large space charge capacity of E-trap. Preferably, the length of ion packets along the direction of ion oscillations is adjusted much shorter compared to the ion path of single oscillation. In an implementation, the method may further comprise a step of detecting an image current signal induced by ion packets and comprises a step of converting of said signal into mass spectrum by one or more method of the group: (i) the Fourier analysis; (i) the Fourier analysis accounting a reproducible distribution of higher harmonics; (ii) the Wavelet-fit analysis; (iii) the Filter Diagonalization Method; and (iv) a combination of the above.

In one method, ions are trapped in electrostatic fields of E-trap, in another—injected ions pass through said E-trap electrostatic fields in the Z-direction. In one method, said electrostatic fields may comprise two field regions of ion mirrors separated by a field-free space; wherein said ion mirror fields comprises a spatial focusing region. Preferably, said electrostatic ion mirrors have at least one electrode with an attracting potential and wherein said mirrors are arranged and tuned to simultaneously provide: (i) an ion retarding in an X-direction for repetitive oscillations of moving ion packets; (ii) a spatial focusing or confining of moving ion packets in a transverse Y-direction (iii) a time-of-flight focusing in T-direction relative to small deviations in spatial, angular, and energy spreads of ion packets to at least second-order of the Tailor expansion including cross terms; (iv) a time-of-flight focusing in T-direction relative to energy spread of ion packets to at least third-order of the Tailor expansion.

Ion packets may be focused in the Z-direction by one method of the group: (i) by spatial modulation in the Z-direction of said trapping electrostatic field to periodically repeat three-dimensional field sections E(X,Y,Z) along the Z-direction; (ii) by distorting electrostatic field with fringing fields penetrating between electrodes or through slits; and (iii) by introducing a spatially focusing field within a nearly field-free region. Preferably, the method further comprises a step of introducing a fringing field penetrating into said electrostatic field of said ion mirrors, wherein said fringing field is variable along Z-axis for at least one purpose of the group: (i) separating said electrostatic trap volume into portions; (ii) compensating mechanical misalignments of said mirror field; (iii) regulating ion distribution along the Z-axis; and (iv) repelling ions at Z-boundaries.

The method may further comprise a step of ion packet injection into said electrostatic fields; and wherein said number of injected ions are adjusted either to keep a constant number of injected ions, or to alternate the ion admission time from an ion source between signal acquisitions.

The method may further comprise a step of ion separation prior to said step of ion injection into said trapping fields by one separation method of the group: (i) a mass-to-charge separation; (ii) a mobility separation; (iii) a differential mobility separation; and (iv) a charge separation. The method may further comprise a step of ion fragmentation after said step of ion separation and prior to said step of ion injection into said trapping fields and wherein said step of fragmentation comprises one step of the group: (i) a collisional induced dissociation; (ii) an electron attachment dissociation; (iii) an anion attachment dissociation; (iv) dissociation by metastable atoms; and (v) a surface induced dissociation.

The method may further comprise a step of forming an array of trapping electrostatic fields; and, within multiple trapping fields, further comprising at least one step of parallel mass spectrometric analysis of the group: (i) an analysis of time slices of a single ion flow; (ii) analysis of time slices of a single ion flow past a fragmentation cell of tandem mass spectrometer; (iii) analysis of multiple portions of the same ion flow for extending space charge capacity of the analysis; (iv) analysis of mass or mobility separated portions of the same ion flow; and (v) analysis of multiple ion flows. The method may further comprise at least one step of ion flow multiplexing of the group: (i) sequential ion injection into multiple trapping fields from a single converter; (ii) distribution of ion flow portions or time slices between multiple converters and ion injection from said multiple converters into multiple trapping fields; and (iii) accumulation of ion flow portions or time slices within multiple converters and synchronous ion injection into multiple trapping fields. The method may further comprise a step of ion packet injection into said electrostatic field; wherein said number of injected ions are adjusted either to keep a constant number of injected ions, or to alternate the ion admission time from an ion source.

In an implementation, the method may further comprise a step of resonant excitation of said ion oscillations in an X or Z-directions and a step of ion fragmentation on a surface located near the ion reflection point. Preferably, the method may further comprise a step of multiplexing of said trapping electrostatic fields into an array of trapping electrostatic fields for one purpose of the group: (i) a parallel mass spectrometric analysis; (ii) multiplexing of the same ion flow between individual electrostatic fields; (ii) extension of the space charge capacity of said trapping electrostatic field. One particular method may further comprise a step of resonant excitation of said ion oscillations in X or Z-directions and a step of ion fragmentation on a surface located near the ion reflection point.

There is also provided an electrostatic analyzer comprising:

(a) at least one first set of electrodes forming a two-dimensional electrostatic field of ion mirror in an X-Y plane; said mirror provides ion reflection in an X-direction;

(b) at least one second set of electrodes forming a two-dimensional electrostatic field in said X-Y plane;

(c) a field free space separating said two electrode sets;

(d) said electrode sets are arranged to provide isochronous ion oscillations in said X-Y plane;

(e) wherein both electrode sets are curved at constant curvature radius R along a third locally orthogonal Z-direction to form a torroidal field regions within said electrode sets; and (f) wherein the ion path per single oscillation L and an inclination angle $\alpha$ □between a mean ion trajectory and the X-axis and measured in radians are chosen to satisfy the relation: $R>50*L*\alpha^2$.

In an implementation, within said first set of mirror electrodes, at least one outer ring electrode may be connected to a higher repelling voltage relative to opposite electrode of the internal ring. In one embodiment, said torroidal spaces may be composed of sections with different curvature radius to form one shape of the group: (i) a spiral; (ii) a snake-shape; (iii) a stadium-shape. In an embodiment, the angle between the plane of Z-axis curvature and the X-axis is one of the group: (i) 0 degrees; (ii) 90 degrees; (iii) an arbitrary angle; and (iv) an angle selected for a particular ratio between X-size and curvature radius of the analyzer in order to minimize the number of electrodes. In an implementation, the shape of said electrode sets is shown in FIG. 4C to FIG. 4H. In an implementation, at least two electrode sets may be identical with account of the analyzer symmetry. Preferably, said second electrode set may comprise at least one ion optical assembly of the group: (i) an ion mirror; (ii) an electrostatic sector; (iii) an ion lens; (iv) a deflector; and (v) a curved ion mirror having features of an electrostatic sector. In an implementation, said second electrode set may comprise a combination of at least two ion optical assemblies of the above said group. In an implementation, said analyzer further comprises at least one additional ion optical assembly of said group to provide a central reference ion trajectory in said X-Y plane with one shape of the group: (i) O-shaped; (ii) C-shaped; (iii) S-shaped; (iv) X-shaped; (v) V-shaped; (vi) W-shaped; (vii) UU-shaped; (viii) VV-shaped; (ix) Ω-shaped; (x) γ-shaped; and (xi) 8-figure shaped. In one embodiment, at least one ion mirror may have at least four parallel electrodes with distinct potentials, and wherein at least one electrode has an attracting potential which is at least twice larger than the acceleration voltage for providing isochronous oscillations with compensation of at least second-order aberration coefficients. In another embodiment, at least a portion of said ion mirror may provide a quadratic distribution of electrostatic potential in said first X-direction; wherein said mirror comprises a spatially focusing lens; and wherein said electrodes further comprise means for radial ion deflection across the Z-axis for arranging an orbital ion motion.

In an implementation, said analyzer may be constructed using one technology of the group: (i) spacing metal rings by ceramic balls similarly to ball bearings; (ii) electro erosion or laser cutting of plate sandwich; (iii) machining of ceramic or semi-conductive block with subsequent metallization of electrode surfaces; (iv) electroforming; (v) chemical etching or etching by ion beam of a semi-conductive sandwich with surface modifications for controlling conductivity; and (vi) a ceramic printed circuit board technology. Preferably, the employed materials are chosen to have reduced thermal expansion coefficients and comprise one material of the group: (i) ceramics; (ii) fused silica; (iii) metals like Invar, Zircon, or Molybdenum and Tungsten alloys; and (iv) semiconductors like Silicon, Boron Carbide, or zero-thermo expansion hybrid semi conducting compounds. The analyzer regions may be multiplexed by either making coaxial slits in parallel aligned electrodes or stacking analyzers. The analyzer may further comprise a pulsed converter extended and aligned along said Z-direction to follow the curvature of said analyzer; wherein said converter has means for ion ejection in the direction orthogonal to Z-direction; and wherein said converter comprises one of the group (i) a radio-frequency ion guide; (ii) a radiofrequency ion trap; (iii) an electrostatic ion guide; and (iv) an electrostatic ion trap with ion oscillations being in X-direction.

In an implementation, the electrostatic trap may be a mass analyzer of a mass spectrometer, and wherein said electrostatic analyzer is employed as one of the group: (i) a closed electrostatic trap; (ii) an open electrostatic trap; and (iii) a TOF analyzer.

A corresponding method of mass spectrometric analysis may comprise the following steps:

(a) forming at least one region of two-dimensional electrostatic field in an X-Y plane for ion reflection in an X-direction;

(b) forming at least one second region of a two-dimensional electrostatic field in said X-Y plane;

(c) separating said two field regions by a field-free space;

(d) arranging said electrostatic fields to provide isochronous ion oscillations in said X-Y plane;

(e) wherein both—first and second field regions are curved at constant curvature radius R along a third locally orthogonal Z-direction to form a torroidal field regions; and (f) wherein the ion path per single oscillation L and an inclination angle $\alpha$ □between a mean ion trajectory and the X-axis and measured in radians are chosen to satisfy the relation: $R>50*L*\alpha^2$.

In an implementation, said electrostatic fields may be arranged for at least one further step of the group: (i) an ion retarding in the X-direction for repetitive ion oscillations; (ii) a spatial focusing or confining of moving ions in a transverse Y-direction; (iii) an ion deflection orthogonal to said X-direction; (iv) a time-of-flight focusing in X-direction relative to energy spread of ion packets to at least third-order of the Tailor expansion; (v) spatial ion focusing or confinement of moving ions in the Z-direction; and (vi) radial deflection for orbital ion motion. In an implementation, possible non parallelism of said two field regions may be at least partially compensated by fringing fields of auxiliary electrodes (E-wedge). In an implementation, at least one of said electrode sets is angularly modulated to periodically reproduce three-dimensional field sections E(X,Y,Z) along the Z-direction.

There is further provided an electrostatic mass spectrometer comprising:

(a) at least one ion source;

(b) means for ion pulsed injection, said means are in communication with said at least one ion source;

(c) at least one ion detector;

(d) a set of analyzer electrodes;

(e) a set of power supplies connected to said analyzer electrodes;

(f) a vacuum chamber enclosing said electrode set;

(g) within said electrode set, multiple sets of elongated slits forming an array of elongated volumes;

(h) each volume of said array being formed by a single set of slits aligned between said electrodes;

(i) each volume forming a two-dimensional electrostatic field in an X-Y plane extended in a locally orthogonal Z-direction; and (j) each two-dimensional field being arranged for trapping of moving ions in said X-Y plane and isochronous ion motion along a mean ion trajectory lying in said X-Y plane.

In an implementation, the field volumes may be aligned as one of the group: (i) a stack of linear fields; (ii) a rotational array of linear fields; (iii) a single field region folded along a spiral, stadium shape, or a snake shape line; (iv) a coaxial array of torroidal fields; and (v) an array of separate cylindrical field regions. In an implementation, the Z-axis may be either straight to form planar field volumes or closed into a circle to form torroidal field volumes. In an implementation, the field volumes may form at least one field type of the group: (i) an ion mirror; (ii) an electrostatic sector; (iii) a field-free region; (iv) an ion mirror for ion reflection in the first direction and an ion deflection in a second orthogonal direction. In an implementation, the fields may be arranged to provide isochronous ion oscillations relative to initial angular, spatial and energy spreads of injected ion packets to at least first order of the Tailor expansion. In an implementation, the fields may be arranged to provide isochronous ion oscillations relative to initial energy spread of injected ion bunches to at least third order of the Tailor expansion. The multiple electrostatic fields may be arranged as one of the group: (i) a closed electrostatic trap; (ii) an open electrostatic trap; (iii) a time-of-flight mass spectrometer.

The pulsed converter may comprise one of the group: (i) a radiofrequency ion guide with a radial ion ejection; (ii) an electrostatic ion guide with periodic electrostatic lenses and with a radial ion ejection; and (iii) an electrostatic ion trap with pulsed ion release into said electrostatic fields of the mass spectrometer. Preferably, said at least one ion detector may comprise one of the group: (i) an image charge detector for sensing frequency of ion oscillations; (ii) a multiplicity of image charge detectors aligned either in X or Z-directions; and (iii) a time-of-flight detector sampling a portion of ion packets per single ion oscillation. Preferably, said electrodes are miniature to maintain oscillation path under about 10 cm; and wherein said electrode set may be made by one manufacturing method of the group: (i) electro-erosion or laser cutting of plate sandwich; (ii) machining of ceramic or semi-conductive block with subsequent metallization of electrode surfaces; (iii) electroforming; (iv) chemical etching or etching by ion beam of a semi-conductive sandwich with surface modifications for controlling conductivity; and (v) using ceramic printed circuit board technology.

In an implementation, a corresponding method of mass spectrometric analysis comprises the following steps: (a) forming a two-dimensional electrostatic field in an X-Y plane; said field allows stable ion motion in said X-Y plane and isochronous ion oscillations in said X-Y plane; (b) extending said field in a locally orthogonal Z-direction to form either planar or torroidal electrostatic field volume; (c) repeating said field volume in a direction orthogonal to Z-direction; (d) injecting ion packets into said multiple volumes of said electrostatic field; and (e) detecting either frequency of ion oscillations or a flight time through said electrostatic field volumes.

The step of field multiplexing may comprises one substep of the group: (i) stacking of linear fields; (ii) forming a rotational array of linear fields; (iii) folding a single field region along a spiral, stadium shaped, or a snake shape line; (iv) forming a coaxial array of torroidal fields; and (v) forming an array of separate cylindrical field volumes. Preferably, said step of ion packet injection may comprise a step of pulsed ion formation in a single pulsed ion source and a step of sequential ion injection into said multiple volumes of electrostatic field; and wherein period between pulse formations is shorter than the analysis time within an individual ion trapping volume. Alternatively, said step of ion packet injection may comprise a step of pulsed ion formation within multiple pulsed ion sources and a step of parallel ion injection into said multiple volumes of electrostatic field. Alternatively, said step of ion packet injection may comprise a step of ion flow formation in a single ion source, a step of pulsed conversion of time slices of said ion flow into ion packets within a single pulsed converter, and a step of sequential ion injection of said time slices into said multiple volumes of electrostatic field.

The method may further comprise a step of mass-to-charge or mobility separation prior to the step of pulsed ion conversion. One method may further comprise a step of ion fragmentation prior to step of ion injection. In another method, said step of mass-to-charge or mobility separation may comprise a step of ion trapping and a step of time-sequential release of trapped ionic components.

In one method, said step of ion injection may comprise a step of ion flow formation in a single ion source, a step of splitting of said ion flow between multiple pulsed converter, a step of pulsed conversion of said ion flow portions into ion packets within multiple pulsed converters, and a step of parallel ion injection from said multiple pulsed converters into said multiple volumes of electrostatic field. In another method, said step of ion injection may comprise a step of ion flow formation in a multiple ion sources, a step of pulsed conversion of said multiple ion flows into ion packets within multiple pulsed converters, and a step of parallel ion injection from said multiple pulsed converters into said multiple volumes of electrostatic field. In another method, at least one ion source forms ions of known mass to charge ration and of known ion flux intensity for the purpose of calibrating mass spectrometric analysis.

There is further provided an ion trap mass spectrometer comprising:

(a) an ion trap analyzer providing ion oscillations in electric or magnetic fields; the period of said oscillations monotonously depends on ions mass to charge ratio;

(b) said analyzer is arranged to provide isochronous ion oscillations at least to the first order of spatial, angular and energy spread of ion ensemble;

(c) means for ion packet injection into said analyzer;

(d) at least one fast ion detector sampling a portion of ions per single oscillation with at least some ions remaining undetected; and (e) means for recovering spectra of ion oscillations frequencies from said signal.

The apparatus may further comprise an ion to electron converter exposed to a portion of ion packets; wherein secondary electrons from said converter are extracted onto a detector in orthogonal direction to ion oscillations. Preferably, said converter may comprise one of the group: (i) a plate; (ii) a perforated plate; (iii) a mesh; (iii) a set of parallel wires; (iv) a wire; (v) a plate covered by a mesh with different electrostatic potential; (v) a set of bipolar wires. Preferably, said sampled portion of ion packet per single oscillation may be one of the group: (i) under 100%; (ii) under 10%; (iii) under 1%; (iv) under 0.1%; (v) under 0.01%. Alternatively, said portion may be controlled electronically, either by adjusting at least one potential of the spectrometer or by applying a surrounding magnetic field.

The spatial resolution of said detector may be at least N times finer than the ion path per single oscillation; and wherein factor N is one of the group: (i) above 10; (ii) above 100; (iii) above 1000; (iv) above 10,000; and (v) above 100,000. The fast ion detector may comprise at least one component of the group: (i) a microchannel plate; (ii) a secondary electron multiplier; (iii) a scintillator followed by either photo-electron multiplier of by a fast photo diode; and (iv) an electromagnetic pick up circuit for detection of secondary electrons rapidly oscillating in magnetic field. The detector may be located within a detection region of said ion trap analyzer and wherein said trap further comprises means for mass selective ion transfer between said regions by resonance excitation of ion motion. The apparatus may further comprise ionization means, ion pulsed injection means and means for recovering frequency spectra. Preferably, said ion trap analyzer may comprise one electrostatic trap analyzer of the group: (i) a closed electrostatic trap; (ii) an open electrostatic trap; (iii) an orbital electrostatic trap; and (iii) a multi-pass time-of-flight analyzer with temporal ion trapping. Further preferably, said electrostatic ion trap analyzer comprises at least one electrode set of the group: (i) an ion mirror; (ii) an electrostatic sector; (iii) a field free region; and (iv) an ion mirror for ion reflection in the first direction and an ion deflection in a second orthogonal direction.

In one group of embodiments, said ion trap analyzer may comprise one magnetic ion trap of the group: (i) ICR magnetic trap; (ii) a penning trap; (iii) a magnetic field region bound by radiofrequency barriers. Further preferably, said magnetic ion trap further comprises an ion to electron converter set at an angle to magnetic field lines and wherein said fast detector is arranged to detect secondary electrons along the magnetic field lines. In another group of embodiments, said ion trap analyzer comprises a radio-frequency (RF) ion trap and an ion-to-electron converter aligned with a zero radiofrequency potential; and wherein said RF ion trap comprises one trap of the group: (i) a Paul ion trap; (ii) a linear RF quadrupole ion trap; (iii) a rectilinear Paul or linear ion trap; (iv) an array of rectilinear RF ion traps.

The mass spectrometer may further comprise an electrostatic lens for spatial focusing of secondary electrons past said converter, and preferably comprises either at least one receiver of secondary electrons of the group: (i) a microchannel plate; (ii) a secondary electron multiplier; (iii) scintillator; (iv) a pin diode, an avalanche photodiode; (v) a sequential combination of the above; and (vi) an array of the above.

In an implementation, a corresponding method of mass spectrometric analysis may comprise the following steps:

(a) forming electric or magnetic analytical field to arrange ion oscillations with oscillation period being monotonous function of ions mass-to-charge ratio;

(b) within said fields, arranging isochronous ion oscillations to at least to the first order of spatial, angular and energy spread of ion ensemble;

(c) injecting ion packets into said analytical field;

(d) sampling a portion of ions per single oscillation onto a fast detector; and (e) recovering spectra of ion oscillations frequencies from said detector signal.

The method may further comprise a step of exposing a conversion surface to at least a portion of oscillating ions, and a step of side sampling of secondary electrons onto said detector. The method may further comprise a step of spatial and time-of-flight focusing of secondary electrons at their passage between the converter and the detector.

In an implementation, the ion injection step may be adjusted to provide time-focal plane in plane of the detector and wherein said analytical fields are adjusted to reproduce the location of time focal plane for consequent ion oscillations. The step of recovering frequency spectra may comprises one step of the group: (i) the Fourier analysis; (ii) the Fourier analysis with account of reproducible distribution of higher oscillation harmonics; (iii) the Wavelet-fit analysis; (iv) a combination of the Fourier and the Wavelet analysis; (iv) a Filter Diagonalization Method for analysis combined with a logical analysis of higher harmonics; and (v) a logical analysis of overlapping groups of sharp signals corresponding to different oscillation frequencies. The step of ion injection may be arranged periodically and with a period being shorter than ion residence time in said analytical field. In an implementation, said detection may occur in a portion of said electrostatic field and wherein ions are admitted into the detection portion of the field in a mass selective fashion. In an implementation, said ion packets may be injected sequentially into said analytical field in subgroups and wherein said subgroups are being formed by one step of the group: (i) separation according to ions m/z sequence; (ii) selection of a limited m/z span; (iii) selection of fragments ions corresponding to parent ions of a particular m/z span; and (iv) selection of a span of ion mobility.

A mass spectrometer is disclosed comprising:

(a) an ion source generating ions;

(b) a gaseous radiofrequency ion guide receiving at least a portion of said ions;

(c) a pulsed converter having at least one electrode connected to a radio-frequency signal; said pulsed converter is in communication with said gaseous ion guide;

(d) an electrostatic analyzer forming a two-dimensional electrostatic field in an X-Y plane; said field being substantially extended in a third locally orthogonal and generally curved Z-direction and allows isochronous ion oscillations in said X-Y plane;

(e) means for ion pulsed ejection from said converter into said electrostatic analyzer in a form of ion packet substantially elongated in said Z direction;

(f) wherein said pulsed ion converter is substantially extended in said generally curved Z-direction and is aligned parallel to said elongated electrostatic analyzer; and (g) wherein said pulsed converter is at substantially vacuum conditions comparable to vacuum conditions in said electrostatic analyzer.

Preferably, said substantial elongation in Z direction of said electrostatic analyzer, said converter and said ion packet may comprise at least ten fold elongation relative to corresponding dimensions in both X and Y directions.

The apparatus may further comprise at least one detector of the group: (i) a time-of-flight detector like microchannel plate or secondary electron multiplier for destructive detection of ion packets at the exit part of the ion path; (ii) a time-of-flight detector sampling a portion of injected ions per single ion oscillation; (iii) an ion to electron converter in combination with a time-of-flight detector for receiving secondary electrons; (iv) an image current detector. In an implementation, said electrostatic analyzer comprises one analyzer of the group: (i) a closed electrostatic trap; (ii) an open electrostatic trap; (iii) an orbital electrostatic trap; (iv) a time-of-flight mass analyzer. In an implementation, said electrostatic analyzer comprises at least one electrode set of the group: (i) an ion mirror; (ii) an electrostatic sector; (iii) an ion mirror having radial deflection for ion orbital motion; (iv) a field free region; (v) an spatially focusing lens; and (vi) a deflector. Preferably, said ion guide and said pulsed converter may have either similar or identical cross sections in said X-Y plane. In an implementation, said converter may be a vacuum extension of said gaseous ion guide formed by protruding a single ion guide through at least one stage of differential pumping. Said converter may further comprise an upstream curved radio-frequency portion for reducing gas load from said gaseous ion guide. In an implementation, said pulsed converter further comprises means for pulsed gas admission into said pulsed converter. Said ion injection means may comprise a curved transfer optics for blocking a direct gas path from said converter into said electrostatic analyzer.

Said means for ion injection may comprise at least one injection mean of the group: (i) an injection window in a field-free region of the analyzer; (ii) a gap between electrodes of said analyzer; (iii) a slit in an electrode of said analyzer; (iv) a slit in the outer ion mirror electrode; (v) a slit in at least one sector electrode; (vi) an electrically isolated section of at least one electrode of said analyzer with a window for ion admission; (vii) at least one auxiliary electrode for compensating field distortions introduced by an ion admission window; (viii) a pulsed curved deflector for turning the ion trajectory; (ix) at least one pulsed deflector for steering the ion trajectory; and (x) at least one pair of deflectors for pulsed displacement of the ion trajectory. At least one said electrode for ion admission may be connected to a pulsed power supply The apparatus may further comprise one energy adjusting means of the group: (i) a power supply for an adjustable floating of said pulsed converter prior to ion ejection; (ii) an electrode set for pulsed acceleration of ion packets out of the pulsed ion source or the pulsed converter; and (iii) an elevator electrode located in-between said pulsed converter and said electrostatic trap, said elevator being pulsed floated during the passage of ion packets through said elevator electrode.

The inscribed radius of said pulsed converter may be less than one of the group: (i) 3 mm; (ii) 1 mm; (iii) 0.3 mm; (iv) 0.1 mm; and wherein the frequency of said radiofrequency field is raised reverse proportionally to inscribed radius. Said converter may be made by one manufacturing method of the group: (i) electro erosion or laser cutting of plate sandwich; (ii) machining of ceramic or semi-conductive block with subsequent metallization of electrode surfaces; (iii) electroforming; (iv) chemical etching or etching by ion beam of a semi-conductive sandwich with surface modifications for controlling conductivity; and (v) using ceramic printed circuit board technology.

A corresponding method of mass spectrometric analysis comprises the following steps:

(a) forming ions in an ion source;

(b) passing at least a portion of said ions through a gaseous radiofrequency ion guide;

(c) within a pulsed converter, receiving at least a portion of ions from said gaseous radiofrequency ion guide and confining received ions in an X-Y plane by a radiofrequency field;

(d) pulse injecting ions from said pulsed converter into an electrostatic field of an electrostatic ion analyzer and in the direction locally orthogonal to said Z-direction;

(e) within said electrostatic analyzer, forming a two-dimensional electrostatic field in an X-Y plane; said field being substantially extended in a locally orthogonal and generally curved Z-direction and allows isochronous ion oscillations in said X-Y plane;

(f) wherein radiofrequency field volume of said pulsed ion converter is substantially extended in said generally curved Z-direction and is aligned parallel to said elongated electrostatic analyzer; and (g) wherein said pulsed converter is at substantially vacuum conditions comparable to vacuum conditions in said electrostatic analyzer.

As discussed above, the ion communication between said gaseous ion guide and said vacuum pulsed converter may comprise one step of the group: (i) providing constant ion communication for maintaining equilibrium of ion m/z composition; (ii) pulsed injecting of ions from a gaseous into a vacuum portion; and (iii) passing ions into a vacuum portion in a pass-through mode. The method further comprises a step of either static or pulsed ion repulsion at Z-edges of said pulsed converter by either RF or DC fields. Preferably, the filling time of the pulsed converter may be controlled either to reach a target number of the filling ions and/or to alternate between two filling times. In an embodiment, the distance between said pulsed converter and said analyzer electrostatic field may be kept at least three times smaller than the ion path per single oscillation in order to expand the m/z span of admitted ions. In some implementations, the injected ions pass through said analyzer electrostatic field in the Z-direction.

Said confining radio frequency field may be switched off prior to ion ejection out of said pulsed converter. The method may further comprise a step of ion detection; wherein the pulsed electric fields at said ion injection step are adjusted to provide time-of-flight focusing in the X-Z plane of said detector; and wherein electric fields of said electrostatic analyzer are adjusted to sustain time-of-flight focusing in the X-Z plane of said detector at subsequent ion oscillations.

One particular method may further comprise a step of multiplexing of said trapping electrostatic fields into an array of trapping electrostatic fields for one purpose of the group: (i) a parallel mass spectrometric analysis; (ii) multiplexing of the same ion flow between individual electrostatic fields; and (iii) extension of the space charge capacity of said trapping electrostatic field.

BRIEF DESCRIPTION OF THE DRAWINGS

Various embodiments of the present invention together with an arrangement given illustrative purposes only will now be described, by way of example only, and with reference to the accompanying drawings in which.

DETAILED DESCRIPTION

Figure 1:
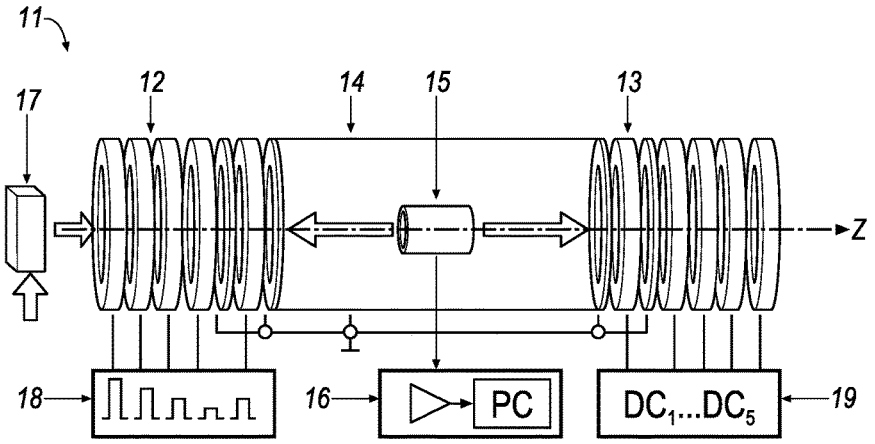
FIG. 1 presents a prior art coaxial I-path E-trap with an image charge detector.

Referring to FIG. 1, a coaxial E-trap 11 similar to that disclosed in U.S. Pat. No. 6,744,042 is shown, incorporated herein by reference, and comprises two coaxial ion mirrors 12 and 13, spaced by a field-free region 14, a pulsed ion source 17, an image current detector 15 with preamplifier and ADC 16, a set of pulsed power supplies 18 and DC 19 power supplies connected the mirror electrodes as shown. The spacing between mirror caps is 400 mm and the acceleration voltage is 4 kV.

In operation, the ion source 17 generates ion packets at 4 keV energy which are pulsed admitted into the spacing between ion mirrors by temporarily lowering the mirror 12 voltages. After restoring the mirror voltages, the ion packets oscillate between the ion mirrors 12 and 13 in the vicinity of the Z-axis, thus forming repetitive I-path ion trajectories. The packets are spatially focused to 2 mm diameter and are extended along the Z-axis to approximately 30 mm, i.e. ion packet volume can be estimated as 100 $mm^3$. Oscillating ion packets induce an image current signal on the cylindrical detector electrode 15. The typical oscillation frequency is 300 kHz for 40 amu ions (corresponding to F=60 kHz for 1000 amu ions considered elsewhere in this application). The signal is acquired for ~1 second time span. U.S. Pat. No. 6,744,042 describes space charge self-bunching effects as the main factor governing the time-of-flight properties of I-path electrostatic traps for ion packets with 1E+6 ions, corresponding to charge density of 1E+4 ions/$mm^3$. The throughput of the cylindrical trap is lower than 1E+6 ions/sec, which corresponds to a very low 0.1% duty cycle if using intensive modern ion sources producing over 1E+9 ions/sec.

Figure 2A:
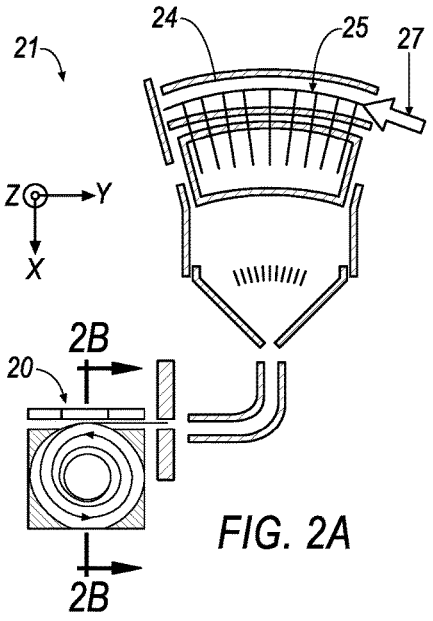
FIG. 2A presents a prior art orbital trap mass spectrometer with an orbital ion motion within a hyper-logarithmic field.
Figure 2B:
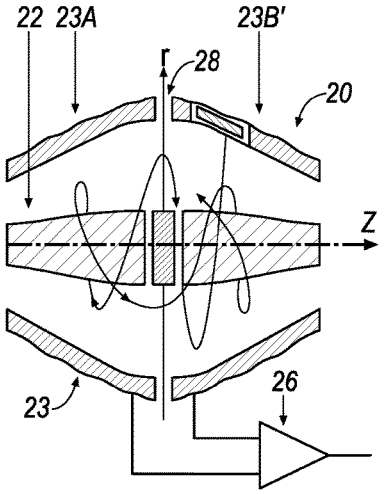
FIG. 2B presents a sectional view cut through the orbital trap of the orbital trap mass spectrometer of FIG. 2A.

Referring to FIGS. 2A-2B, an orbital electrostatic trap mass spectrometer 21 similar to that which is disclosed in U.S. Pat. No. 5,886,346 is shown and comprises a C-shaped storage trap (C-trap) 24 and an orbital electrostatic trap 20 having two coaxial electrodes 22 and 23 forming a hyper-logarithmic electrostatic field. Ions (shown by arrow 27) are generated by an external ion source, get stored within the C-trap 24 within a moderately elongated volume 25, and get pulsed injected into the orbital trap 20 via a fine ~1 mm aperture 28 (Makarov et al JASMS 17 (2006) 977-982, incorporated herein by reference) and then get trapped by ramping Orbitrap potentials. The ion packets rotate around the central electrode 22, while oscillating in the axial parabolic potential (linear field), thus forming spiral trajectories. As described in Anal. Chem. v.72 (2000) 1156-1162, incorporated herein by reference, the ratio of tangential and axial oscillation frequencies exceeds $\pi/2^{1/2}$ in order to stabilize the radial motion, and in the practical Orbitrap geometries, the ratio of tangential to axial average velocities exceeds factor of 3. The charge sensitive amplifier 26 detects a differential signal induced by ion passages across the electrode gap between two halves 23A and 23B of electrode 23. The Fourier transformation of the image current signal provides spectra of oscillation frequencies which are then converted into mass spectra.

An orbital electrostatic trap U.S. Pat. No. 5,886,346, incorporated herein by reference, with C-trap provides a large space charge capacity per single ion injection up to 3E+6 ions per injection (JASMS v.20, 2009, No. 8, 1391-1396). The charge density is estimated as 1E+4 ions/$mm^3$. A higher tolerance of the Orbital trap (compared to I-path E-traps) is explained by charge tolerant harmonic potential and by higher field strength. The downside of orbital trap is in slow signal acquisition: it takes approximately 1 second for obtaining spectrum with 100,000 resolving power. Slower speed also limits the maximal ion flux to 3E+6 ions/second, which is far less than is provided by modern ion sources.

The present invention improves space charge capacity of E-traps by extending E-traps in the direction generally orthogonal to ion oscillation plane. The acquisition speed is accelerated by using sharper ion packets and by applying various waveform analysis methods.

Apparatus and Method

Figure 3B:
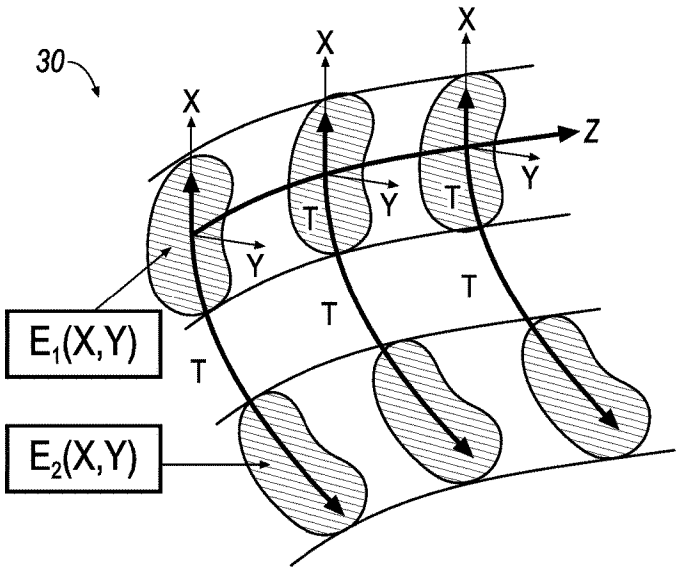
FIG. 3B is an icon demonstrating the local-orthogonal nature of a curved Z-axis with respect to X- and Y-axes.
Figure 3A:
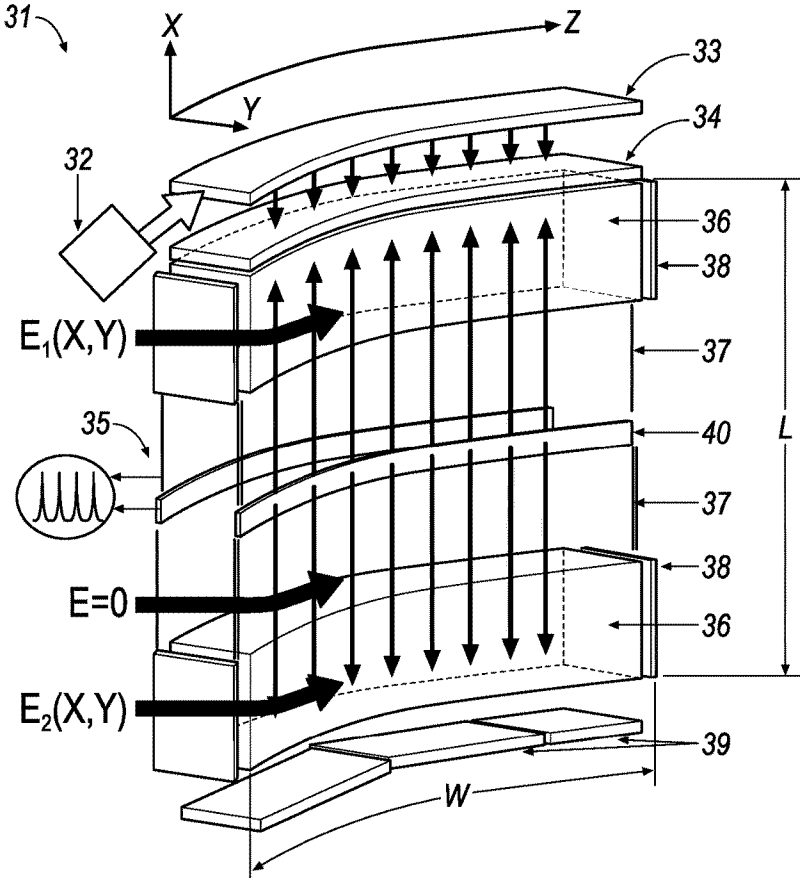
FIG. 3A illustrates the principle 2-D E-trap extension in the Z-direction.

Referring to FIG. 3A, one example apparatus for accomplishing a method of mass spectrometric analysis is shown. The method that can be accomplished may comprise the following steps: (a) forming at least two parallel electrostatic field volumes, separated by a field-free space; (b) arranging said electrostatic fields being two-dimensional in an X-Y plane; (c) said field structure allows both—isochronous repetitive ion oscillations between said fields within said X-Y plane and stable ion trapping in said X-Y plane at about zero ion velocity in the orthogonal direction to said X-Y plane; (d) injecting ion packets into said field; (e) measuring frequencies of said ion oscillations with a detector; and (f) wherein said electric field is extended and the field distribution in said X-Y plane is reproduced along a Z-direction locally orthogonal to said X-Y plane to form either planar or torroidal field regions.

For clarity, contrary to orbital traps wherein orbital motion is required for stability of ion oscillations, the employed here electrostatic fields allow stable ion motion at zero ion velocity in the Z-direction. This does not exclude ion motion in the Z-direction. In such case the novel extended electrostatic fields would also trap oscillating ions.

The icon 30 of FIG. 3B depicts X, Y and Z axes and shows that in spite of shifts and rotations between X-Y planes, the generally curved Z-axis remains locally orthogonal to X-Y planes, so as axes X and Y remain mutually orthogonal in every X-Y plane. The icon 30 depicts a reproduced field regions as a dark enclosed regions of an arbitrary shape and shows that the field regions stay parallel and are aligned with local X-Y plane. The field distributions $E_1(X,Y)$ and $E_2(X,Y)$ are reproduced from region to region along a generally curved axis Z. The icon also depicts an arbitrary and generally curved reference ion trajectory T corresponding to an indefinitely stable and isochronous ion motion between field regions and via a field-free region. Throughout the application the X-axis is usually selected such that the trajectory T-direction coincides with the X-axis in at least one point. Note that the field extension may not be just linear extension of two-dimensional fields but rather a periodical repeating of three-dimensional field segments which have symmetry X-Y planes with the reproduced field distribution $E_1(X,Y)$ and $E_2(X,Y)$ and thus with the reproduced ion motion along the reference trajectories T.

The reproduction of the field structure allows reproducing properties of periodic oscillations from plane to plane. This allows substantially extending the trapping volume while maintaining the same oscillation frequency within the entire trapping field, which significantly improves the space charge capacity and the space charge throughput of electrostatic traps.

Again referring to FIG. 3A, and at the level of schematic drawing, one embodiment 31 of the electrostatic trap (E-trap) mass spectrometer comprises: an ion source 32, a pulsed ion converter 33, ion injection means 34, an E-Trap 35 composed of two sets of electrodes 36 spaced by a field-free region 37, optional means 38 for bounding ions in the Z-direction at Z-edges of the E-trap, and a detector 40 for sensing frequency of ion oscillations, here shown as electrodes for image current detection. In other embodiments said means comprise a time-of-flight detector. Optionally, the E-trap further comprises auxiliary electrodes 39 with auxiliary fields penetrating into the space of electrodes 36.

In operation, the electrode sets are arranged to indefinitely trap moving ions within some range of ion energies while keeping the ion motion along X-axis being isochronous. The electrode fields provide ion reflection along the X-axis and an indefinite spatial confinement of ions in the Y-direction by spatial focusing of ion packets. Z-bounding means 38 provide indefinite ion confinement in the third Z-direction. Electrode sets 36 are substantially elongated in the drift Z-direction to form planar fields $E_1(X,Y)$ and $E_2(X,Y)$. Alternatively, the fields are extended by repeating the same field-sections along the Z-axis, preferably, leaving the field sections in communication. Various field topologies are illustrated in the next section.

Further in operation, the external ion source 32 generates ions from analyzed compounds. The pulsed converter 33 accumulates ions and periodically injects ion packets into the E-trap 35 via injection means 34 and substantially along the X-axis. Preferably, the ion converter 34 is also extended along Z-axis to improve space charge capacity of the converter. The detector 40 (here image current detector) senses the frequency F of ion oscillations along the X-axis, and the signal is converted into a mass spectrum, since $F \sim (m/z)^{-0.5}$.

The novel E-trap provides two novel features which appear not satisfied by prior art E-traps and TOF MS: (a) substantial extension of E-trap volume and (b) substantial elongation of the pulsed converter, thus enhancing the space charge capacity of the E-trap and the duty cycle of the converter.

The novel E-trap differs from the prior art TOF and M-TOF MS by: (a) principle of detection: the novel E-trap measure frequency of indefinite ion oscillations while prior art TOF measure the flight time per the determined flight path; (b) by ion packet size—while M-TOF employs periodic lens to confine ions in the Z-direction, the novel E-trap allows ions to occupy a large portion of Z-width, which improves space charge capacity; and (c) by a much wider class of trapping electrostatic fields of the invention;

The novel E-trap differs from the prior art coaxial I-path E-traps by electric field topology: the novel planar E-trap employs expandable planar and torroidal 2-D fields while the prior art I-path E-traps employ the axially symmetric cylindrical fields with a limited volume.

The novel E-trap differs from the prior art race-track multi-turn E-traps by: (a) extending the sector field in the Z-direction for improving space charge capacity of the novel E-trap; and (b) using of multiple other two-dimensional fields which allow a higher order spatial and time-of-flight focusing; and (c) by principle of frequency measurement in the novel E-trap Vs time-of-flight principle in majority of the prior art race-track E-traps;

The novel E-trap differs from the prior art Orbital traps by: (a) type of electrostatic field—the novel E-trap employs fields of ion mirrors and electrostatic sectors while the orbital traps employ hyper-logarithmic fields; (b) electrostatic field topology—the novel E-trap employ expandable 2D fields, while the hyper-logarithmic field is well defined in all three directions; (c) the role of ion orbital motion—the novel trap allows ion trapping without orbital motion, while in orbital traps the ratio of the orbital and axial average velocities is well above factor of three to provide the ion radial confinement; (d) shape of ion trajectories—the novel trap allows stable ion trajectories within some plane which is not reachable in orbital traps; and (e) substantial extension of a pulsed converter is not achievable in the present format of the orbital trap since ion packets have to be introduced via a small ~1 mm aperture.

The novel E-trap differs from the prior art 3D E-trap WO 2009/001909, incorporated herein by reference, by: (a) electric field topology—the novel E-trap 31 employs expandable fields while the prior art 3D E-trap employs a three dimensional field which does not allow an unlimited field extension in one lateral direction; (b) electric field type—the invention proposes expandable planar fields, while 3-D traps employ a particular class of three-dimensional fields; (c) role of the lateral motion and ion trajectory—the novel E-trap allows alignment of ion trajectories within a plane while the 3-D E-trap of prior art require orbital ion motion for stabilizing ion trajectory in lateral direction; and (d) electrode shape—the novel E-trap allows practically usable straight and circular electrodes, while the 3D E-trap requires complex 3-D curved electrodes.

Let us look closer at novel field structures and at the field topologies of the present invention.

Types and Topologies of Expandable Fields

Referring to FIGS. 4-31, the generic annotation of coordinate axes is kept in the entire application as:

X, Y and Z axes are locally orthogonal;

T—is the direction of the isochronous curved reference ion trajectory in the X-Y plane;

X-Y plane is the plane of a 2D electrostatic field or a symmetry plane of 3D field segments; novel E-traps allow stable trapping of moving ions within the X-Y plane;

X-direction coincides with T-direction in at least one point; trap X-length=L;

Y-direction is locally orthogonal to X, trap Y-height=H;

Z-direction is locally orthogonal to X-Y plane; E-trap field is extended along a linear or curved Z-direction. Ion packets are extended in Z direction; trap Z-width=W.

As described below the axes may be rotated while retaining the property of being locally orthogonal to each other. Then X-Y and X-Z planes do rotate to follow the curvatures of the Z-direction.

Figure 4:
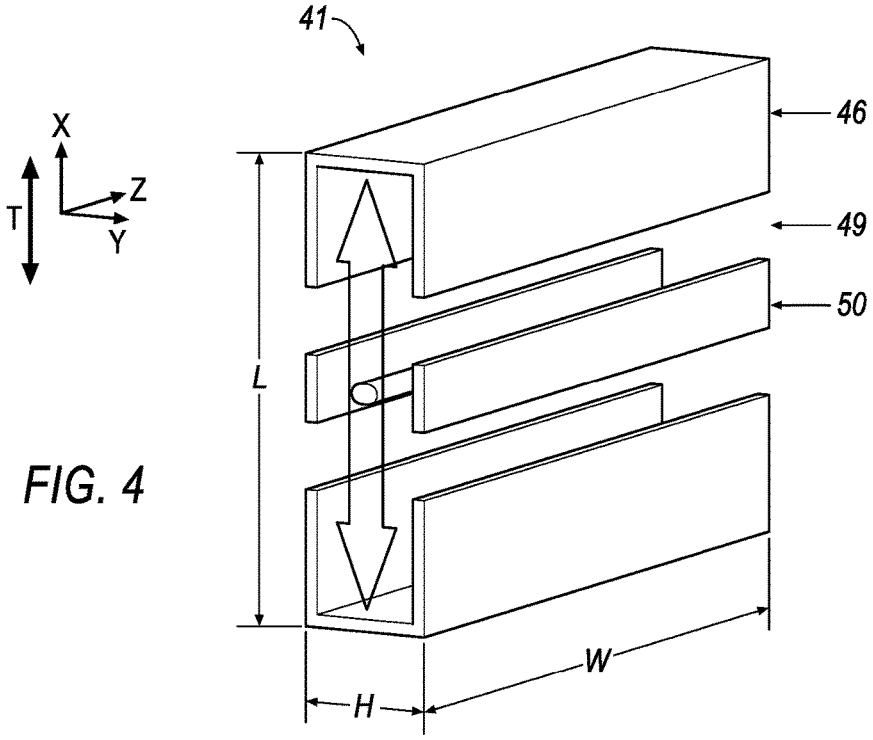
FIG. 4 is a perspective view of an electrode set formed by parallel ion mirrors allowing for a Z-extension of an electrostatic trap.
Figure 5:
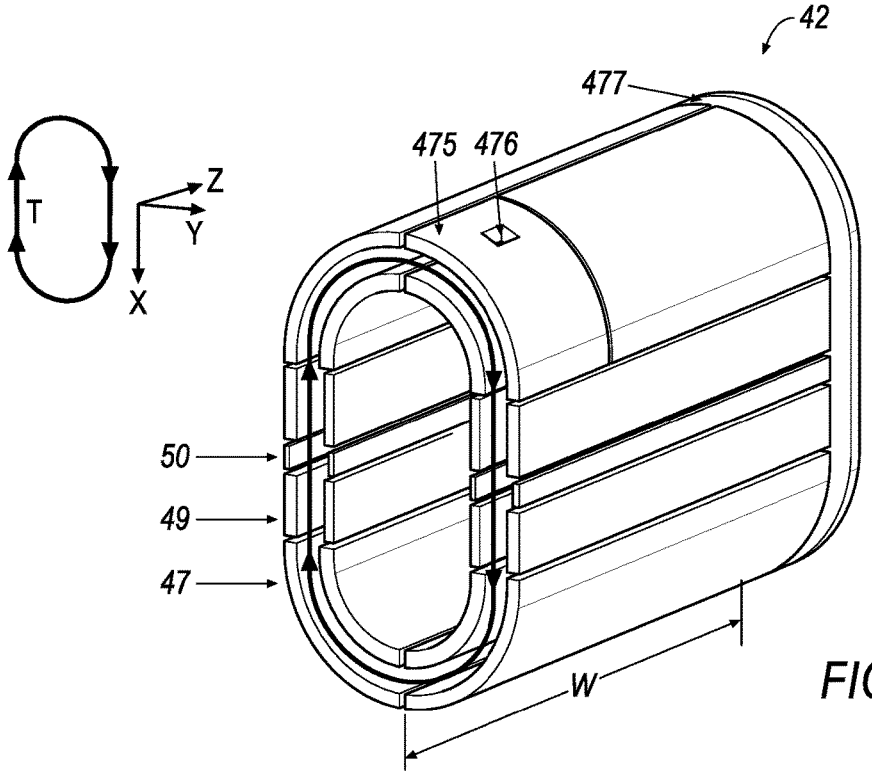
FIG. 5 is a perspective view of an electrode set formed by electrostatic sectors allowing for a Z-extension of an electrostatic trap.
Figure 6:
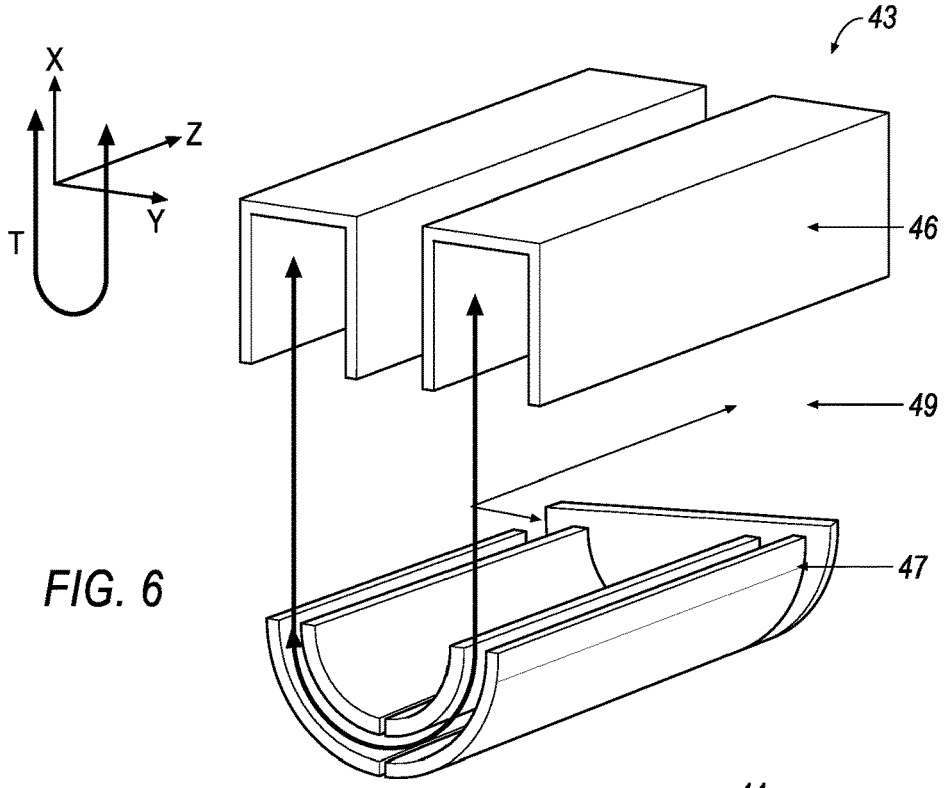
FIG. 6 is a perspective view of an electrode set formed by isolated ion mirrors and electrostatic sectors allowing for a Z-extension of an electrostatic trap.
Figure 7:
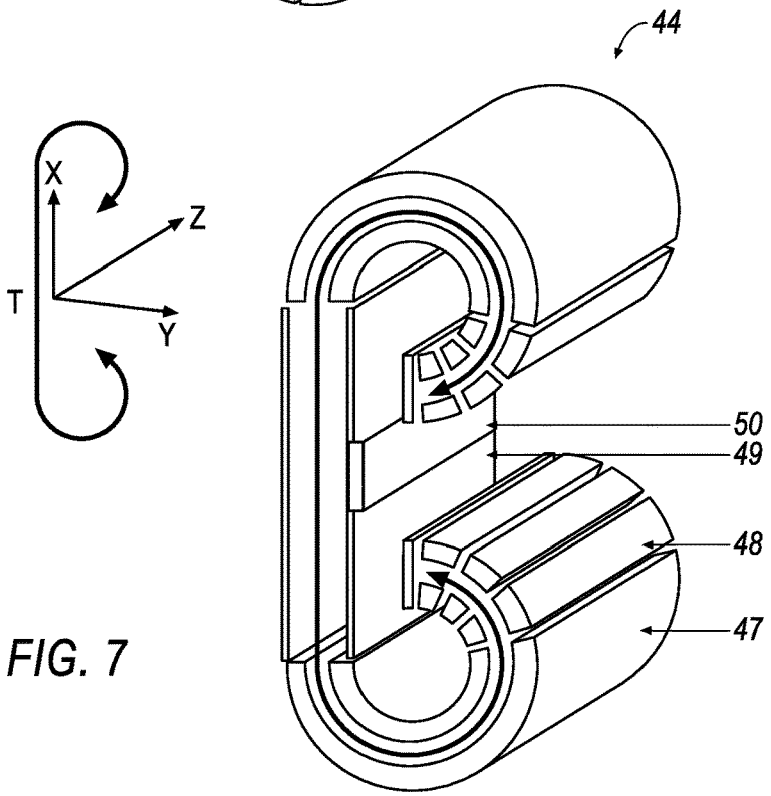
FIG. 7 is a perspective view of an electrode set formed by hybrid fields allowing for a Z-extension of an electrostatic trap.

Referring to FIGS. 4-5, there are few known types of electrostatic fields which (a) are substantially two-dimensional and (b) allow isochronous ion motion detected by an image detector 50. Those fields are employed in traps 41 (illustrated in FIG. 4) formed of parallel ion mirrors 46 separated by a field-free space 49, as well as in traps 42 (illustrated in FIG. 5) formed of electrostatic sectors 47 and field free regions 49 such that to loop ion trajectories. Though the aberrations of electric sectors are inferior relative to those in ion mirrors, still sectors provide an advantage of a compact trajectory folding and an ease of ion injection, e.g. via a window 476 in a pulsed section 475. Referring to FIGS. 6-7, the invention further proposes novel combinations including traps 43 (illustrated in FIG. 6) built of isolated ion mirrors 46 and sectors 47 separated by a field-free space 49, as well as traps 44 (illustrated in FIG. 7) built of hybrid fields 48 carrying features of both—electrostatic sector and of ion mirror. Note, that all the fields including electrostatic sectors 47 are characterized by a bent T-axis. The hybrid fields are expected to provide additional stability to radial ion motion which would improve field linearity for better isochronicity and higher space charge capacity of E-traps.

Figure 8:
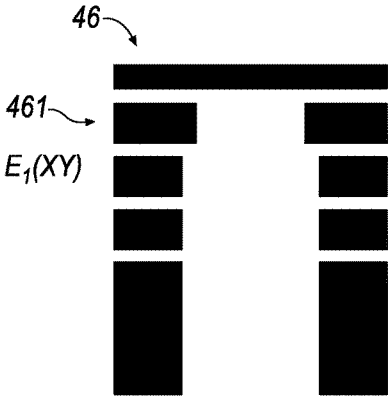
FIGS. 8-13 are schematic views illustrating some ion mirror shapes that may be utilized in Z-directionally extended electrostatic traps.
Figure 9:
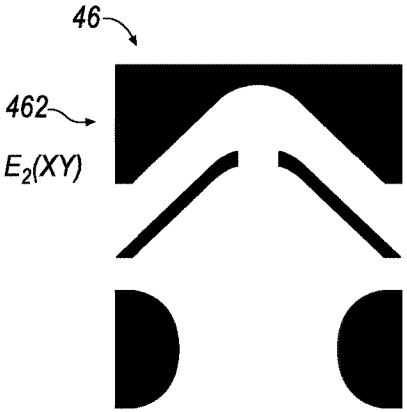
Figure 10:
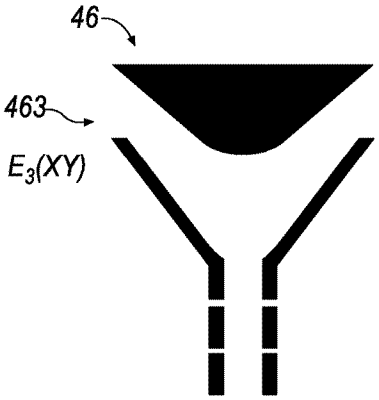
Figure 11:
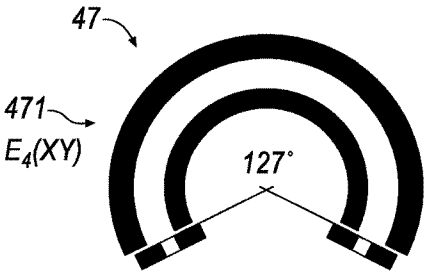
Figure 12:
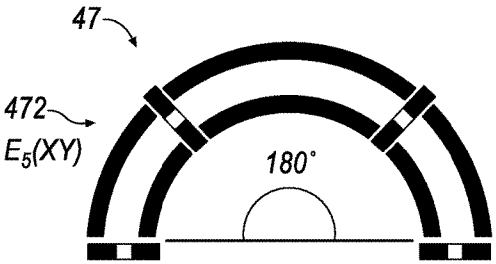
Figure 13:
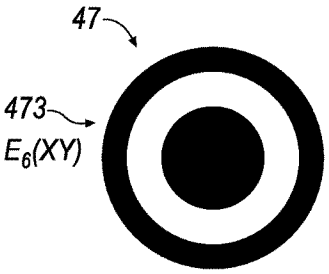

Referring to FIGS. 8-13, there are presented several exemplary shapes of ion mirror 46 electrodes (such as electrode embodiments 461, 462, 463 of FIGS. 8-10) and of sector 47 electrodes (such as electrode embodiments 471, 472, 473 of FIGS. 11-13). It is understood by a skillful person in the art, that though the depicted ion mirrors of FIG. 8 are composed of parallel and equally thick electrodes 461, one may compose a mirror of arbitrary shaped electrodes like in the embodiments 462 and 463 (of FIGS. 9-10), e.g. for the purpose of reducing number of employed potentials or to reach better isochronicity. It is also understood that sectors 47 may be composed of multiple sub-units (like in embodiments 471 and 472) with a wide range of full turning angles while retaining isochronous properties of E-traps. It is also understood that an asymmetric two-dimensional fields can be employed and the isochronous field properties may be achieved for the reference ion trajectories T not aligned with the X-symmetry axis, though symmetric arrangement is preferred for simplicity reasons.

Figure 14:
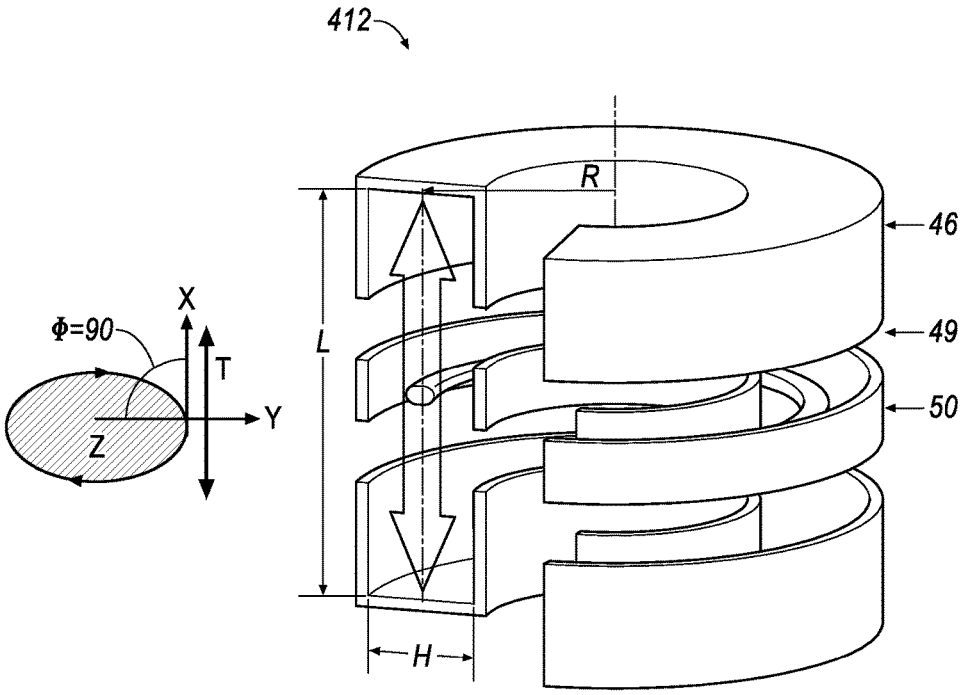
FIG. 14 is a perspective view of an electrostatic trap that is Z-directionally extended by enclosing the Z-axis into a circle.

Returning to FIG. 4, and on the example of the E-trap 41, the invention proposes a linear field extension along the Z axis. Referring to FIG. 14, the invention alternatively proposes a field extension accomplished by closing the Z-axis into a circle as in the embodiment 412. According to the Laplace equation for electrostatic fields $dE_X/dx+dE_Y/dy=-dE_Z/dz$, in order to reproduce electrostatic field E(x,y) in the Z-direction, the z-derivative $dE_Z/dz$ of the field Z-component must be either zero or constant, which corresponds to either a zero $E_Z=0$, a constant $E_Z$=Const, or a linear $E_Z$=Const*z field. In the simplest case of $E_Z=0$ the equation allows the reproductive extension of a purely two-dimensional E(x,y) field along a straight or a constantly curved axis Z.

Figure 15:
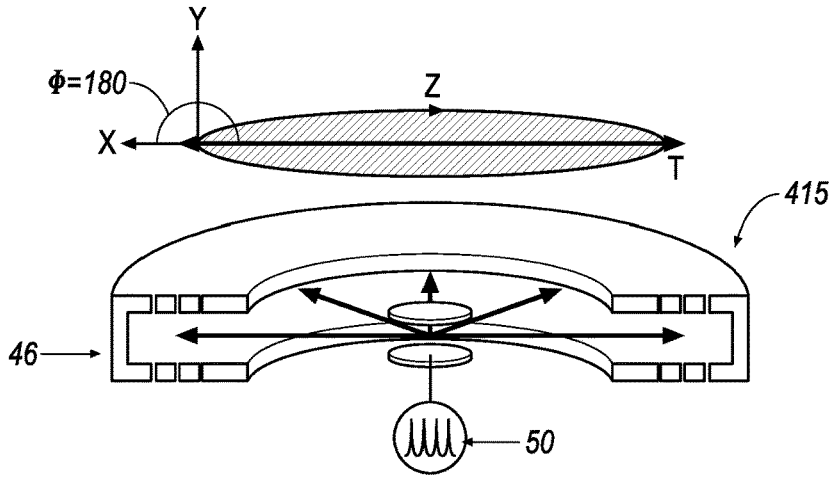
FIGS. 15-19 are perspective views of some Z-directionally extended electrostatic traps having curved Z-axes in a plane tilted at an angle $\phi$ from an X-axis.
Figure 16:
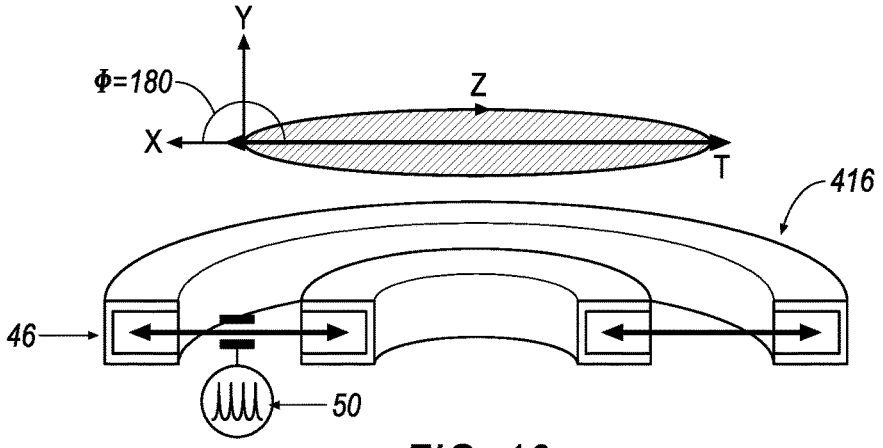
Figure 17:
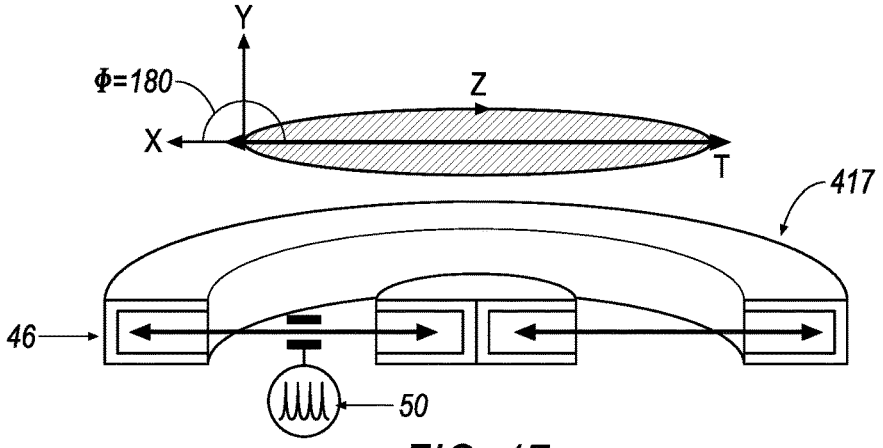
Figure 18:
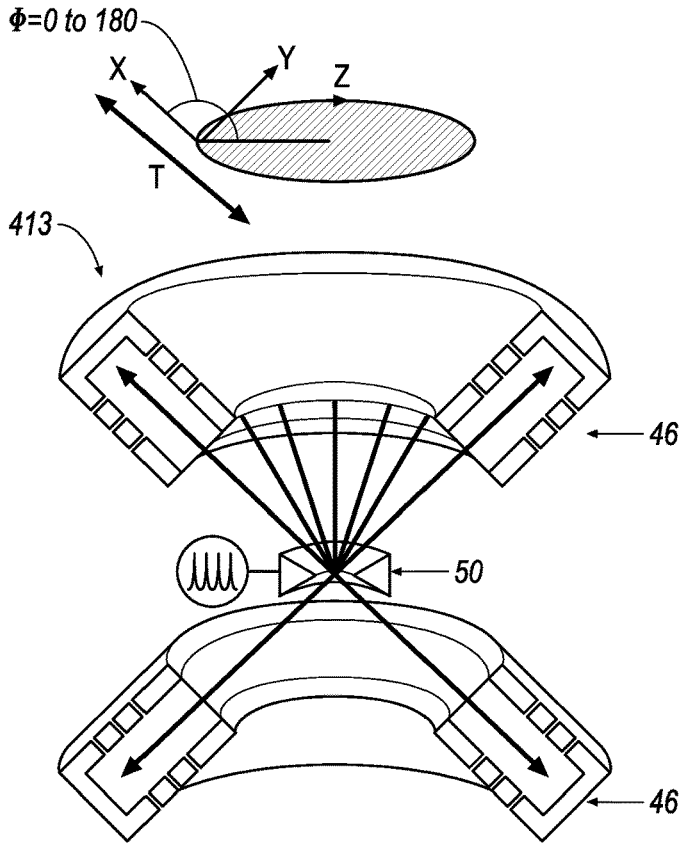
Figure 19:
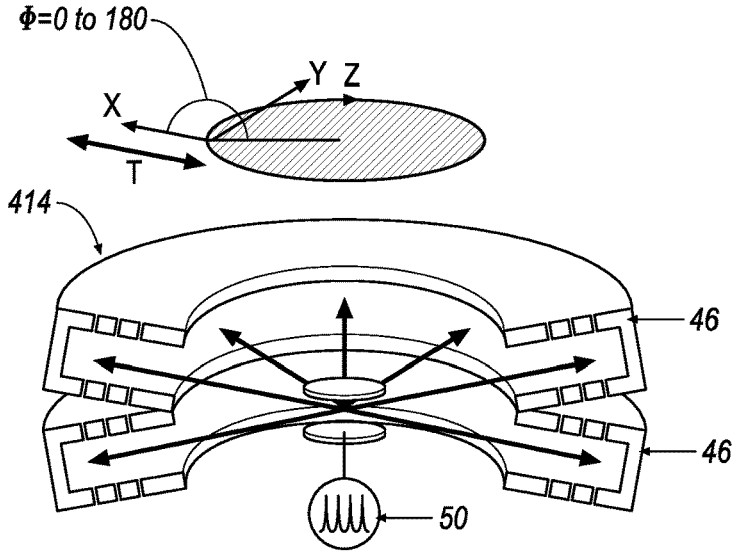

Referring to FIGS. 14-19, the plane of Z-axis curving is tilted to X-axis (or T-axis) at an arbitrary angle ϕ, wherein special topology cases correspond to ϕ=180 deg (0 deg) as in the embodiments 415-417 (as illustrated in FIGS. 15-17), and to ϕ=90 deg as in the embodiment 412 (as illustrated in FIG. 14). The curvature radius R may be chosen relatively large to reduce the curvature effects and to increase the E-trap volume. Still, some special geometrical cases correspond to a particular ratios of R relative to the X-size of traps, e.g. in the embodiments 413 and 414 (as illustrated in FIGS. 18-19) the choice of the angle ϕ and the curvature radius R are balanced to arrange the trap of two circular ion mirrors 46 rather than of four ion mirrors. The embodiments 413, 414 and 415 provide an advantage of compact size of the image detector 50. The embodiments 412, 415, 416 and 417 allow compact wrapping of the trap and mechanical stability of ring electrodes forming the ion mirrors 46.

Figure 22:
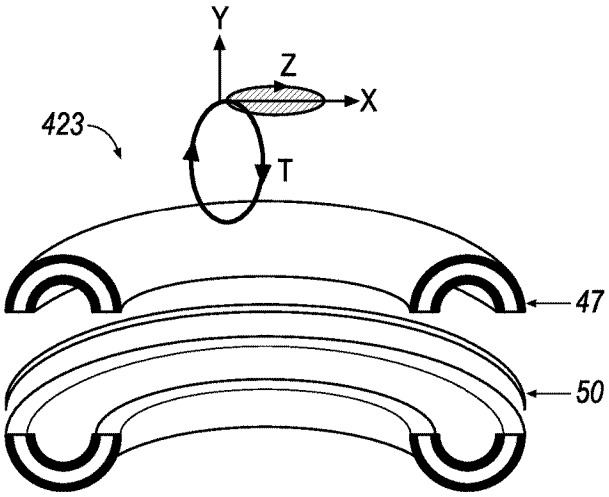
FIGS. 20-23 are perspective views of electrostatic sectors allowing for a curved Z-extension of an electrostatic trap.
Figure 23:
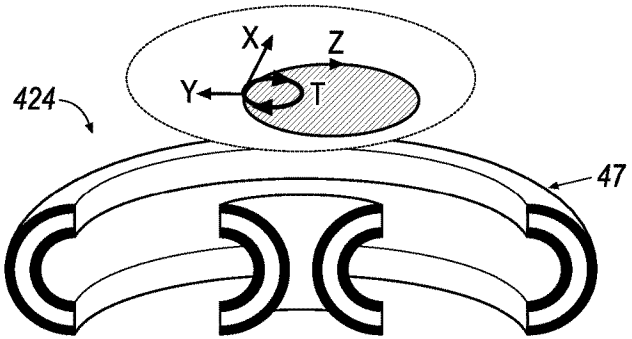
Figure 21:
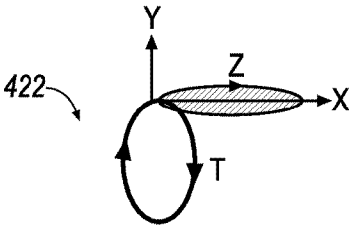
Figure 21:
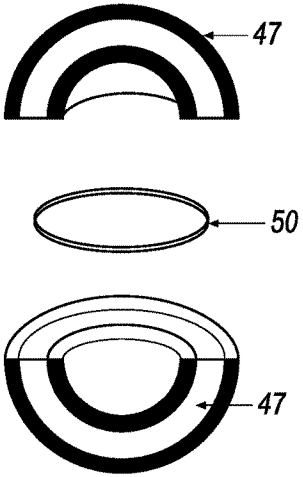
Figure 20:
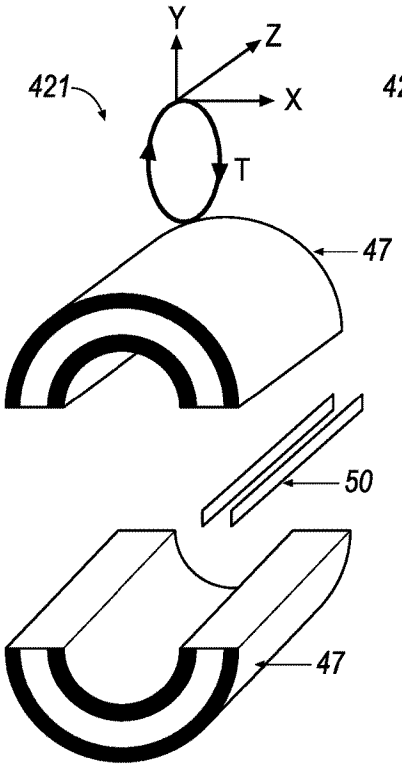
Figure 25:
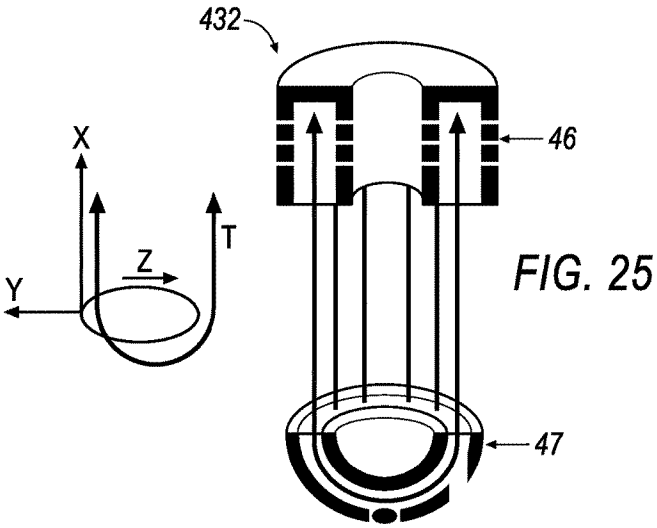
FIGS. 24-30 are schematic views of electrode sets formed by ion mirrors and electrostatic sectors, with each electrode set allowing for a Z-extension of an electrostatic trap.
Figure 24:
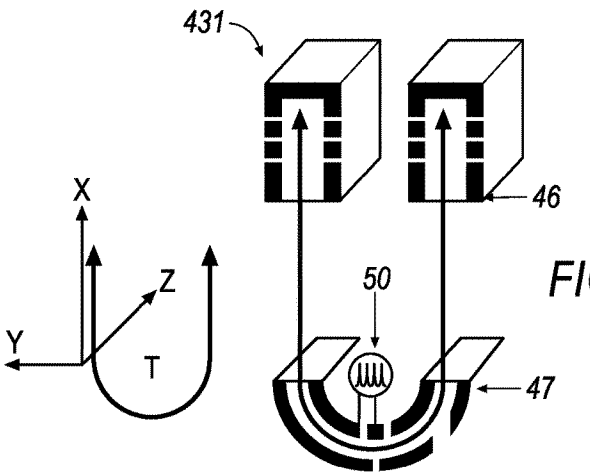
Figure 27:
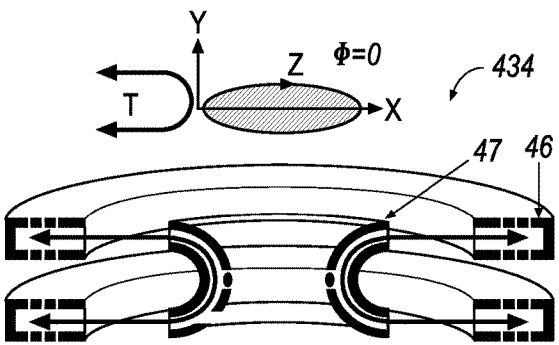
Figure 26:
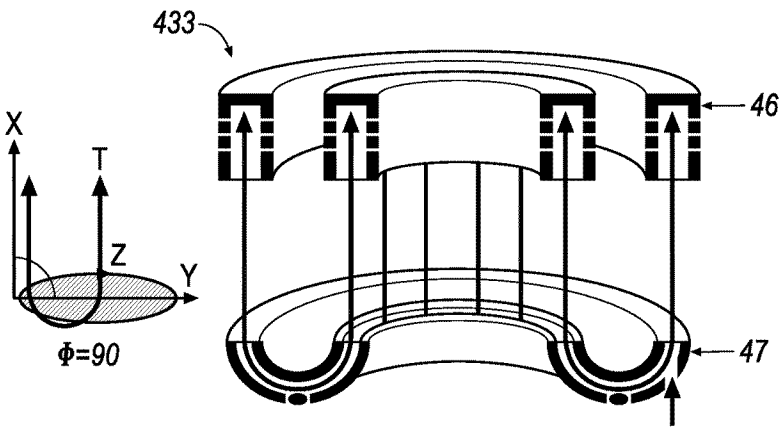

Referring to FIGS. 20-23, an electrostatic traps 42 built of sectors 47 (a first example of which is illustrated in FIG. 5) also can be extended either by a linear extension of the Z-axis as in the embodiment 421 of FIG. 20, or by closing the Z-axis into a circle to make the sector field spherical as in the embodiment 422 of FIG. 21, or torroidal with the angle ϕ=0 in the embodiment 423 of FIG. 22 and ϕ=90 in the embodiment 424 of FIG. 23. Reasonable electrode structures appear at other arbitrary angles ϕ.

Figure 28:
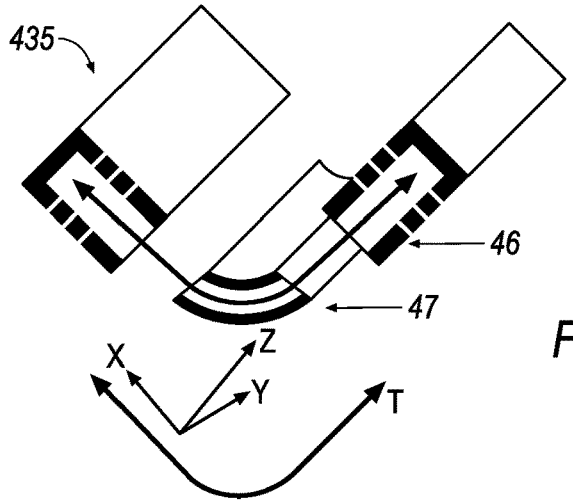
Figure 29:
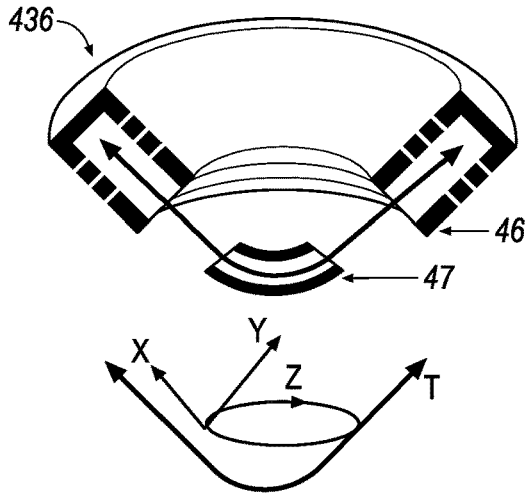
Figure 30:
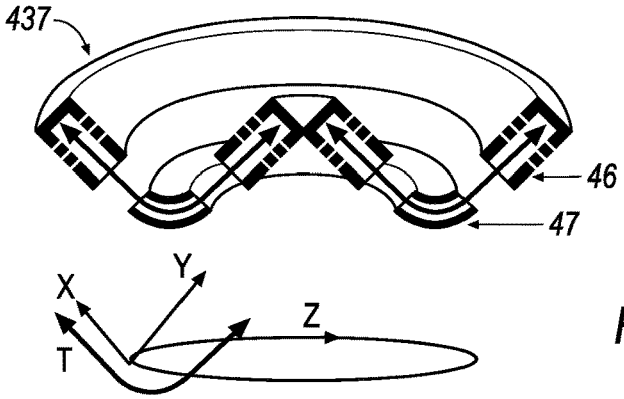

Referring to FIGS. 24-30, the combined traps 43 built of the sectors 47 and the ion mirrors 46 (a first example of which is illustrated in FIG. 6) could be constructed in different ways depending on the arrangement and the sector turning angle. The exemplary drawings present few novel combinations with U-shape of ion trajectory though many more of those structures can be constructed while arranging ion trajectories into an O, C, S, X, V, W, UU, VV, Ω, γ, and 8-figure trajectory shapes and so on. In all those combined traps 43 the T-axis of the reference ion trajectory is curved. However, this does not preclude from bending the Z-axis as in the embodiment 432 of FIG. 25, the embodiment 433 of FIG. 26, the embodiment 434 of FIG. 27, the embodiment 436 of FIG. 29, and the embodiment 437 of FIG. 30. The embodiment 431 of FIG. 24 and the embodiment 435 of FIG. 28 correspond to straight Z-axis. The embodiment 432 of FIG. 25 corresponds to circular axis Z with particular curvature radius to form a spherical sector. The embodiment 433 of FIG. 26 and the embodiment 434 of FIG. 27 correspond to circular axis Z with a larger curvature radius to form torroidal fields and to the particular cases of the angle ϕ=90 and ϕ=180 (0). Referring to FIGS. 29-30, the similar circular Z-axis wrapping of traps 43 is demonstrated on the embodiments 436 and 437 of the V-trajectory traps. Referring specifically to FIG. 28, a linear Z-elongation is demonstrated as embodiment 435 of trap 43 with the V-trajectory.

Figure 31:
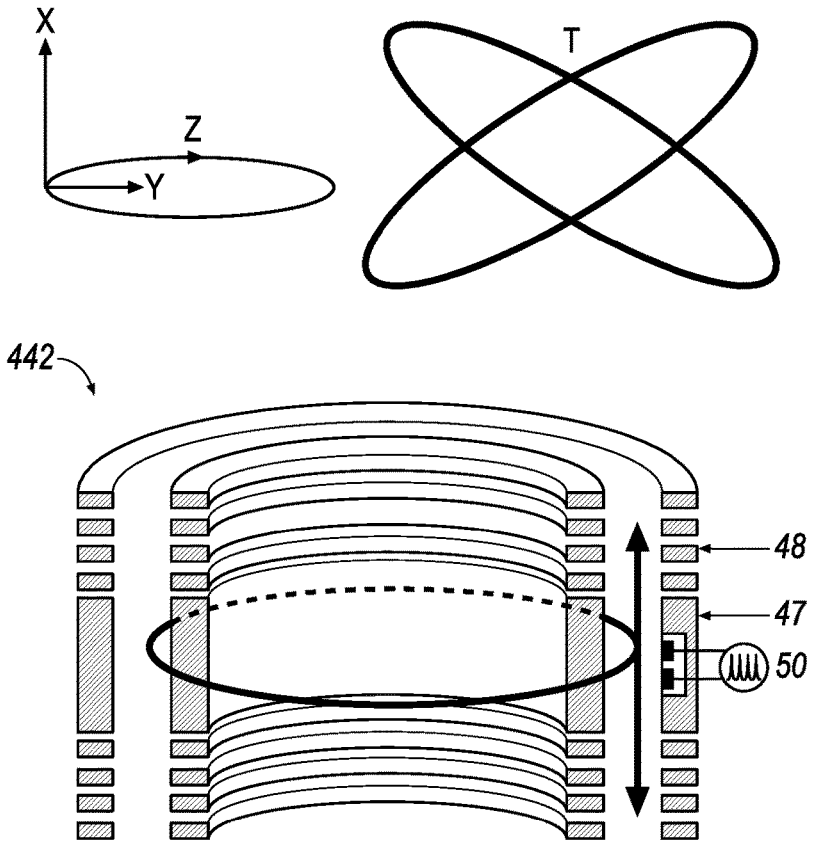
FIG. 31 is a schematic view of a hybrid electrode set formed by curved ion mirrors that dually function as electrostatic sectors, the electrode set allowing for a Z-extension of an electrostatic trap.

Referring to FIG. 31, there is shown a curved example 442 of a hybrid trap 44 (which was illustrated in FIG. 7) wherein the hybrid ion mirrors 48 also carry the function of electrostatic sectors 47, i.e. at least some internal ring electrodes have a voltage offset relative to external ring electrodes. The ion motion is presented by T-lines and is composed of the ion oscillations along the X-axis and an orbital motion along the circular Z-axis. Though the stability of radial ion motion is primarily governed by spatial focusing properties of the two-dimensional fields, still, a stronger radial motion may extend the region of purely quadratic potential near the retarding point. Contrary to known orbital traps, the proposed hybrid E-trap allows flexible variation of parameters. Presence of field-free space eases ion injection and ion detection by TOF detectors.

The above described expandable fields may be spatially modulated along the Z-axis without loosing isochronous or spatially confining properties of E-traps. Such modulation may be achieved e.g. by (a) slight periodic variations of the curvature radius; (b) bending of trap electrodes; (c) using fringing fields of auxiliary electrodes; and (d) use of spatially focusing lenses in the field free space. Such spatial modulation may be used for ion packet localization within multiple regions.

Other particular geometries of isochronous and extended E-traps could be generated while following the above outlined strategy: (a) using a combination of isochronous ion mirrors, electrostatic sectors interspaced by field free regions; (b) extending those fields linearly or into torroids or spheres; (c) varying curvature radius and an inclination angle between the local plane of central ion trajectory and an X-axis coinciding with T-line in at least one point; (d) spatial modulation of those fields along the expanding Z-axis; (e) optionally multiplexing of those traps while optionally maintaining communicating field segments; (f) optionally employ orbital motion; and (g) use various spatial orientations of the multiplexed fields. Between the multiple structures and topologies the preference can be made based on the: (a) known isochronous properties as in case of mirrors and sectors; (b) compact wrapping of ion traps as in cylinders and sector fields; (c) convenience of ion injection as in sectors; (d) small size of the image current detector; (e) mechanical stability of electrodes such as circular electrodes; (f) wider range of operational parameters and ease of tune; (g) compatibility for stacking such as circular and planar traps built of mirrors; and h) manufacturing cost.

To the best knowledge of the inventor the extended two-dimensional geometries have not been employed in electrostatic traps with frequency detection, and in particularly, for the purpose of extending the space charge capacity of the E-traps and of the pulsed converters. The novel type fields may be employed for closed and open E-traps as well as for TOF spectrometers. The range of novel electrostatic fields provides multiple advantages like compact folding of the field volume; convenience of electrode make; and small capacity of detection electrodes. Those fields are readily extendable in the Z-direction without any fundamental limitation on Z-size, so that the ratio of Z to X-size may reach hundreds. Then high ion oscillation frequency in the MHz range could be reached at volume of ion packets in the 1E+4-1E+5 $mm^3$ range.

Figure 33:
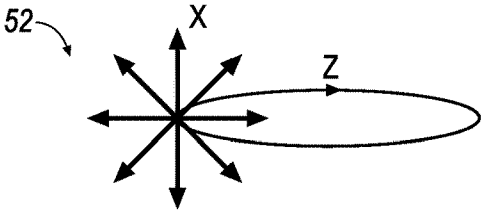
FIG. 33 is a perspective view of a multiplexed electrostatic field extended along a curved Z-axis.
Figure 33:
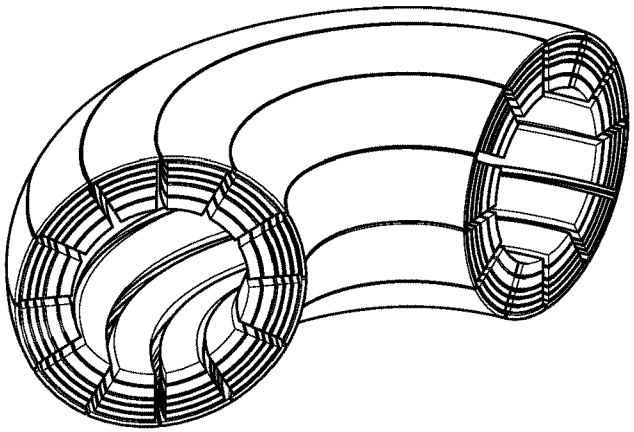
Figure 32:
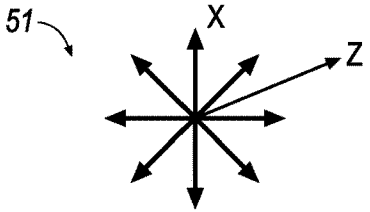
FIG. 32 is a perspective view of a multiplexed electrostatic field extended along a linear Z-axis.
Figure 32:
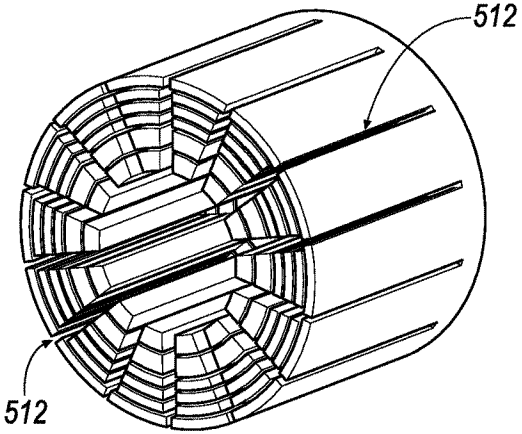
Figure 34:
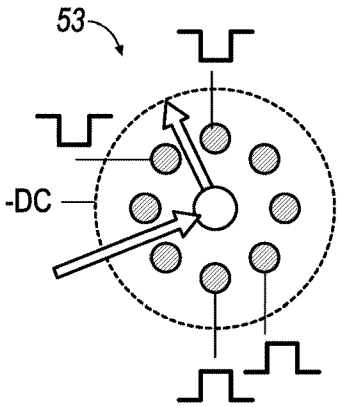
FIG. 34 is a schematic view of an ion converter for multiplexed electrostatic fields.
Figure 36:
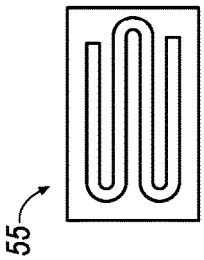
FIGS. 36-38 are schematic views of some slit arrangements for with the plates of the analyzer of FIG. 35.
Figure 37:
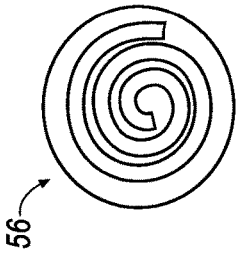
Figure 38:
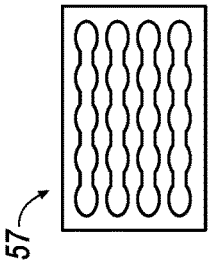
Figure 35:
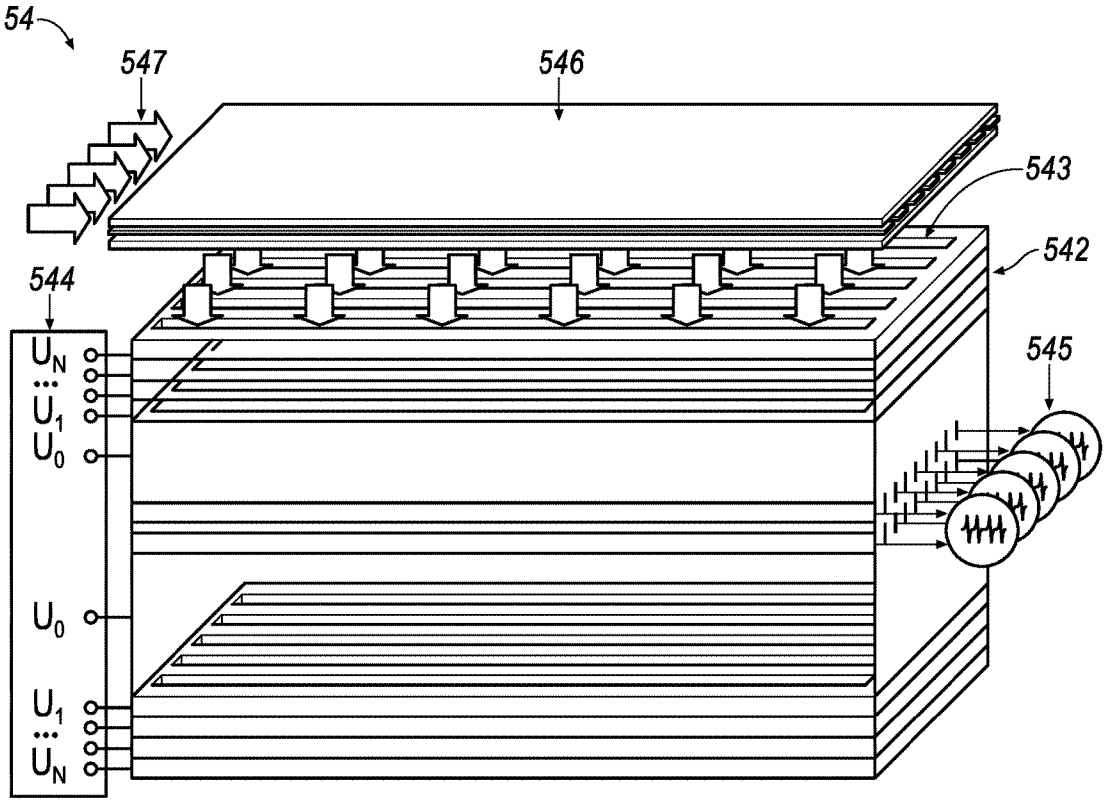
FIG. 35 is a perspective view of a stack-multiplexed analyzer formed within a layer of plates.

Referring to FIGS. 32-38, there are shown examples of spatial multiplexing and stacking of electrostatic fields. Referring specifically to FIG. 32, the radial multiplexed E-traps 51 are formed within coaxial electrodes by cutting a set of radial aligned slits 512, thus forming multiple communicating E-trap analyzers. Referring specifically to FIG. 33, the radial multiplexed E-trap 51 of FIG. 32 may be Z-directionally wound into a torroid to form an E-trap 52. Referring specifically to FIG. 34, a multiplexing ion converter 53 may direct ion packets into each of individual E-trap, by selecting separate pulse amplitude on individual electrodes of the converter. Referring specifically to FIG. 35, the stack-multiplexed analyzer 54 is formed within a layer of plates 542 by cutting a set of parallel aligned slits 543. Plates 542 are attached to the same set of highly stabilized power supplies 544, but each E-trap has individual detector and data acquisition channel 545. The converter 546 is split onto multiple parallel and independent channels. Preferably, the generic ion source has means for splitting the ion stream into sub-streams depicted as white arrows 547. The sub-streams 547 are time fractions or proportional fractions of the main stream from the ion source. Each fraction is directed into an individual channel of the multiplexed pulsed converter 546. Multiplexing of planar or circular structures is perfectly compatible with ultra miniaturization while employing such technologies of trap making as (i) micromachining; (ii) electro erosion; (iii) electroforming; (iv) laser cutting; and (v) multi-layer printed circuit boards technology while employing different sandwiches containing conductive, semi-conductive and insulating films with possible metallization or surface modifications after cutting electrode windows. Referring to FIGS. 36-38, the multiplexing of multiple traps is employed to further extend the volume of a single E-trap within compact packaging, by making either a snake-shaped 55 or spiral 56 slits 543 within mirror plate electrodes 542 of the E-trap 54 of FIG. 35. The E-trap 54 volume may contain multiple communicating trapping volumes as in the embodiment 57. The proposed novel multiplexed electrostatic analyzers may be employed for other types of mass spectrometers, like open traps or TOF MS. Methods of using stacked traps are described in a separate section.

To avoid complex drawings and geometries the subsequent description will be primarily dealing with planar and circular E-traps built of ion mirrors as shown in FIG. 4 and in FIG. 14.

Planar E-Traps

Figure 39B:
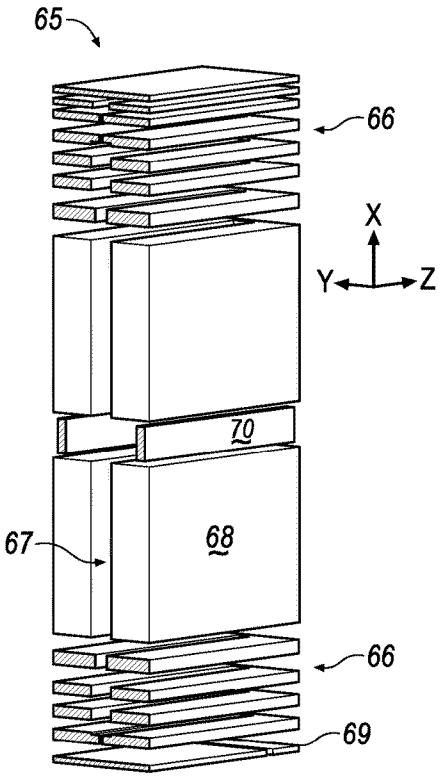
FIG. 39B is a perspective view of the analyzer of the novel E-trap of FIG. 39A.
Figure 39A:
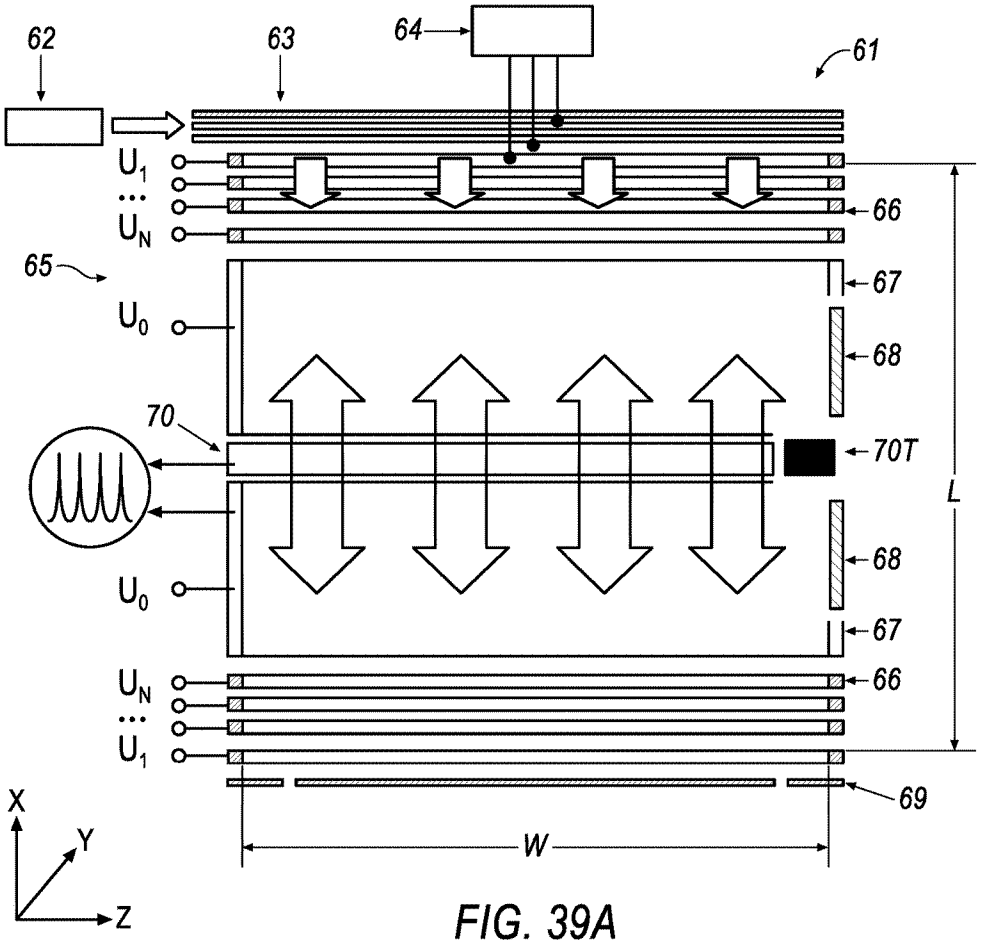
FIG. 39A presents a generalized embodiment of a novel E-trap.

Referring to FIGS. 39A-39B, one embodiment 61 comprises an ion source 62, a pulsed ion converter 63, ion injection means 64, a planar electrostatic trap (E-trap) analyzer 65 with two planar and parallel electrostatic ion mirrors 66 spaced by a field-free region 67, means 68 for bounding ions in the drift Z-direction, auxiliary electrodes 69, and electrodes 70 for image current detection. Optionally, the image current detector 70 is complimented by a time-of-flight detector 70T. The planar E-trap analyzer 65 is substantially elongated in the drift Z-direction in order to increase the space charge capacity and spatial acceptance and the analyzer. It is of principle importance to provide high quality of spatial and time-of-flight focusing of ion mirrors. The planar ion mirrors contain at least four mirror electrodes. In prior art M-TOF, such mirrors are known to provide indefinite ion confinement within the X-Y plane, the third-order time-of-flight focusing with respect to ion energy, and the second-order time-of-flight focusing with respect to spatial, angular, and energy spreads including cross terms.

In operation, ions of a wide mass range are generated in the external ion source 62. Ions get into pulsed converter 63 and, in the preferred mode ions are accumulated by either trapping within the Z-elongated converter 63 or by slowly passing ions along the Z-axis. Periodically, ion packets (shown by arrows) are pulsed injected from the converter 63 into the planar E-trap 65 with the aid of the injection means 64. Ion packets are injected substantially along the X-axis and start oscillating between the ion mirrors 66. Because of moderate ion energy spread in Z-direction, the individual ions slowly drift in the Z-direction. Periodically, once per hundreds of X-reflections the individual ion reach a Z-edge of the analyzer 65, get soft-reflected by the bounding means 68 and revert its slow drift in the Z-direction.

At every reflection in the X-direction, ions pass by the detector electrodes 70 and induce an image current signal. The ion packet length is preferably kept comparable to intra-electrode spacing in Y-direction. The periodic image current signal is recorded during multiple ionic oscillations, get analyzed with the Fourier transformation or other below described transformation methods to extract the information on oscillation frequencies. The frequencies F get converted into ions m/z values, since $F \sim (m/z)^{-0.5}$. Resolution of the Fourier analysis is proportional to the number of acquired oscillation cycles Resolution ~N/3. However, in the preferred mode of the electrostatic trap operation I expect a much faster spectra acquisition. This may be achieved by keeping the ion packets X-length comparable to Y-dimension of E-trap and short (~1/20) compared to the E-trap X-size. Signals will be much sharper and the required acquisition time is expected to drop proportional to ion packet relative length. In analogy to TOF MS the resolving power is limited as $R=T_a/2\Delta T$, where $T_a$ is analysis time and $\Delta T$ is the ion packet time duration. To simplify spectral deciphering, it is preferable reducing an m/z span of analyzed ions within an individual E-trap section.

Space Charge Capacity of Planar E-Traps

The increased space charge capacity and the space charge throughput of the novel electrostatic trap is the primary goal of the invention. Extending Z-width enhances the space charge capacity of the electrostatic trap and of the pulsed converter. For estimation of the space charge capacity and the analysis speed I will assume the following exemplar parameters of the planar E-trap: the Z-Width is Z=1000 mm, (preferably, the analyzer is wrapped into a torroid of 300 mm diameter); X-length is X=100 mm, the X-size of the detector is $X_D$=3 mm, the Y-height of the intra-electrode gap is Y=5 mm, and the acceleration voltage $U_A$=8 kV. I estimate ion packet height as $Y_P$=1 mm and the length as $X_P$=5 mm.

For those numbers the volume occupied by ion packets can be estimated as V=5,000 $mm^2$, which is greater than 100 $mm^3$ in I-path E-trap and 300 $mm^3$ in Orbital traps. Besides, the exemplar electrostatic trap provides ten times greater field strength compared to the I-path E-traps, which allows raising the charge density to $n_0$=1E+4 ions/$mm^3$. Thus, space charge capacity of the novel E-trap is estimated as 5E+7 ions per injection: SSC=V*$n_0$=5E+3 ($mm^3$)*1E+4 (ions/$mm^3$)=5E+7 (ions/injection).

In the later described sections the acquisition time is estimated as 20 ms, i.e. acquisition speed is 50 spectra a second. The space charge throughput of the novel electrostatic trap can be estimated as 2E+9 ions/sec per single mass component, which matches the ion flux from the modern intensive ion sources.

The above estimations are made assuming relatively short (5 mm) ion packets. If analyzing just frequency of the signal, the packets height could be made comparable to the single reflection path, say 50 mm. Then the space charge capacity becomes 10 times higher and equal to 5E+8 ions per injection. It is proposed to employ a Filter Diagonalization Method (FDM) described by Aizikov et al in JASMS 17 (2006) 836-843 in application to ICR magnetic MS. The E-traps have an advantage of well defined initial phase which is expected to accelerate the analysis by factor of tens.

The drive for higher throughput has to be balanced with space charge capacity of the pulsed converter. The particular embodiment 63 of the pulsed ion converter (a later described rectilinear RF converter with a radial ion ejection) approaches the space charge capacity of the E-trap mass analyzer. Preferably, the inscribed diameter of the rectilinear RF converter is between 2 and 6 mm and the Z-length of the converter is 1000 mm. The typical diameter of an ion thread is 0.7 mm and the occupied volume is about 500 $mm^3$. A space charge disturbance appears only when potential of the ion thread exceeds kT/e=0.025V. One can calculate that such threshold corresponds to 2E+7 ions per injection. At expected 50 Hz repetition rate of the ion ejection, the space charge throughput of the pulsed converter is 1E+9 ions/sec and matches the set benchmark 1E+9 i/s for ion flux from the modern intensive ion sources. Besides, the later presented simulation results suggest that a higher space charge potential (up to 0.5-1 eV) within the RF converter would still allow an efficient ion injection.

Resolution of Planar E-Traps

Figure 40B:
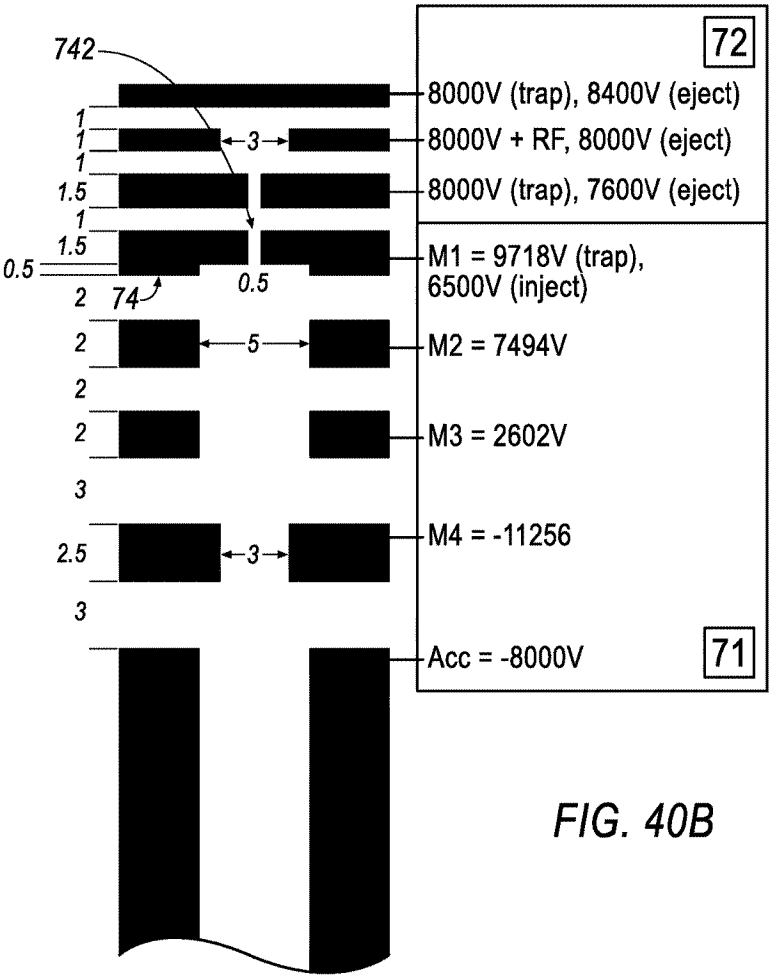
FIG. 40B is a schematic view enlarging one of the ion mirrors and the ion converter of the example electrode set of FIG. 40A.
Figure 40A:
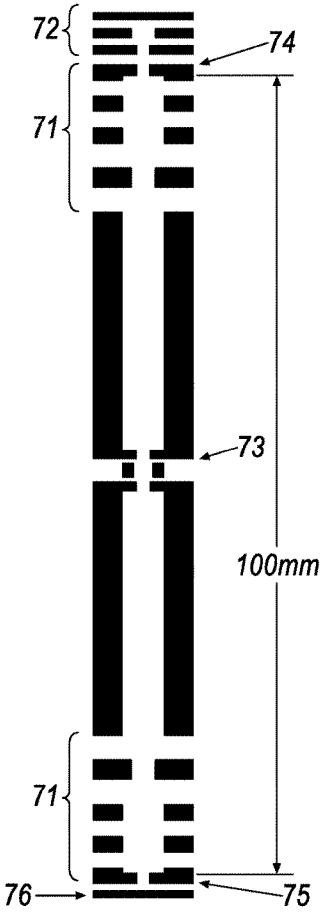
FIG. 40A is a schematic view of an example electrode set formed by planar ion mirrors with an ion converter.

Referring to FIGS. 40A-40B, in order to estimate the utility hereof, there is shown one particular example of ion mirrors 71 of the planar electrostatic trap together with the planar linear radiofrequency ion converter 72. Ion mirrors 71 though resemble ion mirrors of prior art planar M-TOF still differ by relatively wide spaces between electrodes and wider electrode windows to avoid electrical discharges.

The drawing depicts sizes and voltages of ion mirrors 71 for a chosen acceleration voltage $U_{acc}$=−8 kV. The voltages may be offset to allow grounding of the field-free space. The distance 73 between the mirror caps is L=100 mm; each ion mirror comprises four plates with square windows of 5 mm and one plate (M4 electrode) with 3 mm window. To assist ion injection via the mirror cap, the outer plates 74 have a slit 742 for ion injection, and the potential on the outer plate 74 is pulsed. The gaps around electrode gap for M4 are increased to 3 mm to withstand the 13 kV voltage difference. The presented example employs ion mirrors with enhanced isochronous properties. The ion mirror field comprises four mirror electrodes and a spatial focusing region of M4 electrode with attracting potential about twice larger than the accelerating voltage. The potential distribution in X-direction is adjusted to provide all of the following properties of ion oscillations: (i) an ion retarding in an X-direction for repetitive oscillations of moving ion packets; (ii) a spatial focusing of moving ion packets in a transverse Y-direction (iii) a time-of-flight focusing in X-direction relative to small deviations in spatial, angular, and energy spreads of ion packets to at least second-order of the Tailor expansion including cross terms; and (iv) a time-of-flight focusing in X-direction relative to energy spread of ion packets to at least third-order of the Tailor expansion.

For the purpose of even distribution of ion packets along the Z-direction and for the purpose of compensating minor mechanical misalignments of the ion mirrors, the invention suggests a use of an electrostatic controllable wedge. The slit in the bottom electrode 75 allows moderate penetration of a fringing field created by at least one auxiliary electrode 76. In one particular embodiment, the auxiliary electrode 76 is tilted compared to the mirror cap to provide a linear Z-dependent fringing field. Depending on the voltage difference between the bottom mirror cap and the auxiliary electrode, the field would create a linearly Z-dependent distortion of the field within the electrostatic trap in order to compensate a small non-parallelism of two mirror caps. In another particular embodiment, a linear set of auxiliary electrodes is stretched along the Z-direction. Optionally, the voltages of the auxiliary electrodes are slowly varied in time to provide an ion mixing within the E-trap volume. Other utilities of electrostatic wedges are described below in multiple sections.

Few practical considerations should be taken into account at the mirror construction: Mechanical accuracy and mirror parallelism should be at least under 1E-4 of cap-to-cap distance L, which translates into accuracy better than 10 micron at L=100 mm. Accounting the small thickness of the mirror electrodes (2-2.5 mm) it is preferred employing rigid materials, such as metal coated ceramics. For the precision and ruggedness, the entire ion mirror block may be constructed as a pair of ceramic plates (or cylinders in other examples) with isolating groves and metal coating of electrode surfaces. A portion of groves should be coated to prevent the charge built up by stray ions. Alternatively, a ball bearing design may accommodate ceramic balls with submicron accuracy of make.

It is also preferable to further reduce X-size of the E-trap under 10 cm and even under 1 cm, while employing large Z-size (say, 10 to 30 cm diameter). To satisfy requirements of mechanical accuracy and electrical stability such E trap may be constricted using one technology of the group: (i) electro erosion or laser cutting of plate sandwich; (ii) machining of ceramic or semi-conductive block with subsequent metallization of electrode surfaces; (iii) electroforming; (iv) chemical etching or etching by ion beam of a semi-conductive sandwich with surface modifications for controlling conductivity; and (v) a ceramic printed circuit board technology. For the purpose of thermal stability the employed materials may be chosen to have reduced thermal expansion coefficients and comprise one material of the group: (i) ceramics; (ii) fused silica; (iii) metals like Invar, Zircon, or Molybdenum and Tungsten alloys; and (iv) semiconductors like Silicon, Boron carbide, or zero-thermo expansion hybrid semi conducting compounds.

Fewer electrodes with curved windows as shown in FIG. 4 and FIG. 14 may be used to reduce the number of static and pulsed potentials and to increase relative electrode thickness. In one particular embodiment the ion turning region of the ion mirror could be constructed to maintain a parabolic potential distribution in order to enhance space charge capacity of the trap. A spatial defocusing property of the linear field could be compensated by a strong lens, preferably built into the mirror and by an orbital motion within the E-trap 442 shown in FIG. 31.

Figure 41:
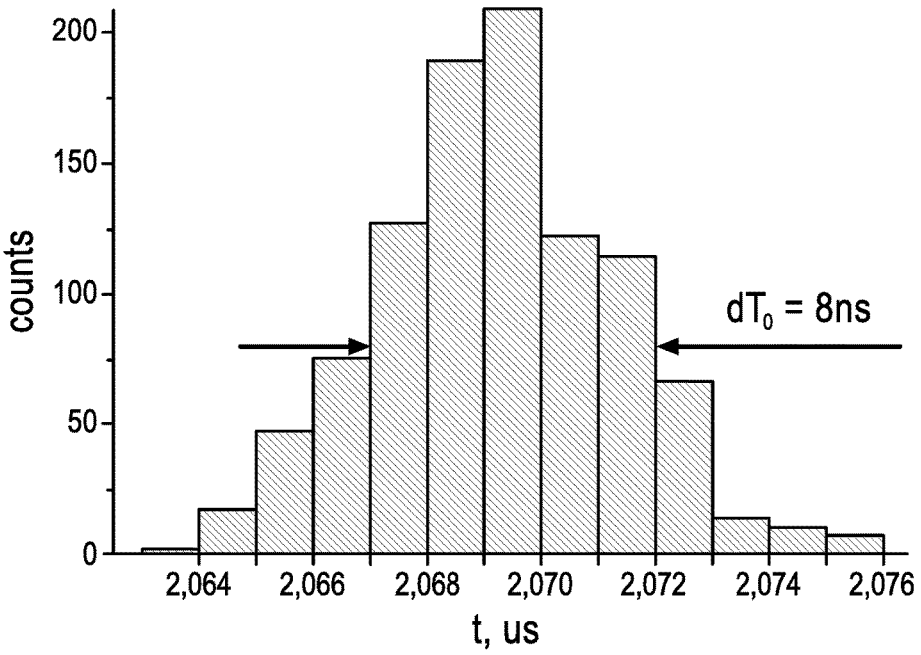
FIGS. 41-42 present plots for describing the resolving power of an electrostatic trap having the example electrode set of FIG. 40A.
Figure 42:
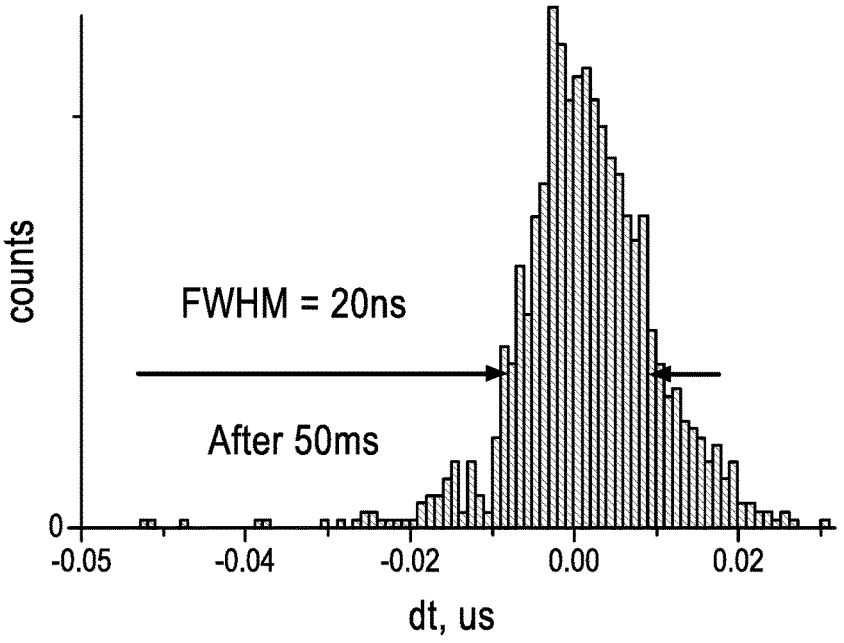

Referring to FIG. 41 and FIG. 42, the aberration limit of resolving power is simulated together with parameters of the injected ion packets for electrostatic trap presented in FIGS. 40A-40B. The accumulated ion cloud within the RF converter 72 is assumed to have thermal energies. Then the beam is confined into a ribbon of less than 0.2 mm and, as shown in figure, the ejected packets are focused tightly with angular divergence under 0.2 degree. The turn-around time is estimated as 8-10 ns as shown in FIG. 41, while the energy spread is 50 eV. The initial parameters are measured in the first time-focal plane. The estimated time width of the ion packets after 50 ms time is only 20 ns (FIG. 42), i.e. the aberration limit of resolution is above 1,000,000! This makes me believing that the practically achievable resolution is rather limited by: (a) by the time duration of ion packets; (b) by the time distortions introduced by Z-bounding means; and (c) by the efficiency of spectra transformation method limiting acquisition speed.

Assuming that resolution is limited by packet relative height and by detector height, I arrive to the following estimations. For E-trap of FIGS. 40A-40B at 8 keV acceleration the velocity of 1 kDa ions is 40 km/s, the frequency of ion passage by detector is F=400 kHz and the flight time per single pass is $T_1$=2.5 us. Accounting that the detected (effective) length of ion packets is 20-25-fold shorter, i.e. 4~5 mm long, the packet time-width for 1 kDa ions is about 0.1 us. Then to acquire spectra with 100,000 mass resolution (corresponding to 200,000 time-of-flight resolution) it would take 20 ms, i.e. approximately 50 times faster than in the prior art orbital traps. It is also understandable, that a longer acquisition can improve resolution up to the aberration limit of one million.

Bounding Means

The bounding means may vary depending on the E-trap topology.

Referring back to FIGS. 8-13, the most preferred embodiment of the bounding means for the cylindrical electrostatic traps comprises wrapping itself of the analyzer into a torroid. The exemplar embodiments 412-417, 52, 422-424, 432-434, 436-437, and 442 of such torroidal traps are shown in FIGS. 14-33. Simulations suggest that the distortion of the isochronous ionic motion and of the spatial ion confinement occur only at fairly small radius R of the analyzer bending compared to the ion trap X-length L. According to simulations, for a selected resolution threshold R=300,000 and at the inclination angle of ion trajectory to X-axis $\alpha$=3 deg the ratio R/L>⅛ and for $\alpha$=4 deg the R/L>¼. I realized that in order to provide stable ion trapping and to provide resolving power in excess of 300,000 the relation between curvature radius R, X-length L of torroidal traps and the inclination angle $\alpha$ in radians between the mean ion trajectory and the X-axis can be expressed as: $R>50*L*\alpha^2$. The requirement to minimal radius R drops at smaller resolution. Still, for the purpose of extending the space charge capacity and space charge throughput of E-traps it is preferable using the R to X-length between 1 and 10.

Figure 45:
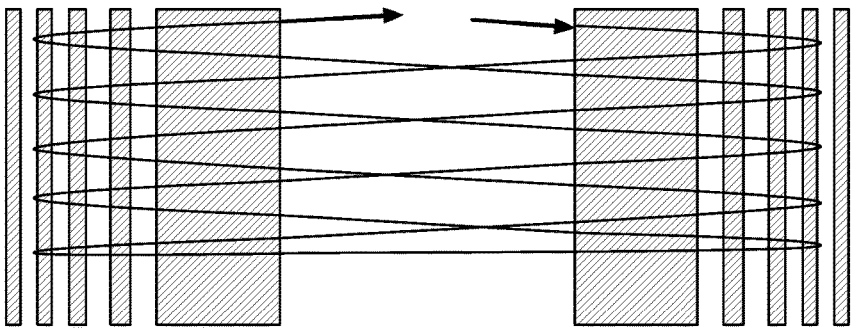
FIG. 45 is a schematic view of an example ion path within an electrostatic field that includes a means for Z-directionally bounding ions.
Figure 43:
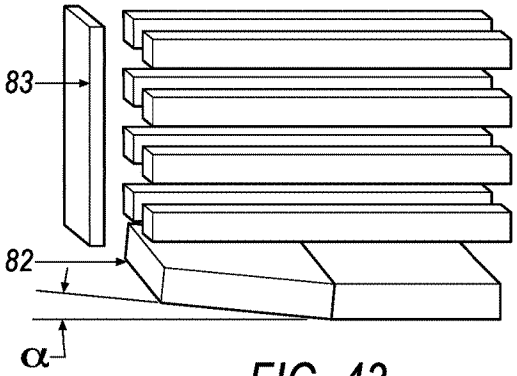
FIG. 43 is a perspective view of a Z-edge of an electrostatic field having a ion mirror bend and an electrode for Z-directionally bounding in electrostatic traps.
Figure 44:
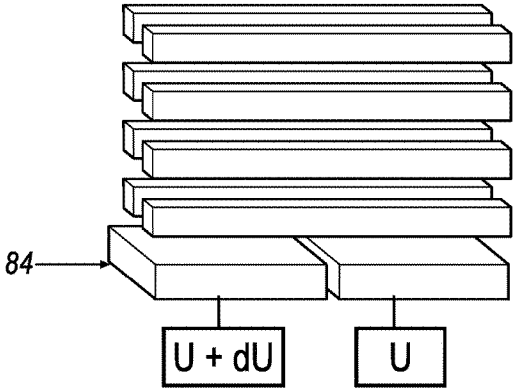
FIG. 44 is a perspective view of a Z-edge of an electrostatic field having a split mirror electrode for Z-directionally bounding in electrostatic traps.

Referring back to FIG. 5, the preferred embodiment of bounding means for E-trap 42 built of electrostatic sectors comprises either a deflector at Z-edges of the field-free region or Matsuda plate 477 known in the prior art. Both solutions provide the ion repulsion at the Z-boundaries. Z-bounding means for planar electrostatic traps, such as embodiment 41 of FIG. 4, comprise multiple exemplar embodiments. Referring to FIG. 43, one embodiment of the bounding means comprises a weak bend 82 of at least one ion mirror electrode relative to the Z-axis An elastic bend can be achieved by using uneven ceramic spacers between the metal electrodes. Yet another embodiment of the bounding means comprises an additional electrode 83 installed at the Z-edge of the field-free region. Referring to FIG. 44, an alternative electronic bend can be achieved by splitting the mirror cap electrode and by applying an additional retarding potential to Z-edge sections 84. Another embodiment for electronic edge bending is provided with the aid of fringing fields penetrating through the cap slit. Any of those means would cause ion reflections at the Z-edges as shown in FIG. 45.

Figure 46:
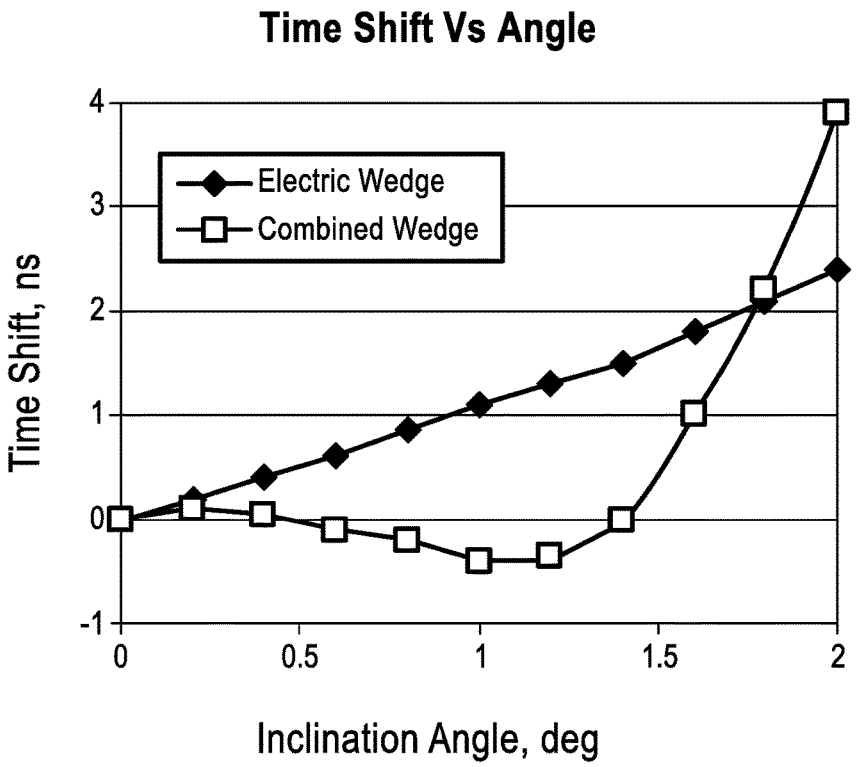
FIG. 46 is a plot of time shifts per single edge reflection within an electrostatic field that includes a means for Z-directionally bounding ions.

Repulsion by Z-edge electrode 83 slows down ion motion in the Z-edge area and thus causes a positive time shift. Since other means of FIG. 43 and FIG. 44 introduce a negative time shift, the combination of those means with electrode 83 would allow partial mutual compensation of the time shifts, as shown in FIG. 46 presenting simulation results for the time shifts per single edge reflection. Note that by choosing properly the average ion energy in the Z-direction one can reach a zero average time-shift for ion packet oscillation frequency. Still, because of the ion energy spread in the Z-direction there would occur ion packets time spread, but not the shifting in the oscillation frequency!

Referring to FIG. 46, the time spreading of the ion packets in the Z-edge area could be estimated. For the particular presented example of an inclination angle from 0.5 to 1.5 deg, the time spreading of 1000 amu ions per single Z-reflection would remain under 0.5 ns. Now assuming the average angle (energy in Z-direction=3 eV/charge) equal to $\alpha$=1 deg, and accounting the large analyzer Z-width W=1000 mm, such edge deflections occur only once per every 500 oscillations, i.e. once per 1 ms. The time spread at Z-reflections becomes less than 5E-7 of the flight time. Thus, at moderate inclination angles of $\alpha$~1 degree the Z-edge deflections would not affect resolution of the E-trap up to R=1,000,000.

In one embodiment, the E-trap analyzer does not employ bounding means and ions are allowed to free propagate in the Z-direction. The embodiment eliminates potential aberrations of the Z-bounding means, allows clearing ions between injections, and may provide sufficient ion residence time just because of sufficient Z-length of the E-trap analyzer. As an example a time-of-flight detector would allow resolution well in excess of 100,000 for calculated 500 mirror reflections.

Novel E-Traps with Image Current Detectors

Figure 47:
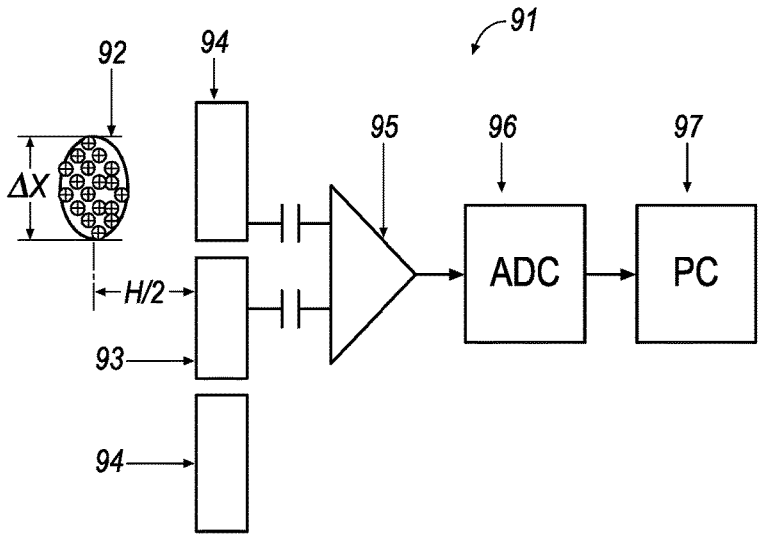
FIG. 47 is a schematic view of an arrangement of an ion detector, an amplifier, a converter, and a processor for use with an electrostatic trap.

Referring to FIG. 47, the detection means 91 comprise at least one detection electrode 93 and a differential signal amplifier 95 picking the signal between said detector electrode 93 and the surrounding electrodes 94 or ground. The flying-by ion packets 92 induce an image current signal on the detector electrode 93. The signal is differentially amplified by amplifier 95, recorded with an analog-to-digital converter 96, and is converted into a mass spectrum within a processor 97, preferably having multiple cores. In one embodiment, short detection electrode is kept in middle plane of the E-trap. The ion injection means and E-trap are tuned such that the first and subsequent time focusing planes coincide with the detector plane. In another embodiment, pick up electrodes are chosen long to make the signal approaching sinus. Alternatively, a line of electrodes is used to form higher frequency signals per single ion pass.

The present disclosure proposes the following methods relying on short ion packets: (a) a Wavelet-fit transformation wherein the signal is modeled by the repetitive signal of the known shape, the frequency is scanned and resonance fits are determined; (b) wrapping of raw spectra with a specially design wavelet; and (c) a Fourier transformation providing a multiplicity of frequency peaks per single m/z component, then followed by wrapping multiple frequency peaks with the calibrated distribution between peaks; higher harmonics improve resolution of the algorithm. Potentially, the gain in the analysis speed could reach L/$\Delta$X earlier estimated as L/$\Delta$X~20. Alternatively, the data acquisition in E-traps is accelerated by: using long detector, generating nearly sinusoidal waveforms, and applying a Filter Diagonalization Method (FDM) described by Aizikov et al in JASMS, 17 (2006) 836-843, incorporated herein by reference.

Figure 48:
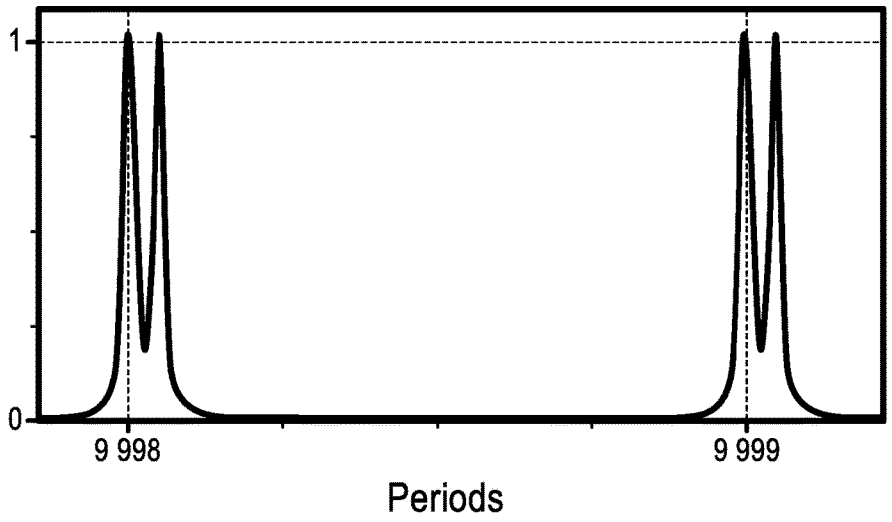
FIG. 48 illustrates the simulation results for image charge detection accelerated by the Wavelet-fit analysis.
Figure 49:
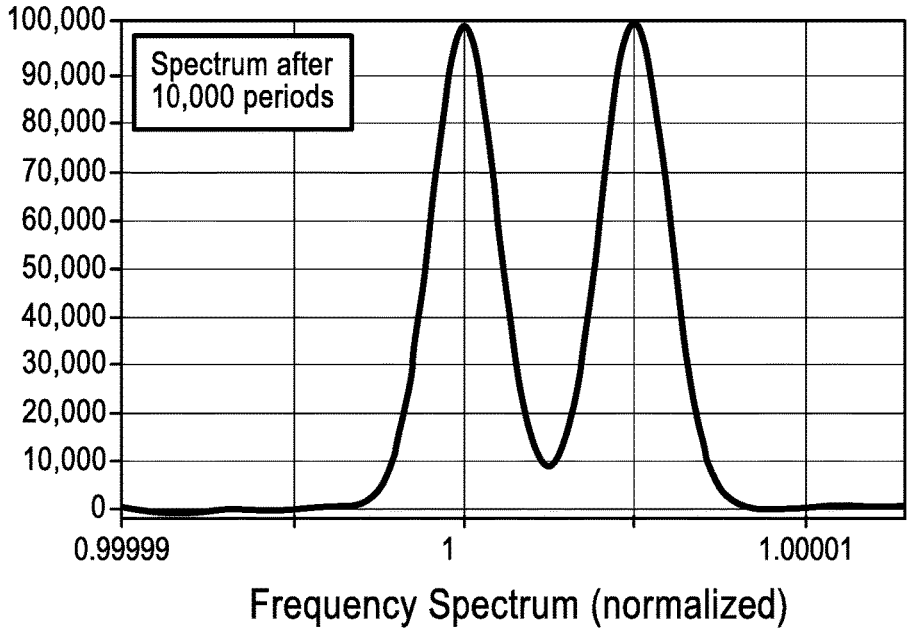
FIG. 49 illustrates a recovered frequency spectrum.

Referring to FIG. 48, the results of Wavelet-fit transformation are illustrated. Waveform is modeled as an image signal on detector 93 on FIG. 47. For each ionic component the signal is spread by 1/20 of the flight period assuming Gaussian spatial distribution within the ion packet while accounting the known arc-tangent relation for the induced charge per individual ion. FIG. 48 shows a segment of the signal shape for two ionic components with arbitrary masses 1 and 1.00001. Because of very similar masses (and hence frequencies) the raw signal of ionic components becomes notably separated only after 10,000 oscillations. Referring to FIG. 49, the frequency spectrum is recovered from the 10,000 period signal. Ionic components are resolved with 200,000 time-of-flight resolution corresponding to 100,000 mass resolving power. For the exemplar signal, the Wavelet fit analysis allows twenty times faster analysis than the Fourier analysis. However, the Wavelet fit analysis generates the additional frequency hypotheses which can be removed by the combination of the Wavelet-fit analysis with the Fourier analysis of signals from an additional wider detector, or by logical analysis of the overlaps, or by analyzing a limited m/z span. The proposed strategy may be employed in other trapping mass spectrometers, like orbital traps, FTMS and the existing non extended E-traps.

Figure 50:
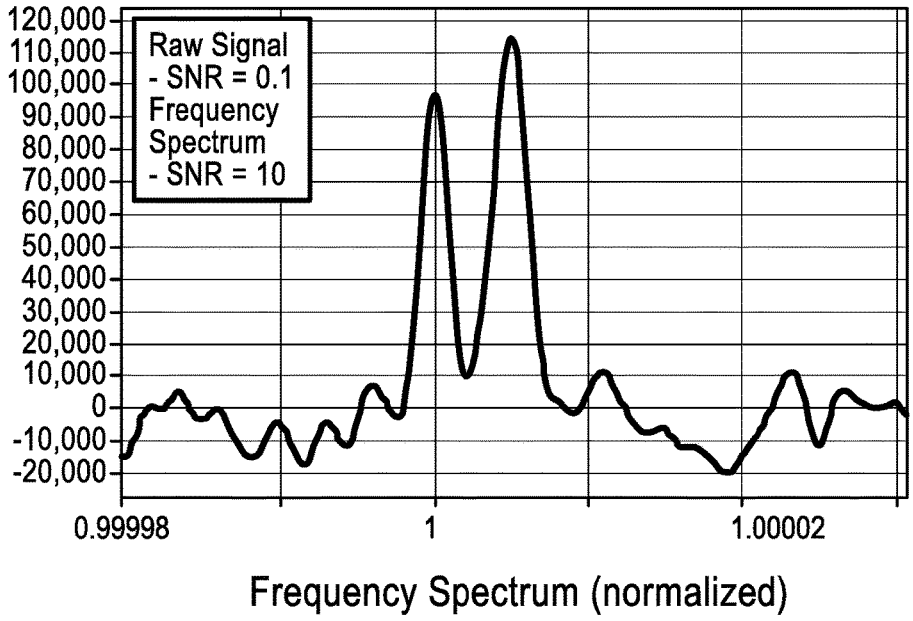
FIG. 50 illustrates a raw frequency spectrum mixed with noise.

Referring to FIG. 50, the signal-to-noise ratio (SNR) is enhanced with number N of analyzed periods. The initial 'raw' spectrum has been mixed with white noise having the standard deviation (RSD) ten times stronger than the ionic signal amplitude, i.e. SNR=0.1. After the Wavelet-fit analysis of N=10,000 oscillations the SNR improved to SNR=10, i.e. 100 times=$N^{0.5}$. Thus, analysis acceleration would reduce SNR. Note, that the detected signal would not compromise the mass accuracy, limited by ion statistics. Also note that in cases, when the dynamic range is limited by the space charge capacity of the trap, the dynamic range of the analysis per second may be improved proportional to the square root of the analysis speed.

Accounting specifics of the image charge detection, the signal acquisition should preferably incorporate strategies with variable acquisition times. Longer acquisitions improve the spectral resolution and sensitivity but do limit the space charge throughput and the dynamic range of the analysis. One can choose either longer acquisitions T~1 sec to obtain resolving power up to 1,000,000 corresponding to the aberration limit of the exemplar E-trap, or choose T<1 ms to increase the space charge throughput of the E-trap up to 1E+11 ions/sec for better match with intense ion sources, like ICP. Strategies with adjustment or automatic adjustment of the ion signal strength and of the spectral acquisition time are discussed below in the section on the ion injection.

Figure 51:
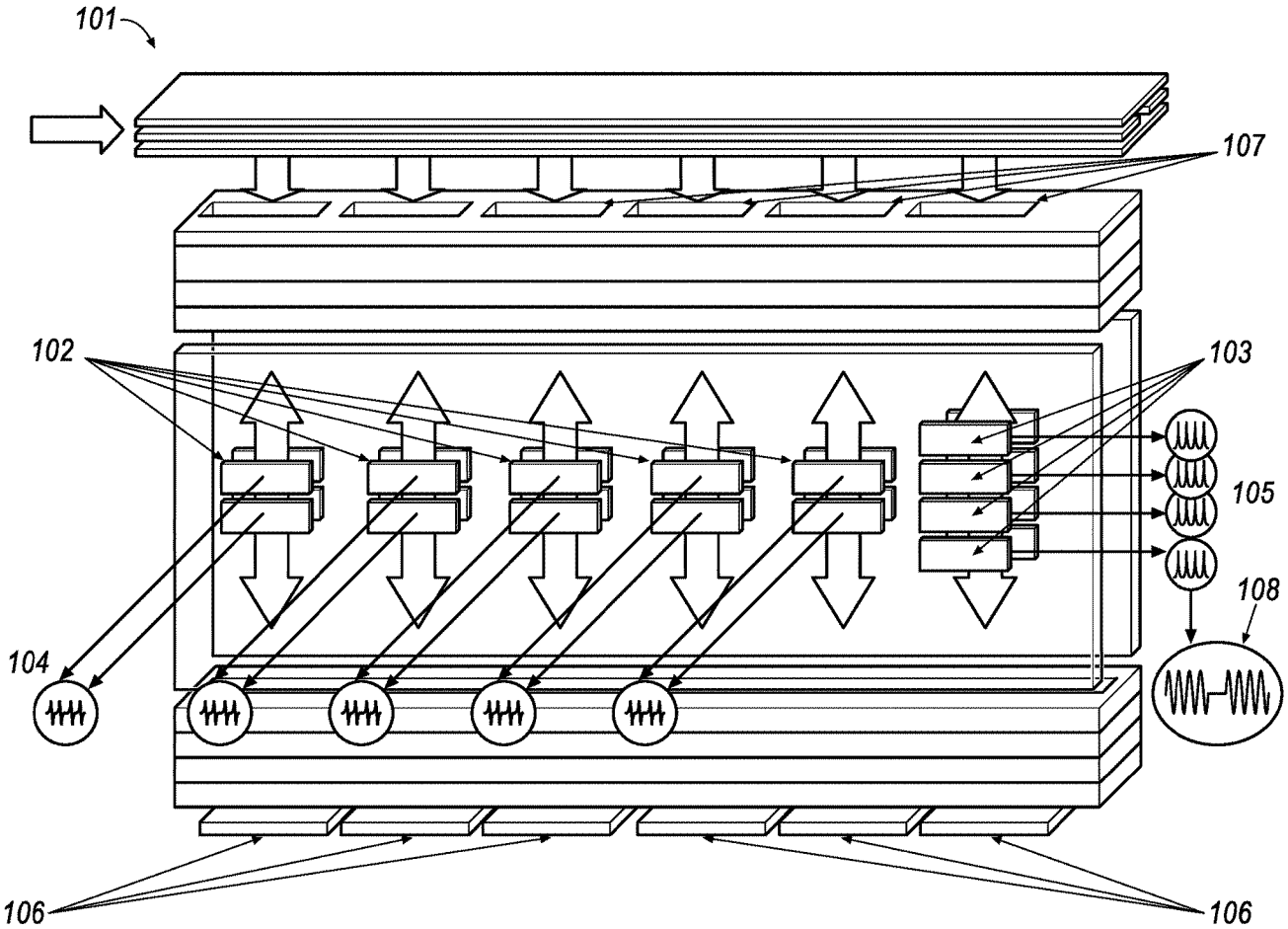
FIG. 51 presents embodiments with the splitting of image charge detectors in Z and X-directions.

Referring to FIG. 51, in one particular embodiment, at least one detection electrode is split into a number of segments either in Z-direction 102 and/or X-direction 103. Each segment is preferably sensed by a separate preamplifier 104 or 105 and is optionally connected to a separate acquisition channel. The detector splitting 102 in the Z-direction allows reducing the detector capacity per channel and this way enhances the bandwidth of the data system. Splitting the electrodes drops the capacity of individual segments in proportion to Z-width of the segments. The splitting also allows detecting the homogeneity of ion filling of the electrostatic trap in the Z-direction if acquiring data with multiple data channels. In case of a moderate imperfection in the analyzer geometry there may appear Z-localization of trapped ions or frequency shifts correlated with Z-position. Then a set of auxiliary electrodes 106 could be used for redistributing ions in the Z-direction and for compensating the frequency shifts. Alternatively, Z-localization may be used for multi-channel detection, e.g. for acquiring spectra with different resolving power and acquisition time, or at various sensitivity of individual channels, or for using narrow bandwidth amplifiers, etc. The particularly beneficial arrangement appears when ions are distributed between multiple Z-regions according to their m/z value. Then each detector is employed for detection of relatively narrow m/z span which allows narrow-band detection of higher harmonics while avoiding artifact peaks in the unscrambled spectra. As an example, detection of $11^{th}$ harmonics (relative to main oscillation frequency) can be confused by presence of $9^{th}$ and $13^{th}$ harmonics. Then the allowed frequency range of 13:9 roughly corresponds to 2:1 m/z range. The Z-localization may be reached either by using auxiliary electrodes (e.g. 39 in FIG. 3), or by spatial or angular modulation of electrostatic field in the Z-direction. One method comprises a step of time-of-flight separation of ions within the RF pulsed converter to achieve ion separation along the Z-axis according to m/z sequence at the time of ion injection into multiple Z-regions of the E-trap. Another method comprises mass separation in ion traps, ion mobility or TOF analyzers for sequential ion injection into multiple converters and for subsequent analysis within multiplexed E-trap volumes with narrow band amplifiers tuned for corresponding narrow m/z span.

Splitting 103 of the detection electrodes in X-direction is likely to accelerate the frequency analysis, to improve signal-to-noise ratio and to remove higher harmonics in the frequency spectra by deciphering phase shifts between adjacent detectors. In one embodiment, an alternated pattern of detector sections provides signals strings 108 with a higher frequency. In this case the detectors may be connected to single preamplifier and data system. In other embodiments, multiple data channels are used. The multi-channel acquisition in E-traps is the potential approach which can provide multiple benefits, such as: (i) improving the resolving power of the analysis per the acquisition time; (ii) enhancing the signal-to-noise ratio and the dynamic range of the analysis by adding multiple signals with account of individual phase shifts for various m/z ionic components; (iii) enhancing signal-to-noise ratio by using narrow bandwidth amplifiers on different channels; (iv) decreasing capacitance of individual detectors; (v) compensating parasitic pick-up signals by differential comparison of multiple signals; (vi) improving the deciphering of the overlapping signals of multiple m/z ionic components due to variations between signals in multiple channels; (vi) utilizing phase-shift between individual signals for spectral deciphering; (vii) picking up common frequency lines in the Fourier analysis; (viii) assisting the deciphering of sharp signals from the short detector segments by the Fourier transformation of signals from the large size detector segments; (ix) compensating a possible shift of temporal ion focusing position; (x) multiplexing the analysis between separate Z-regions of said electrostatic trap; (xi) measuring homogeneity of ion trap filling by ions; (xii) testing the controlled ion passage between different Z-regions of said electrostatic trap; and (xiii) measuring the frequency shifts at Z-edges for controllable compensation of frequency shifts at said Z-edges.

In one embodiment, the detecting electrode may be floated and capacitive coupled to amplifier, since ion oscillation frequency (estimated as 400 KHz for 1000 amu) is much higher compared to noise frequency of HV power supplies in 20-40 kHz range. It is still preferable keeping the image charge detectors at nearly grounded potential. In another embodiment, the grounded mirror plate is used as a detector. In yet another embodiment, the field-free region of the analyzer is ground and ions are injected either from a floated pulsed converter, or ions are pulsed accelerated to full energy at injection step. The pulsed converter may be temporarily grounded at the ion filling stage. Yet another embodiment employs a hollow electrode (elevator) which is pulsed floated during ion passage through the elevator.

Novel E-Traps with Time-of-Flight Detectors

Figure 52:
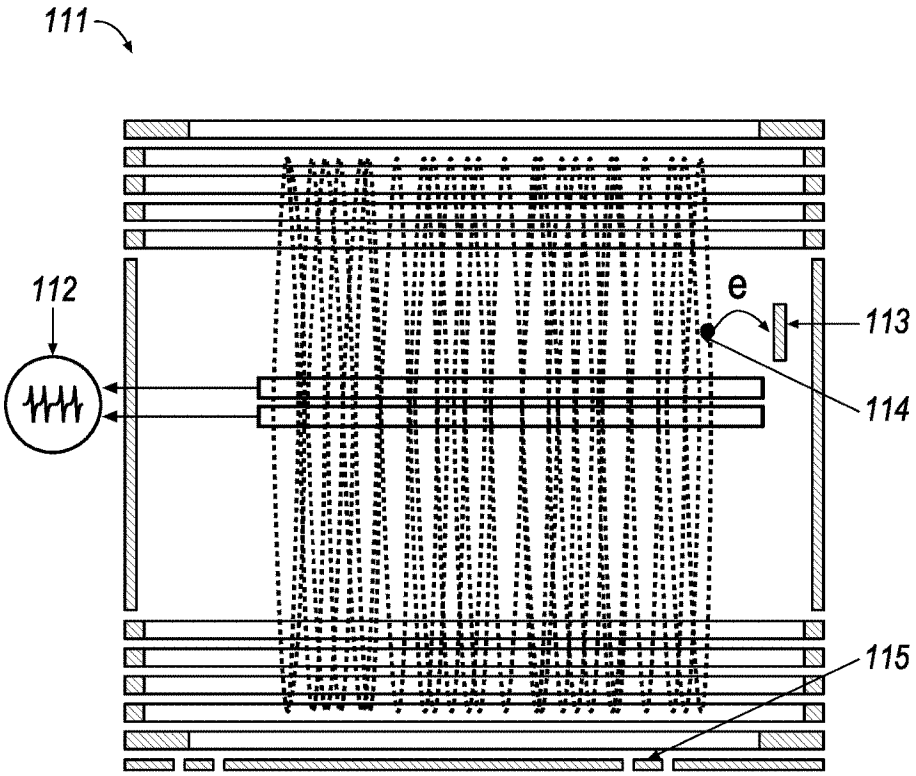
FIG. 52 is a schematic view of an electrostatic trap having an image current detector and time-of-flight detector.

Referring to FIG. 52, in addition to the image current detector 112, ions are detected by a more sensitive time-of-flight detector 113, such as a micro-channel plate (MCP) or a secondary electron multiplier (SEM), as shown in embodiment 111. The time-of-flight detector 113 may also be provided as an alternative to the image current detector 112, rather than both detectors 112, 113 being provided as in the shown embodiment 111. The principle concept of such time-of-flight detection method, as it relates to the inventions of this disclosure, lies in detection of only a small and controllable fraction of injected ions per one oscillation cycle with the subsequent analysis of ion oscillation frequencies based on sharp periodic signals. The expected sampled portion may vary between 0.01% and 10% and depends on counter acting requirements of the resolving power and of the acquisition speed. The sampled percentage is reverse proportionally to the average number of ion oscillations, selected from 10 to 100,000. Preferably, the sampled portion is controlled electronically, e.g. by ion packet swallowing or side deflection in E-trap field. The adjustment allows alternating between spectra with higher speed and sensitivity and spectra with higher resolving power. Ultimately, the sampled portion may be raised up to 100% after a preset oscillation time.

Time-of-flight detector is capable of detecting compact ion packets without degrading time-of-flight resolution. Preferably, ion injection step is adjusted to form short ion packets (X-size is in 0.01-1 mm range) and to provide time-of-flight focusing of ion packets in the detector plane, usually located in the symmetry plane of the E-trap. The E-trap potentials are preferably adjusted to sustain location of time-of-flight focusing in the detector plane.

Alternatively, or in addition to the Fourier and the Wavelet-fit analysis, the raw signal deciphering is assisted by a logical analysis of overlapping signals from different m/z ionic components. As described in the later co-pending patent application by the author, the logical analysis is split into stages, wherein: (a) signal groups are gathered corresponding to hypothesis of possible oscillation frequencies; (b) the overlapping signals for any pair of hypotheses is either discarded or analyzed to extract individual component signals, (c) the validity of the hypotheses is analyzed based on signals distribution within each group; and (d) the frequency spectra are reconstructed wherein signal overlaps no longer affect the result. Such analysis potentially can extract signals of small intensity down to 5-10 ions per individual m/z component. In one embodiment, a pulsed ion converter extends along an initial portion of E-traps' Z-length, and ions are allowed to pass through the trap in a Z-direction, such that light ions arrive to a detection zone earlier. This reduces peak overlaps. Since the proposed method generates series of periodic sharp signals, it is further proposed to improve throughput of the analysis by employing frequent ion injections with the period being shorter than the average ion residence time in the analyzer. The additional spectral complication should be deciphered similar to deciphering of ion frequency patterns.

Preferably, in order to make the detector compact and free of dead zones, an ion-to-electron (I-E) converting surface 114 is placed into the ion path and a SEM or MCP detector is placed outside of the ion path. The I-E converter may comprise either a plate, optionally covered by mesh for accelerating secondary particles, or a mesh, or a set of parallel wires, or a set of bipolar wires, or a single wire. The probability of ion collision with the converter may be controlled electronically in multiple ways, such as a weak steering of ions from the central trajectory in Y-direction and towards the side zone of the I-E converter or TOF detector, or by ion packet local defocusing which leads to a local swallowing of ion packets in Y-direction, or by applying an attractive potential to the I-E converter (also acting as repulsing field for secondary electrons), etc. The sampled ion portion can be controlled by transparency of the converter, by window size in the converter electrode or by Z-localization of the converter. Ions hitting the ion-to-electron converter emit secondary electrons. A weak electrostatic or magnetic field is employed to collect secondary electrons onto the SEM. Then secondary electrons are preferably sampled orthogonal to ion path. Preferably, ion packets are formed short (say under 10 ns) to further accelerate the mass analysis. Preferably, the sampling ion optics is optimized for spatial and time-of-flight focusing of secondary electrons.

In one embodiment, to detect a small portion of ions per oscillation the detector is placed at a Z-edge of the E-trap and ions are allowed to reach the detector whenever they travel into the detector Z-area. In another embodiment, the ions are bound within a free oscillation area and then they are allowed to travel into the detection area, for example by changing potentials on the auxiliary electrode 115. Alternatively, ion packets are expanded in the Y-direction to hit the detector. Yet in another embodiment, the mesh converter occupies only a chosen small fraction of ion path area. Yet in another embodiment, ions are directed towards a detector from a separate E-trap volume by sampling electric pulses or by a periodic string of pulses, in order to reduce the overlapping of different ionic components on the detector and to simplify the spectral frequency deciphering. Such sampling pulses could be a Z-deflecting pulses providing ion packets a kick to overcome a weak Z-barrier.

Contrary to image current detector, the TOF detector is preferably deals with much sharper peaks. Besides, the TOF detector is more sensitive, since it is capable of detecting single ions. Compared to TOF mass spectrometers, the invention extends the detector dynamic range by the orders of magnitude since the ion signal is spread onto multiple cycles. For novel E-traps, the TOF detector allows expanding the E-trap height, which ease the mechanical accuracy requirements to a high resolution E-trap, allows further extension of space charge capacitance, throughput and the dynamic range.

It is preferable extending the life time of the detector by using non deteriorating converting surfaces even at a cost of a lower secondary electron gain per amplification stage. When analyzing signals at the rate of 1E+9 ions per second, the life time of the TOF detector becomes the main concern. An MCP with a small gain (say, 100-100) may be used for the first conversion stage. Then 1Coulomb life charge would allow approximately 1 Year life time at 1E+9 e/sec charge input and 1E+11 e/sec charge output. Similarly, conventional dynodes can be used at the initial amplification stage. To avoid dynode surface poisoning and aging at the subsequent signal amplification stage there should be either dynodes with non modified surfaces or an image charge detection of the initially amplified signal. The second stage can be a scintillator followed by a sealed PMT, by a pin-diode, by an avalanche photo diode, or by a diode array.

Figure 53:
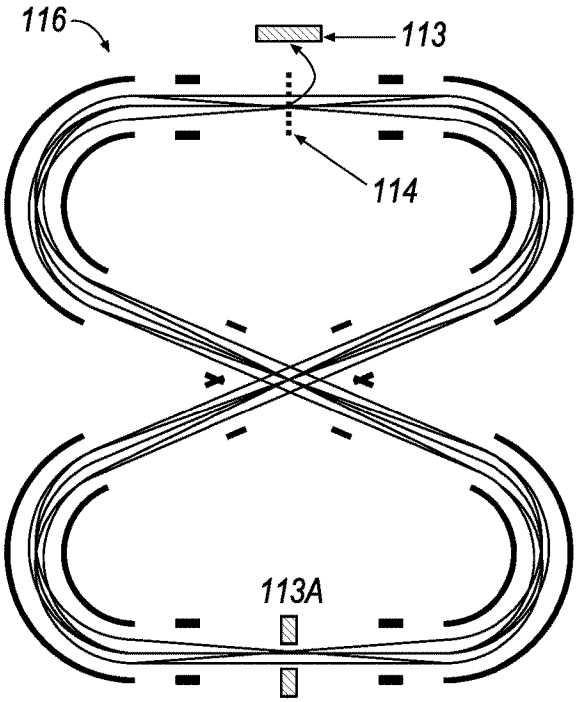
FIG. 53 is a schematic view of a race track electrostatic trap having an annular detector and an ion-to-electron converter assisting a time-of-flight detector.
Figure 54A:
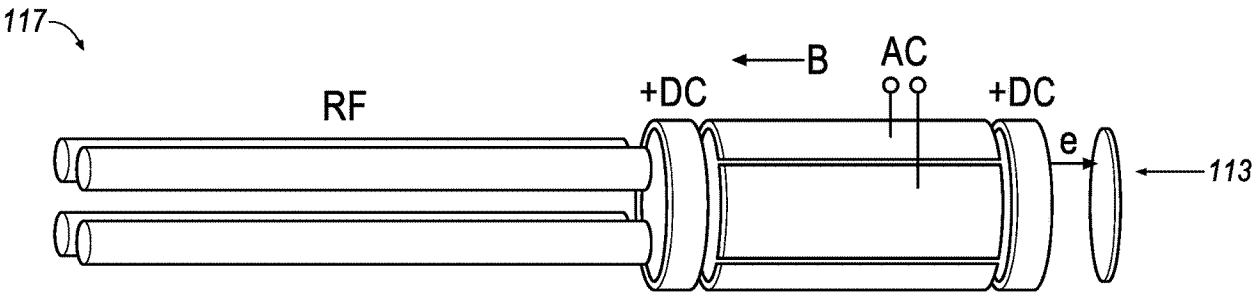
FIG. 54A is a perspective view of a magnetic trap.
Figure 54C:
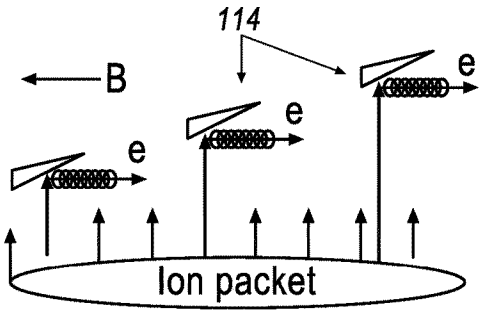
FIGS. 54B-54D illustrate ion-to-electron converters for the magnetic trap of FIG. 54A.
Figure 54D:
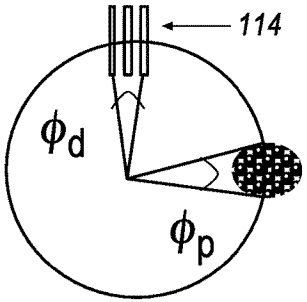
Figure 54B:
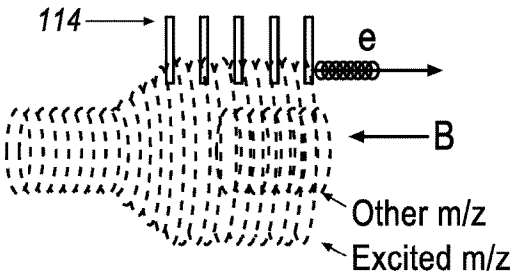
Figure 56A:
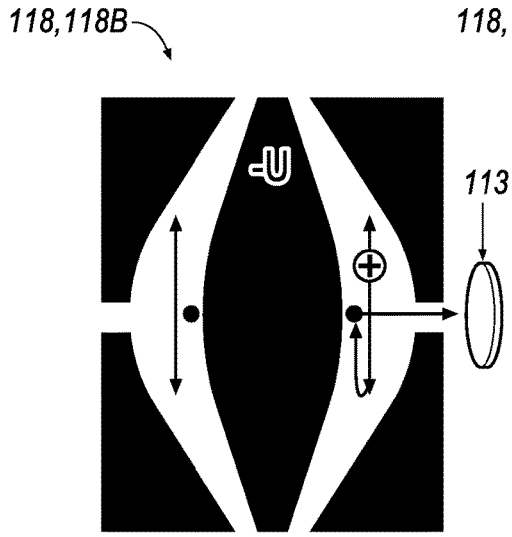
FIGS. 56A-56B are schematic views describing another example of orbital traps.
Figure 56B:
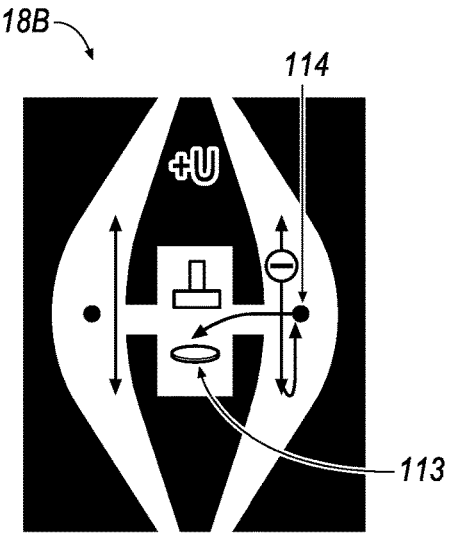
Figure 57A:
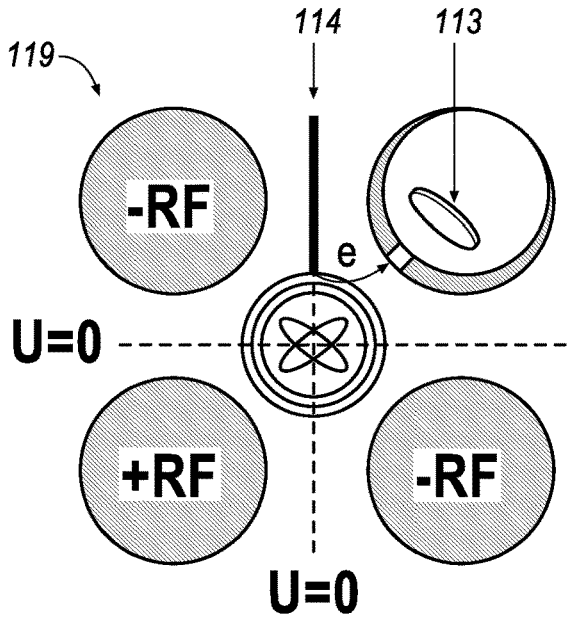
FIGS. 57A-57B are schematic views illustrating the possibilities for utilizing a conversion surface and detector within linear RF ions traps.
Figure 57B:
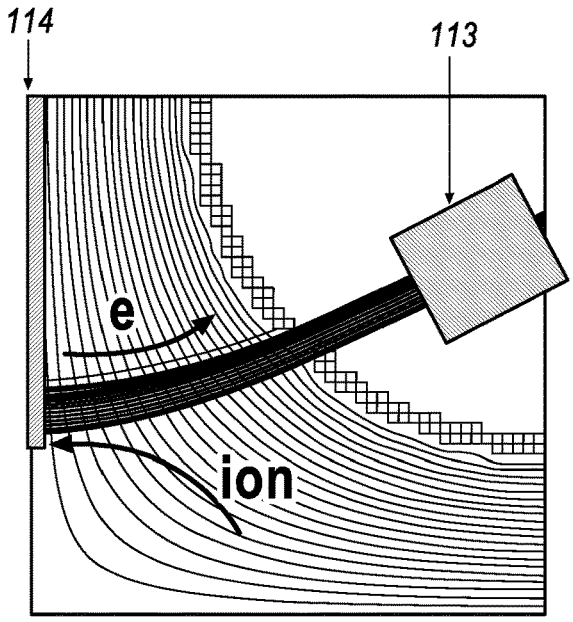

The novel method of detection is applicable to other known types of ion traps, like I-path coaxial traps, race track electrostatic traps 116 using electrostatic sectors in FIG. 53, magnetic traps with Ion Cyclotron Resonance (ICR) 117 in FIGS. 54A-540, penning traps, an ICR cell with RF barriers, orbital traps 118 in FIGS. 55-56 and linear radio frequency (RF) ion traps 119 in FIG. 57A-57B.

In race-track ion traps 116, illustrated in FIG. 53, a fairly transparent (90-99.9%) I-e converter 114 may be set at an ion time-focal plane and may sample a small portion of ion packets per cycle. The secondary electrons are preferably extracted sidewise onto an offline TOF detector 113 by combined action of local electric fields and weak magnetic fields to separate electrons from secondary negative ions. Alternatively, the sampled ion percentage is reduced and controlled by setting a detector in a peripheral region of ion path or by using an annular detector 113A. The prior art race-track ion traps employ narrow ion paths. The invention proposes extending the traps in the Z-direction.

In ICR MS 117, as illustrated in FIGS. 54A-540, the TOF detector 113 is preferably set coaxial and outside of the ICR-cell, and an I-e converter 114 is preferably set at relatively large radius within the ICR cell. Preferably, ions of a limited m/z span are resonance excited to larger orbits and hit the I-e converter 114, such that to maintain relatively small angular spread $\phi_p$ of ion packets. The converter is set at an angle to the axis Z, such that secondary electrons could be released from the conversion surface in spite of micron size spirals magnetron motion, while secondary ions are likely to be caught by the surface. Preferably, the converter occupies a small portion of an ion path to form multiple signals per m/z component. Alternatively, sampling of small portion is arranged by slow ion excitation. The method improves the detection limit compare to image current detection.

Figure 55A:
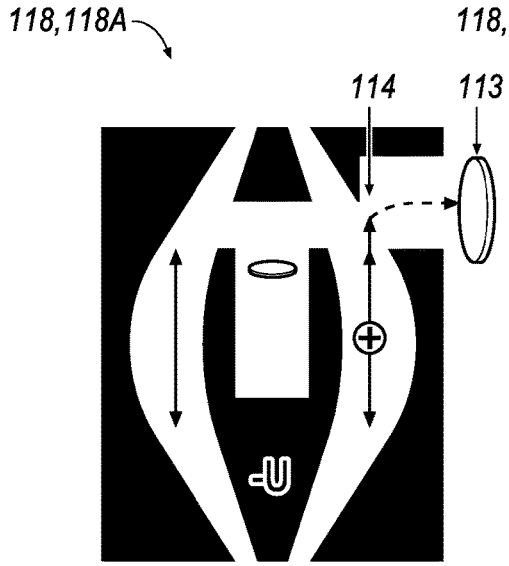
FIGS. 55A-55B are schematic views describing a first example of orbital traps.
Figure 55B:
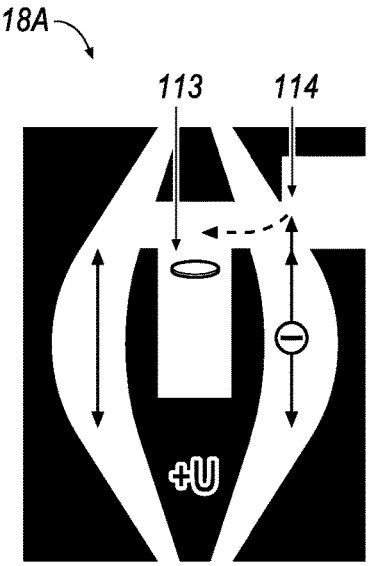

Referring to FIGS. 55-56, in orbital traps 118, two examples 118A, 118B of arranging I-e converters 114 and detectors 113 are shown in FIG. 55A (118A) and in FIG. 56A (118B) and their polarity variations are shown in FIG. 55B (118A polar variation) and in FIG. 56B (118B polar variation). In FIGS. 55A-55B, an m/z span of trapped ions is excited either to a larger size axial motion or, in FIGS. 56A-56B, to a different size radial motion. At gradual excitation there would be formed multiple periodic signals per single m/z.

Referring to FIGS. 57A-57B, in linear RF ion traps 119, the conversion surface 114 may be placed diagonally to quadrupole rods, and secondary electrons could be sampled via a slit in the RF rods onto a detector 113. The conversion surface 114 is set at the surface corresponding to zero RF potential appearing due to opposite RF signals on the trap rods. The arrangement relies on very rapid electron transfer taking nanoseconds relative to slow (sub microsecond) variations of the RF field. Preferably, ions of a selected m/z span are excited to larger oscillation orbits, preferably having strong circular motion component due to rotational excitation. Then small portion of ions would be sampled due to slowly raising orbital radius and variations in radiofrequency ion motion. Preferably, a set of multiplexed linear RF traps is employed for enhancing the analysis throughput.

In all described methods, there are formed multiple periodic signals which are treated with logical analysis. Excitation of narrow m/z span simplifies spectral unscrambling. Detection threshold is estimated between 5 to 10 ions per ion packet, which improves detection limit compared to image current detection. In all described embodiments and methods the spectral deciphering can be improved by either sequential injection of ions within a limited m/z span, or by sequential excitation of ions of a limited m/z span.

Ion Injection into Novel E-Traps

In an embodiment, the ion injection into novel E-traps provides one, some, or all of the following: (a) accumulates ions between the injections to enhance the duty cycle of the converter; (b) provides space charge capacity of 1E+7-1E+8 ions at a long ion storage up to 20 msec; (c) preferably, being extends along the drift Z-direction; (d) is placed in close vicinity of the analyzer to avoid the m/z span limitations due to time-of-flight effects at the injection; (e) operates at gas pressures under 1E-7 Torr to sustain good vacuum in the analyzer; (f) generates ion packets with the energy spread under 3-5%, with minimal angular spread (less than 1 degree) and with the X-length either between 0.1 mm in case of TOF detector up to 30 mm in case of using image detector with FDM analysis; and (g) introduces minimal distortion onto the potentials and fields of electrostatic traps.

Figure 58:
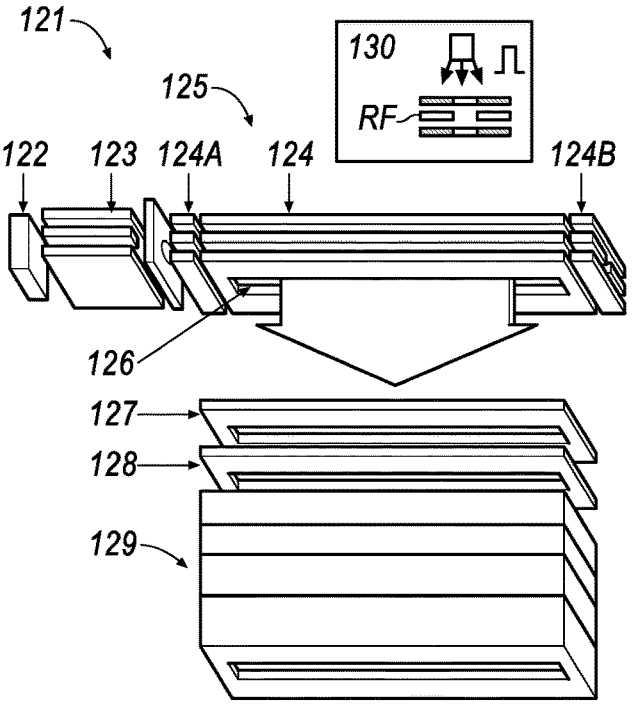
FIG. 58 shows a schematic for the ion pulsed converter built of radial ejecting radiofrequency ion guide.

Referring to FIG. 58, an embodiment 121 of E-trap with a radio frequency (RF) pulsed converter 125 generalizes a group of the converter embodiments and injection methods. The converter 125 comprises a radio frequency (RF) ion guide or ion trap 124 having an entrance end 124A, an exit end 124B and a side slit 126 for radial ejection. The converter is connected to a set of DC, RF and pulse supplies (not shown). Preferably, the converter comprises a rectilinear quadrupole 124 as depicted in the figure, though the converter may comprise other types of RF ion guides or traps like an RF channel, an RF surface, an RF array of traps formed by wires, an RF ring trap, etc. Preferably, the RF signal is applied only to the middle plates of the rectilinear converter 125 as shown in the icon 130. In some embodiments for the purpose of creating an X-elongated ion packets, the RF ion guide may be extended in the X-direction and comprise multiple RF electrodes. Still, it is expected that the converter provides ion packets which are at least ten fold longer in Z-direction. Preferably, the entrance and the exit sections of the converter have electrodes with a similar cross section, but those electrodes are electrically isolated to allow an RF or DC bias for trapping ions in the Z-direction. Figure also depicts other components of the electrostatic trap: a continuous or quasi-continuous ion source 142, a gaseous and RF ion guide at intermediate gas pressure 123, an injection means 127, and a planar electrostatic trap 149 having a mirror cap electrode 128 with an injection slit. In some embodiments (for example embodiment 131 of FIG. 59), the pulsed converter 135 is curved to match the circular curvature of the electrostatic trap 139.

In operation, ions are fed from ion source 122, pass gaseous ion guide 123 and fill pulsed converter 125. In one method, ions are initially accumulated within the gaseous ion guide 123, and then are pulse injected into the converter 125 through the entrance end 124A, pass through the guide 124 and get reflected at the exit end 124B by either an RF or a DC barrier. After the pulsed ion injection, the potential of the entrance end 124A is brought up to trap ions indefinitely in the portion 124. The duration of the injection pulse is adjusted to maximize the m/z range of trapped ions. In another method, the gaseous ion guide 123 and the converter 125 constantly remain in communication, and ions exchange freely between those devices for the time necessary for the equilibration of m/z composition within the converter 125. Yet, in another method, ions are continuously fed from the gaseous ion guide 123 and pass through the converter 125 at a small velocity (under 100 m/s) and leave through the exit end 124B. Accounting the extended ~1 m length of the converter the ion propagation time becomes above 10 ms, i.e. comparable to the period between ejections into the electrostatic trap (20 ms for R=100,000). For this embodiment, it is preferable using the same rectilinear electrodes and the same RF power supply for both—gaseous ion guide and vacuum converter and to remove a DC barrier between them. Preferably, a converter protrudes through at least one stage of differential pumping. Preferably, the converter has curved portions to reduce the direct gas leakage between pumping stages. In those methods, optionally, a portion of the converter is filled with a gas pulse as shown in the icon 130 in order to reduce the kinetic energy of ions, either for the trapping or for the slowing down their axial velocity. Such pulse is preferably generated with a pneumatic valve or by a light pulse desorbing of condensed vapors. The proposed pulsed converter with the RF radial ion trapping at deep vacuum allows the following features: (i) extending the converter Z-size to match Z-size of the E-trap; (ii) aligning the converter along the generally curved E-trap; (iii) keeping short X-distance (relative to X-size of E-trap) between the converter and the E-trap for wider m/z range of admitted ions; and (iv) sustain deep vacuum in the E-trap in the range under 1E-9 Torr and ultimately under 1E-11 Torr. The proposed solution differs from prior art gas filled RF ion traps which would do not provide those features.

Figure 59:
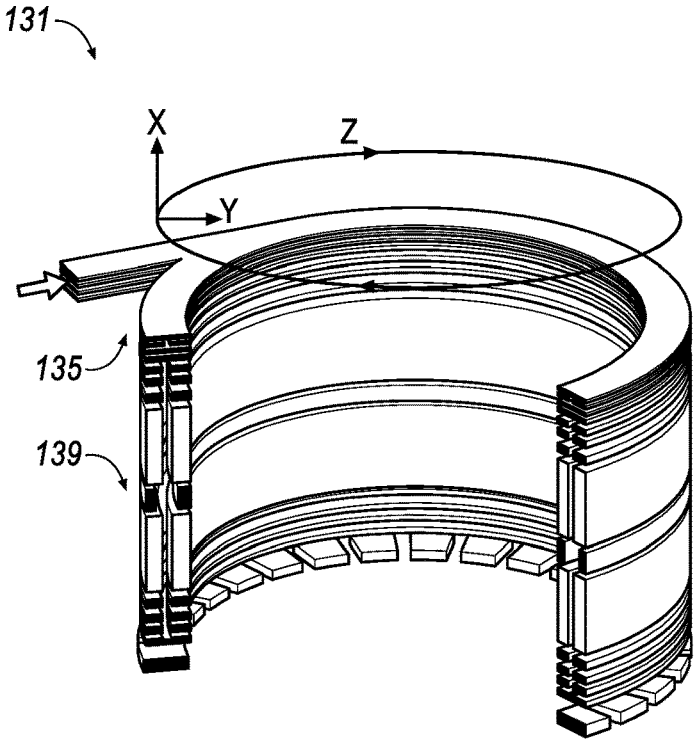
FIG. 59 shows a schematic of a curved pulsed converter suited for cylindrical embodiment of E-trap.
Figure 62:
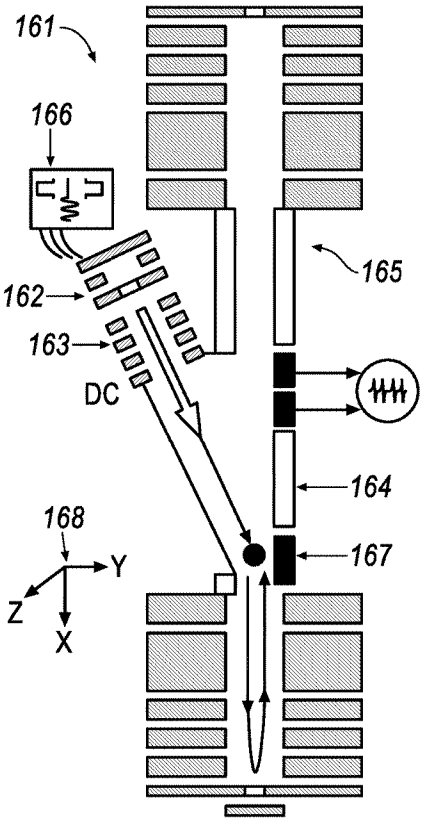
FIG. 62 presents an embodiment of ion injection via a pulsed deflector.
Figure 61:
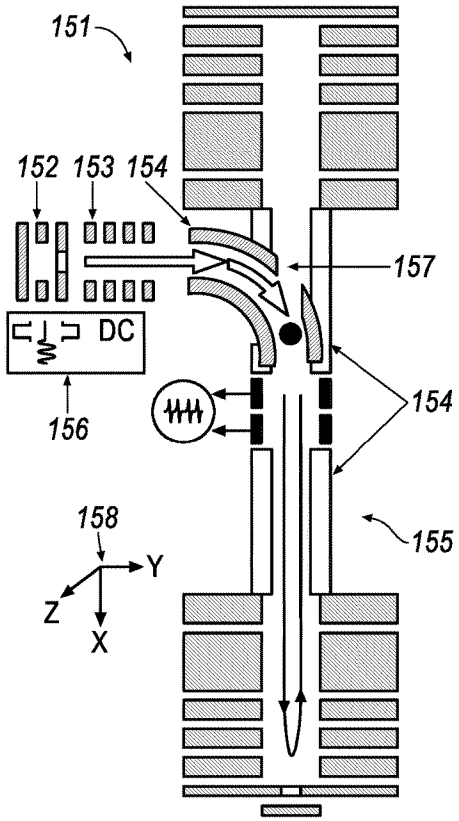
FIG. 61 presents an embodiment of ion injection via a pulsed electrostatic sector.
Figure 60:
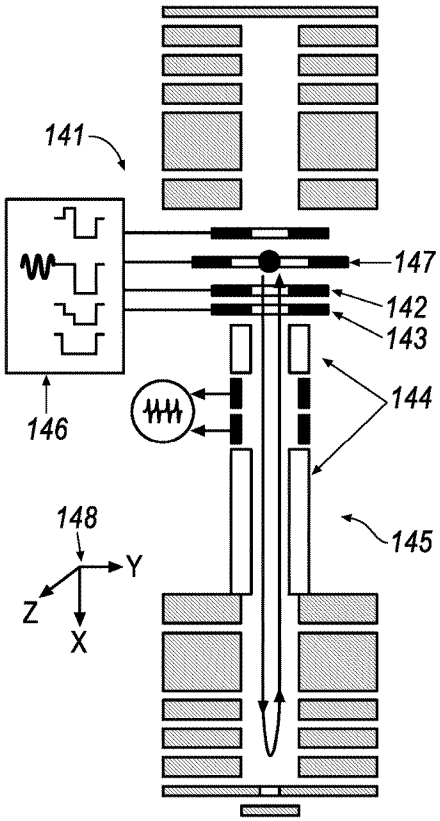
FIG. 60 presents an embodiment of a pulsed converter protruding through a field-free space of E-trap.

This disclosure proposes multiple embodiments of the ion injection (FIGS. 58-62) from the linear RF trap converter of FIG. 58 into E-traps. Referring to FIG. 59, for example, a cylindrical embodiment 131 including an E-trap 139 is formed by a curved pulsed converter 135. This disclosure also proposes multiple methods for utilizing those embodiments. In those methods, the confining RF field is optionally switched off prior to the ion ejection. In one method, once the converter 125 is filled, ions are radial injected through the side slit 126 and through the slit in the mirror cap 128. At injection time, the potential of mirror cap 128 is brought lower to introduce ions into the electrostatic trap. Once the heaviest ions leave the mirror cap region, the potential of the mirror cap 128 is brought to the normal reflecting value. Exemplar values of switching mirror voltages are discussed previously and shown in FIGS. 39A-39B. In another method, illustrated in FIG. 60, a rectilinear ion pulsed converter 142 and a pulsed accelerator 143 protrude through a field-free region 144 of an electrostatic trap 145. Once the converter 142 is filled with ions, the RF signal is switched off and a set of pulses is applied to the converter 142 and the accelerator 143 to inject ions into the field-free region 144 of the electrostatic trap 145. After injection the potentials on the converter 142 and on the accelerator 143 are brought to the potential of the field-free region 144, to allow not distorted ion oscillations. The embodiment allows steady mirror voltages but requires complex RF and pulsed signals. Referring to FIG. 61, in another embodiment 151, ions are injected into E-trap via an electrostatic sector 156. The sector bends ion trajectories, so that they become aligned with the X-axis 158 of the electrostatic trap 155. After injection, the sector field is switched off to allow non distorted ion oscillations in E-trap. Because of moderate requirements to the initial time spread of ion packets the sector field can be made of any convenient angle, e.g. 90 degrees. The sector can serve as an elongated channel for separating differentially pumped stages. The embodiment sets limitations onto the accepted m/z range. Referring to FIG. 62, yet in another embodiment 161, ions are injected via a pulsed deflector 167. The trajectories get steered by the deflector 167 to become aligned with the symmetry X-axis of E-trap 165. Pulsed deflector also limits the accepted m/z range.

In one group of embodiments, the radial size of the ion thread in the X-Y plane is reduced by using small inscribed radius r of the RF converter (r=0.1-3 mm). The thinner ion packets would be compatible with miniaturized (under 1-10 cm in X-direction) E-traps or allow higher resolving power of a larger E-trap. To sustain m/z range, the frequency of RF field should be adjusted as 1/r. Such compact converter may be manufactured by one manufacturing method of the group: (i) electro erosion or laser cutting of plate sandwich; (ii) machining of ceramic or semi-conductive block with subsequent metallization of electrode surfaces; (iii) electroforming; (iv) chemical etching or etching by ion beam of a semi-conductive sandwich with surface modifications for controlling conductivity; and (v) using ceramic printed circuit board technology.

In another embodiment (not shown), the injection means comprise an RF ion trap with an axial ion ejection. Said trap is set near the Z-edge of the E-trap and tilted at small angle to X-axis. Ions are pulsed injected via a field free region into the trap. The solution retains full m/z range but compromises space charge capacity of the converter.

Figure 63:
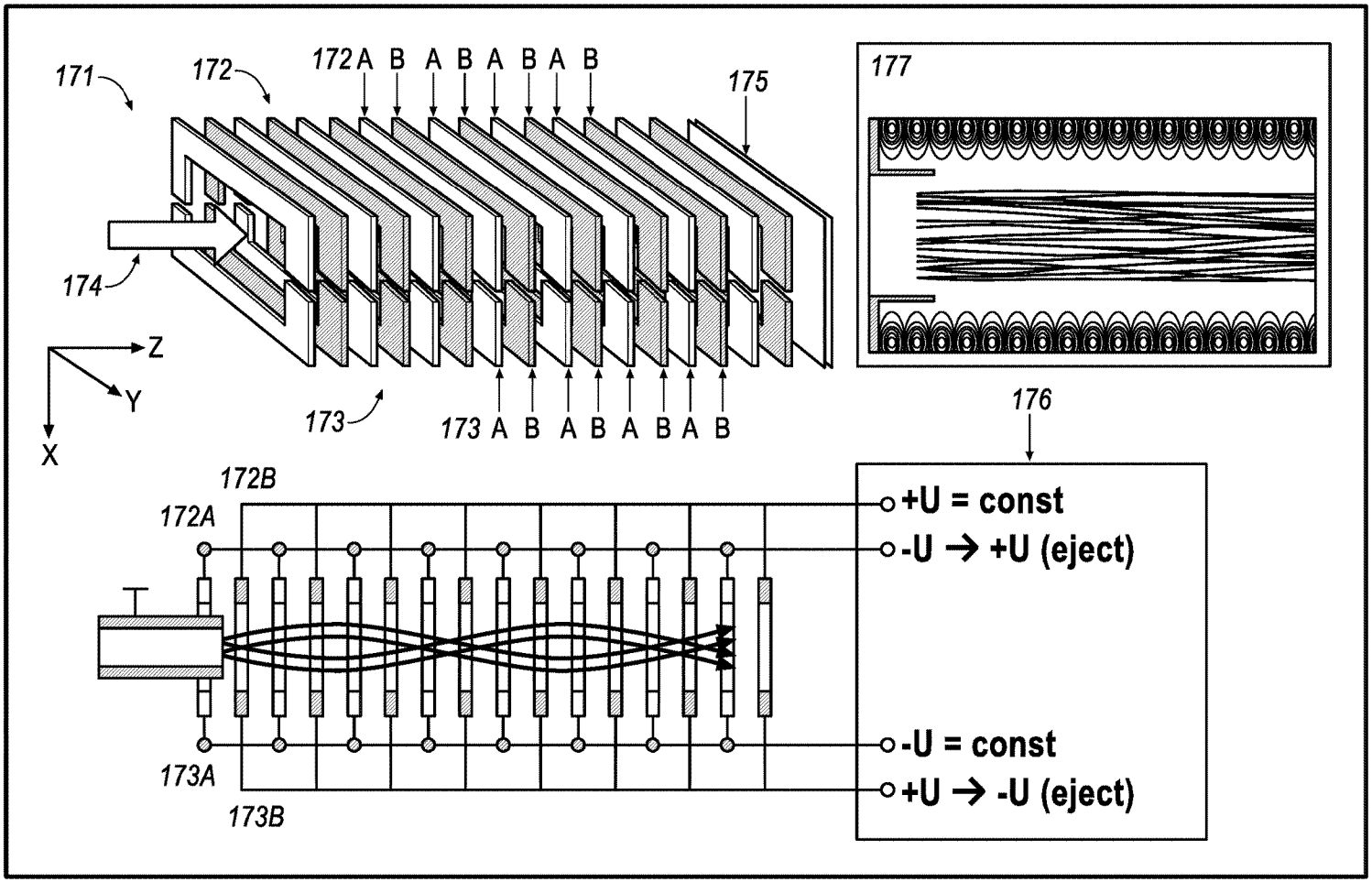
FIG. 63 presents an embodiment of ion injection via electrostatic ion guide.

Referring to FIG. 63, yet in another alternative embodiment, the pulsed converter comprises an electrostatic ion guide 171. The guide is formed by two parallel rows of electrodes 172 and 173. Each row contains two alternated electrode groups 172A, 172B and 173A, 173B. The spacing between the adjacent electrodes is preferably at least two times smaller than the X-width of the channel. The entrance side of the guide is annotated by the wide arrow 174, which also indicates the direction of the entering ion beam. The exit side of the guide 171 is optionally equipped with a reflector 175. A switched power supply 176 feeds two equal and opposite polarity static potentials U and −U, to electrodes 172A, 172B and 173A, 173B in a spatially alternated manner and switches them at ion ejection.

In operation, a continuous, slow and low diverging ion beam is introduced via the entrance side of the ion guide. Preferably, potentials U on the guide relate to the energy E of the propagating ion beam 174 as $0.01\ U<E/q<0.3\ U$. Spatially alternated potentials create a series of weak electrostatic lenses which retain ions within the channel. The ion retention is illustrated by simulated ion trajectories shown in the icon 177. Once ions fill the gap the potentials on electrode groups 172A and 173B is switched to the opposite polarity. This would create an extraction field across the channel and would eject the ions in-between the electrodes 173. The embodiment is free of RF fields which eliminates pick up by detector electrodes. It also allows extending the X-size of ion packets for detection of the main oscillation harmonics.

Figure 64:
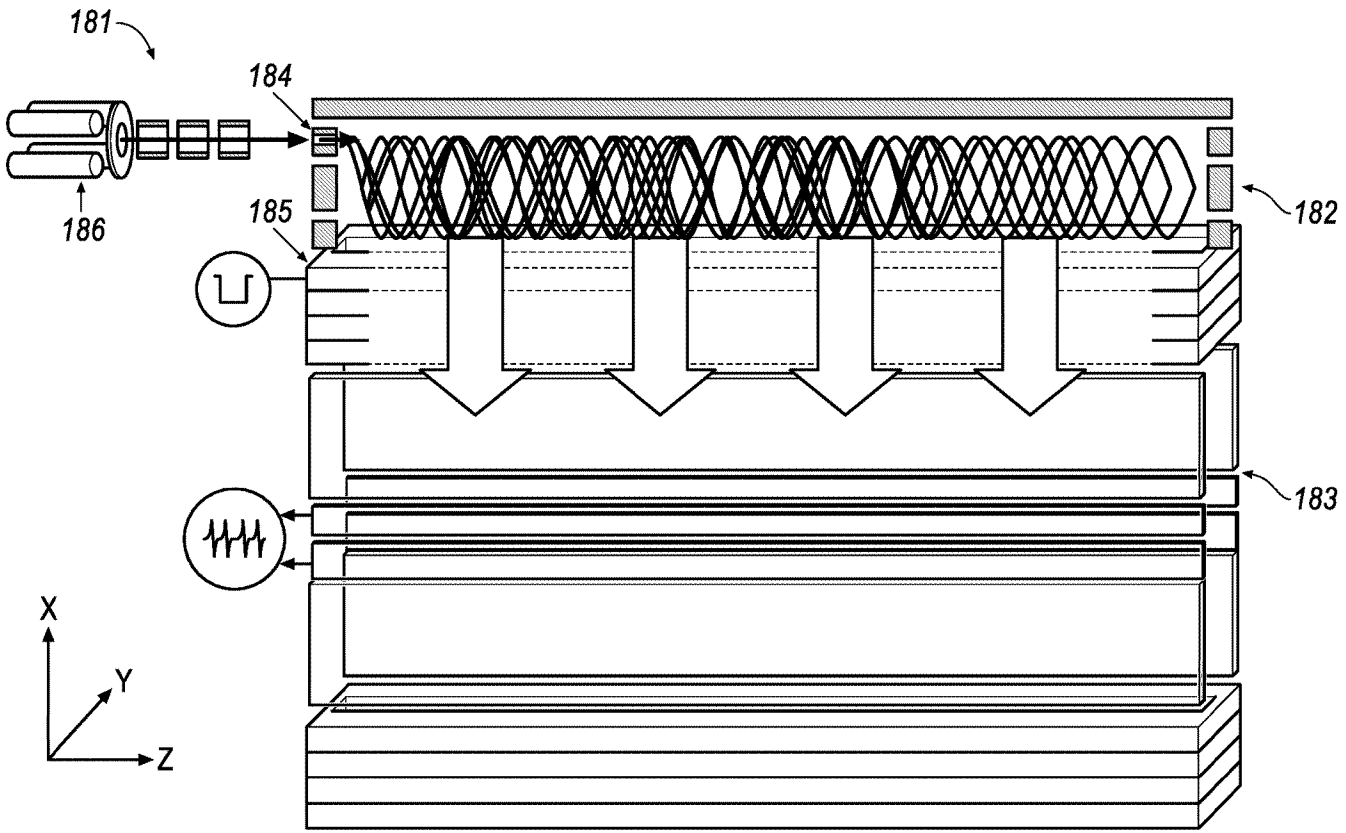
FIG. 64 presents an embodiment of a pulsed converter made of equalizing E-trap.

Referring to FIG. 64, in another embodiment 181, an equalizing E-trap 182 is proposed for injecting elongated ion packets into the analytical E-trap 183. Compared to analytical E-trap 183, the equalizing E-trap 182 is made at least two-fold shorter in X-direction and it employs simpler geometry, since it should not be isochronous. Preferably, a quasi-continuous ion beam is introduced via a Z-edge of the equalizing E-trap and via an electrode 184. Preferably, the electrode 184 is made relatively long in the X-direction to minimize energy spread of ions and it is set at the accelerating potential. A linear RF ion guide 186 generates a quasi-continuous ion beam of 0.1-1 ms duration. The ions enter via an aperture 185 of electrode 184 and get accelerated along the X-direction to the acceleration energy. Due to edge fields and due to initial ion energy in Z directions the ions propagate through the equalizing trap along a jig-saw ion trajectory. The continuous ion beam fills the equalizing E-trap and ions of all m/z fill the X-space homogeneously. After injection, the potential of the joint mirror electrode 185 get lowered to pass ions from the equalizing E-trap 182 into the analytical E-trap 183. The method provides ion packets which are equally elongated for all m/z components and is useful when applying FFT or FDM methods of spectral analysis wherein the pick up signals should be brought to sinusoidal at main oscillation harmonics.

To allow grounding of a pulsed converter, one embodiment employs an elevator electrode. Once ion packet fills the elevator space, the potential of the elevator electrode is brought up to accelerate ions at the elevator exit.

Gain Adjustment and E-Trap Multiplexing for Tandems

Similarly to other types of MS the novel E-trap is suitable for tandems with various chromatographic separations of neutrals and with mass spectrometry or mobility separations of ions.

Figure 65:
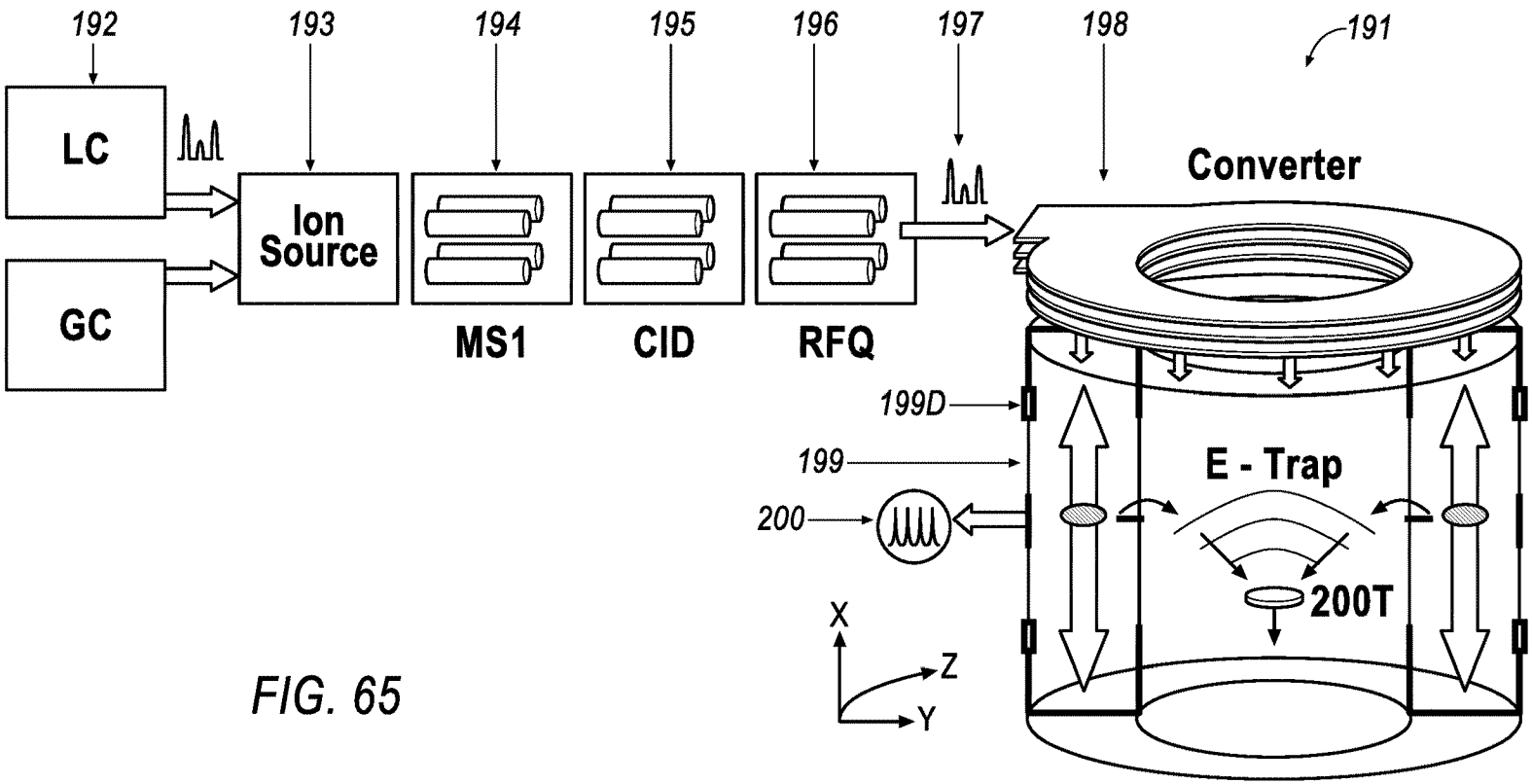
FIG. 65 is a schematic view of a cylindrical E-trap mass spectrometer combined with a chromatograph and with a first MS for MS-MS analysis.

Referring to FIG. 65, the most preferred embodiment 191 of the invention comprises a sequentially connected chromatograph 192, an ion source 193, a first mass spectrometer 194, a fragmentation cell 195, a gaseous radio frequency RF ion guide 196, a pulsed converter 198, and a cylindrical electrostatic E-trap 199 with an image current detector 200 and a time-of-flight detector 200T. The trap has an optional ring 199D electrode for correcting radial ion displacement. Variation of ion flux into E-trap is depicted by the symbolic time diagram 197.

The chromatograph 192 is either a liquid (LC), or a gas (GC) chromatograph, or capillary electrophoresis (CE) or any other known type of compound separators, or a tandem including several compound separation stages, like two-dimensional GC×GC, LC-LC, LC-CE, etc. The ion source may be any ion source of the prior art. The source type is selected based on the analytical application and, as an example, may be of one the list: Electrospray (ESI), Atmospheric Pressure Chemical Ionization (APCI), Atmospheric pressure Photo Ionization (APPI), Matrix Assisted Laser Desorption and Ionization (MALDI), Electron Impact (EI) and Inductively Coupled Plasma (ICP). The first mass spectrometer MS1 194 is preferably quadrupole, though may be an ion trap, an ion trap with mass selective ejection, a magnetic mass spectrometer, a TOF, or another mass separator known in the prior art. The fragmentation cell 195 is preferably a collision activated dissociation cell, though may be an electron detachment or a surface dissociation cell, or a cell for ion fragmentation by metastable atoms, or any other known fragmentation cell or a combination of those. The ion guide 196 may be a gas filled multipole with an RF ion confinement, or any other known ion guide. Preferably, the RF guide is rectilinear to match the ion pulsed converter of the electrostatic trap. The converter 198 is preferably a rectilinear RF device with radial ejection which is shown in FIG. 58 and FIG. 59, though may be any converter shown in FIG. 60-FIG. 64. The electrostatic trap 199 is preferably the cylindrical trap described in FIG. 59, though may be the planar trap of FIG. 58 or a circular sector trap 42,43 or 44 as depicted in FIGS. 5-7 or any other E-trap depicted in FIG. 4-31. In this particular example, the electrostatic trap is employed as a second stage mass spectrometer MS2. The detection means are preferably a pair of differential detectors with a single channel data acquisition system, though may comprise multiple detector segments split either in Z or X-direction, so as multiple data systems, or a time-of-flight detector optionally used in combination with an image charge detector.

The LC-MS-MS and the GC-MS tandems imply multiple requirements on the electrostatic trap, such as synchronization of major hardware components and the adoption to variable signal intensities. The ion flux from the ion source varies in time. Typical width of chromatographic peaks is 5-15 seconds in the LC case, about 1 second in the GC case and 20-50 ms in the GC×GC case. The novel E-trap is expected to provides an acquisition speed up to 50-100 spectra/sec at R=100,000 which exceeds typical chromatographic requirements, but is needed either for tandem MS of multiple precursors, or for time deconvolution of nearly coeluting components.

For MS-MS analysis one can employ multiple strategies comprising: (a) data dependent analysis where the parent mass and the duration of individual MS-MS steps are selected based on parent mass spectra; (b) all mass MS-MS analysis at higher acquisition speed, e.g. MS1 scan is made in 1 second at 500 resolution and MS2 is made in E-trap with 10,000 resolution; (c) data dependent analysis wherein parent ion masses and fill-time are selected for high resolution analysis based on all-mass MS-MS analysis at a moderate resolution.

During weak chromatographic peaks the sensitivity of the instrument is limited by the amplifier noise and by the relatively short acquisition time. It is advantageous increasing the trap filling time and the data acquisition time during elution of weak chromatographic peaks, while accounting such the adjustments at the final determination of compound concentration. The duration of the ion filling and of the signal acquisition could be increased up to ten times before affecting the GC separation speed and up to 50-100 times before affecting the LC separation speed.

One method of the gain adjustment of E-trap operation is best suited for LC-MS and GC-MS analysis. The method comprises the following steps: admitting a variable ion flux into the ion guide 196; measuring a momentarily ion current $I_F$ from the ion guide into the converter; adjusting a duration $T_F$ of ion flow into the converter in order to fill the converter with the preset target number of charges $N_e=I_F*T_F/e$; injecting said ions from the converter into the electrostatic trap 199; adjusting the data acquisition time within the electrostatic trap equal to $T_F$, and attaching the information on the fill-time to spectra file; and then going towards the next time step. The mass spectrometry signal is then reconstructed with the account of the recorded signal and the fill time. Ion current into the converter could be measured e.g. on electrodes of the transfer optics. Alternatively, the ion current can be measured based on the signal intensity from the previous spectra. The target number of charges $N_e$ could be set with wide boundaries in order to quantize fill time. As an example fill time could be varied 2-fold per step. Additional criteria may be employed for setting the fill time $T_F$. For example, a minimal acquisition time could be set to maintain minimal resolution through chromatogram. A maximal acquisition time could be set to sustain a sufficient chromatographic resolution. The user choice of the preset target number of charges $N_e$ is expected to account the average signal intensity from the employed ion source, a concentration of the sample and multiple other parameters of the application. Alternatively, the ion filling time can be periodically alternated such that to choose between the signal sets at the data analysis stage.

The tandem analyses can be further improved if using E-trap multiplexing shown in FIGS. 32-38. The proposed multiplexing is formed by making multiple sets of aligned slits within the same set of electrodes to form multiple volumes, each corresponding to individual E-trap. This allows economic manufacturing of multiplexed E-traps, sharing the same vacuum chamber and the same set of power supplies. The E-trap multiplexing is preferably accompanied by multiplexing of pulsed converters. Then the ion flow or time slices of the time flow or flows from multiple ion sources could be multiplexed between the pulsed converters. In one method, a calibrating flow is used for the purpose of mass and/or sensitivity calibration of multiple E-traps. In one particular embodiment 53, the same flow is rotationally multiplexed between multiple E-traps.

In one method, multiple electrostatic traps are preferably operated in parallel for analysis of the same ion stream for the purpose of further enhancement of the space charge capacity, the resolution of the analysis, and the dynamic range of electrostatic traps. E-trap multiplexing allows extending acquisition time and enhance resolution. In another method, multiple electrostatic traps are employed for different time slices of the same ion stream, coming either from ion source with variable intensity, or from MS1 or IMS. The time fractions of the main ion stream are diverted between multiple electrostatic traps in a time-dependent or data-dependent fashion. The time slices could be accumulated within multiplexed converters and be simultaneously injected into parallel electrostatic traps with a single voltage pulse. The parallel analysis may be used for multiple ion sources, including a source for calibrating purpose. Yet in another method, the multiplexed analysis in a set of electrostatic traps is combined with a prior step of crude mass separation of ion streams into m/z fractions or ion mobility fractions, and forming the sub-streams with narrower m/z ranges. This allows using narrow bandwidth amplifiers with a significantly reduced noise level and this way improving the detection limit, ultimately, to single ion.

Mass Selection in E-Trap

The ion packets can be indefinitely confined within the electrostatic ion trap for many thousands of oscillations wherein number of oscillation is limited by slow losses due to the scattering on residual gas and due to coupling of the ion motion to the detection system. In one method of the invention, a weak periodic signal is applied to trap electrodes, such that the resonance between the signal and the ion motion frequencies is utilized either for a removal of particular ionic components, or for a selection of individual ionic components by a notched waveform, or for a mass analysis with resonant ion ejection out of the ion oscillation volume onto a Time-of-flight detector or into a fragmenting surface or for passage between E-trap regions. The component of interest would be receiving distortions at every cycle, while the temporary overlapping in space components would be receiving only few distortions. If choosing low distortion amplitudes and if accumulating the distortions through many cycles there will appear sharp resonance in the ion removal/selection. For excitation of X, Y or Z-motions it is preferable using some electrodes in the field free-region and to apply a string of periodic deflecting/accelerating short pulses which would exactly fit the timing of ion packet passage for a particular ionic component. Resonant excitation in the Z-direction is most preferable, since they do not affect oscillation frequencies. The potential barriers at Z-edges are weak (1-10 eV) and it would take a moderate excitation to eventually eject all the ions of particular m/z range through a Z-barrier even if the excitation pulses are applied within a fraction of Z-width.

Figure 66:
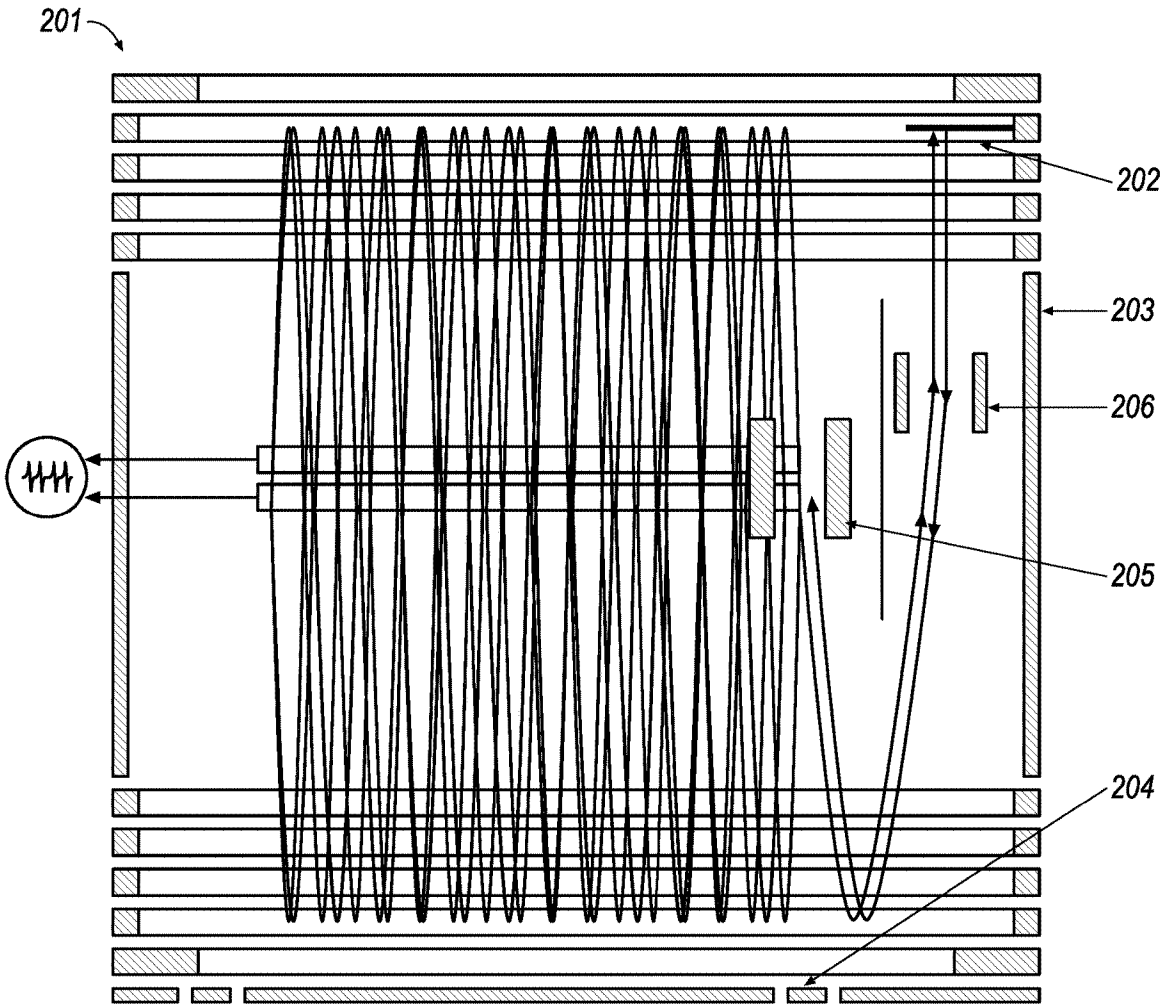
FIG. 66 demonstrates principles of ion selection, surface induced fragmentation, and mass analysis of fragment ions within the same E-trap apparatus.

Referring to FIG. 66, an example of MS-MS method employs an opportunity of MS-MS in electrostatic traps. Ion selection in electrostatic traps is preferably accompanied by a surface induced dissociation on a surface 202 of an electrostatic trap 201. An optimal location of such the surface is in the region of ion reflection in X-direction within the ion mirror wherein ions have moderate energy. To avoid field distortions during the majority of ion oscillation the surface 202 may be located at one Z-edge 203 of the electrostatic trap 201. The surface is preferably located beyond the weak Z barrier, formed e.g. by an electronic wedge 204. Ion selection is achieved by a synchronized string of pulses applied to electrodes 205. Ions with mass of interest would accumulate the excitation in Z-direction and would pass the Z-barrier. Once primary ions hit the surface, they form fragments which are accelerated back into the electrostatic trap. Preferably, to avoid repetitive hitting of the fragmentation surface a deflector 206 is employed. The method is particularly suitable in case of using multiple electrostatic traps wherein each trap deals with relatively narrow mass range of ions.

Although the present invention has been describing with reference to preferred embodiments, it will be apparent to those skilled in the art that various modifications in form and detail may be made without departing from the scope of the present invention as set forth in the accompanying claims.

The invention claimed is:

1. An apparatus for detecting ions moving along a curved or linear T-direction, said apparatus comprising at least one of:

an image current detection system comprising:

at least one detection electrode, with said moving ions inducing an image current signal on the at least one detection electrode;

a differential signal amplifier picking the signal between the at least one detection electrode and surrounding electrodes or ground; and an analog-to-digital converter arranged to record the image current signal induced on the at least one detection electrode; and a time-of-flight detection system arranged to detect a fraction of the moving ions comprising:

an ion-to-electron converting surface residing within at least a portion of a path of the moving ions; and a time-of-flight detector residing outside of the path of the moving ions, wherein the fraction of the moving ions represents less than ten percent of all of the moving ions.

2. The apparatus of claim 1, wherein the apparatus comprises both the image current detection system and the time-of-flight detection system.

3. The apparatus of claim 2, wherein the at least one detection electrode comprises more than one adjacently arranged segments of detection electrodes.

4. The apparatus of claim 2, wherein the moving ions are in motion within one of: (i) an ion trap mass spectrometer; (ii) an electrostatic trap using electrostatic sectors; (iii) a magnetic trap; (iv) a penning trap; (v) an ICR cell; (vi) an orbital trap; and (vii) a linear radio frequency ion trap.

* * * * *